US005117266A

United States Patent [19]

Takemura et al.

[11] Patent Number: 5,117,266

[45] Date of Patent: May 26, 1992

[54] RECIRCULATING DOCUMENT HANDLER AND IMAGE FORMING APPARATUS EQUIPPED THEREWITH

[75] Inventors: Kazutaka Takemura; Hirokazu Matsuo; Yusuke Morigami; Wataru Hamakawa; Takuma Ishikawa, all of Osaka, Japan

[73] Assignee: Minolta Camera Kabushiki Kaisha, Osaka, Japan

[21] Appl. No.: 745,237

Related U.S. Application Data

[62] Division of Ser. No. 499,909, Mar. 27, 1990.

[22] Filed: Aug. 14, 1991

[30] Foreign Application Priority Data

| | | | |
|---|---|---|---|
| Mar. 31, 1989 | [JP] | Japan | 1-082202 |
| Mar. 31, 1989 | [JP] | Japan | 1-082203 |
| Mar. 31, 1989 | [JP] | Japan | 1-082204 |
| Mar. 31, 1989 | [JP] | Japan | 1-082205 |
| Mar. 31, 1989 | [JP] | Japan | 1-082206 |

[51] Int. Cl.[5] ..... G03G 21/00

[52] U.S. Cl. ..... 355/316; 271/3.1; 355/308; 355/321

[58] Field of Search ..... 355/308, 309, 311, 316–318, 355/320, 321, 322, 203–206, 208, 209; 271/3, 3.1, 7, 10, 65, 186, 241, 902

[56] References Cited

U.S. PATENT DOCUMENTS

| | | | |
|---|---|---|---|
| 4,184,671 | 1/1980 | Sasamori | 271/18 |
| 4,231,562 | 11/1980 | Hori | 271/3.1 |
| 4,345,751 | 8/1982 | Holzhauser | 271/3.1 |
| 4,727,401 | 2/1988 | Partilla et al. | 355/319 |
| 4,731,637 | 3/1988 | Acquaviva et al. | 355/317 |
| 4,786,039 | 11/1988 | Ito | 271/3.1 |
| 4,866,484 | 9/1989 | Murai | 355/313 |
| 4,881,729 | 11/1989 | Culligan et al. | 271/3.1 |
| 4,937,623 | 6/1990 | Nishimori et al. | 355/233 |
| 4,996,568 | 2/1991 | Hamakawa | 355/308 |

FOREIGN PATENT DOCUMENTS

| | | | |
|---|---|---|---|
| 56-39559 | 4/1981 | Japan | 355/317 |
| 58-173759 | 10/1983 | Japan | 355/309 |
| 61-23038 | 1/1986 | Japan . | |
| 61-150949 | 7/1986 | Japan . | |
| 62-270941 | 11/1987 | Japan . | |
| 63-282029 | 11/1988 | Japan . | |
| 2-8145 | 1/1990 | Japan . | |

*Primary Examiner*—A. T. Grimley
*Assistant Examiner*—Matthew S. Smith
*Attorney, Agent, or Firm*—Burns, Doane, Swecker & Mathis

[57] ABSTRACT

An automatic original feeding handler adapted for transporting an original to a reading portion in an image forming apparatus. The automatic original feeding handler is provided with an accommodating portion upwardly provided with respect to the reading portion for accommodating originals stacked therein, a supplying member for supplying a lowermost original of the stacked originals one by one to the reading portion, a transporting member for transporting on the reading portion the original supplied by the supplying member and returning that original to the accommodating portion, a counting member for counting the number of the originals and a control member for controlling the supplying member so as to change the timing for start of supplying the original according to a count value counted by the counting member.

10 Claims, 41 Drawing Sheets

#4
scanning mode check process routine

#131
sorting ?
YES
NO
#133
copy number=1?
YES
NO
#134
simultaneous color printing mode
YES
NO
#135
enlarge copy mode ?
YES
NO
#136
A M S ?
YES
NO
#137
book original mode
YES
NO
#138
duplex original mode ?
YES
NO
#139
two-in-one mode ?
YES
NO
#140
duplex / composite copy mode ?
YES
NO
#141
manual feed ?
YES
NO
#132
set optical system scan mode
#142
set original moving scan mode
return original size detecting process
#306

#501
sensor 155 ON edge?
NO
YES
#502
start timer TP
#503
sensor 155 OFF edge?
NO
YES
#504
stop timer TP
#505
A register ← timer TP value × transport speed
#506
A register ≦ 182 ?
NO
YES
#508
A register ≦ 210 ?
NO
YES
#510
A register ≦ 257 ?
NO
YES
#507
original size ← B5Y
#509
original size ← A4Y
#511
original size ← B5T
#512
A register ≦ 297 ?
#514
A register ≦ 364 ?
NO
YES
#516
original size ← A3
#515
original size ← B4
#513
original size ← A4T
return

TABLE A

| outlet | 1 | | 2 | | 3 | | 4 | |
|---|---|---|---|---|---|---|---|---|
| inlet | LEFT | RIGHT | LEFT | RIGHT | LEFT | RIGHT | LEFT | RIGHT |
| original size | A4Y | B5Y | A4T | B5T | B4T | | A3T | |

Ⓡ: 106a
Ⓛ: 106c

RECIRCULATING DOCUMENT HANDLER AND IMAGE FORMING APPARATUS EQUIPPED THEREWITH

This application is a division of application Ser. No. 07/499,909, filed Mar. 27, 1990.

BACKGROUND OF THE INVENTION

1. Field of the Invention

The present invention relates to image forming apparatus such as copying machines and laser beam printers, and to a recirculating document handler for use with the image forming apparatus or the like.

2. Description of the Related Art

In recent years, image forming apparatus have been proposed which are provided with a recirculating document handler on the glass platen of the apparatus for exposing documents to light and reading images thereof to eliminate the need for the user to place the document sheets one by one on the glass platen.

The recirculating document handler has a document containing portion for accommodating a stack of documents and delivering the documents by a feed roller one by one from the lowermost position, and transport means for transporting the delivered document onto the glass platen for image exposure or reading and thereafter returning the document onto the remaining stack of documents accommodated in the containing portion. With use of the handler thus constructed, a multiplicity of documents can be transported therethrough in circulation one sheet after another in the order in which they are stacked up, with the result that the documents can be fed to the glass platen in the stacked order and thereafter collected automatically.

The document handler further has a return document holder for holding the documents as stacked up in the containing portion when the document is delivered from the containing portion. When a sheet of document is returned while the holder is in the document holding position, the sheet of document is arrested by the holder on the documents set in the containing portion, whereby the returned document is distinguished from the set documents to be fed. The return document holder is integrally formed with a plurality of projections for holding the set documents at widthwise different portions thereof and for arresting the returned document. Nevertheless, the documents previously set in position are not always planar, or the document setting tray of the containing portion, feed mechanism or recirculating transport mechanism will produce undulations of documents or locally raise some documents, so that a clearance not infrequently occurs between the document and one of the plurality of projections which are integral with the single document holder.

Consequently, the projection in contact with the set document is likely to arrest the forward end of the returning document at a one-sided position, or the returning document will be arrested at only one portion. It is then likely that the returning document will skew under the raised projection owing to an uneven arresting action or unbalanced resistance involved in the return travel.

Such a skew will not always be fully corrected even if the returned document is set in the feed position again for the subsequent feeding. Furthermore, repeated transport of documents in circulation is likely to entail a greater disturbance. Consequently, the document will jam the handler, or copy images become oriented improperly.

Additionally, the return document holder is so disposed as to function at a position downstream, with respect of the feeding direction, from the feed roller for delivering the set documents from the containing portion one sheet after another at the lowermost position. Accordingly, the set documents are subjected to the transport action of the feed roller at a portion upstream from the portion thereof held by the holder. Thus, while being subjected to the transport action, the set documents are offered resistance against this action by being held by the holder at the downstream position. As a result, some of the set documents tend to deviate upward, forming a loop between the holding position and the position where the transport action is exerted thereon. This loop could lead to improper transport.

The document holder holds the stacked documents at all times, so that as documents are dispensed from the lowermost position, upper documents also inch forward, forming an upward loop between the document transport means in the downstream position and the document holder. This loop can also be a cause of faulty transport.

The above problem becomes more serious as the number of set documents decreases or if the documents are thinner; the document becomes wrinkled and is therefore liable to cause a jam.

Further, with the image forming apparatus equipped with the recirculating document handler described, it is common practice to set the apparatus in a document moving scan mode wherein the document is scanned for image exposure or reading while the document is being transported in order to execute a high-speed process. In this mode documents are successively delivered from the containing portion at the greatest possible rate for continual image exposure or reading and are thereafter returned to the containing portion.

However, the return of the first document to the containing portion is likely to overlap the delivery of the final document from the containing portion owing to the conditions involved such as document size, number of set documents, feeding interval or length of the document transport path. If the speed of return of the document to the containing portion is higher than the speed of delivery of the document therefrom at this time, the front end of the returning document impinges on the rear end of the document being delivered for feeding. It is then likely that the document to be fed or the return document will skew, or that the return document is positioned beneath the outgoing document and dragged along thereby for feeding. Consequently, a document jam occurs, or the last document is not handled properly for image exposure or reading through interference with the first document.

The document handler described further has a document conveyor belt means in pressing contact with the upper surface of the glass platen for image exposure in the above-mentioned document moving scan mode.

Depending upon where the image scan point is set on the glass platen or depending upon the size of documents to be handled, transport means such as transport rollers adjacently disposed to the conveyer belt means, on the upstream side of the conveyor belt means with respect to the direction of transport of the document and, along with the conveyor belt means extending along the platen at the same time, operates on the document moving past the image scan point.

It therefore follows that while moving past the scan point, the document is affected not only by the speed of transport by the conveyor belt means but also by the speed of transport by the transport means adapted to transport the document to the conveyor belt means and disposed upstream from the conveyor belt means with respect to the direction of document transport by the conveyor belt means. It is therefore often likely that the document image will not be scanned at a constant speed.

For example, suppose the speed of transport by pinch rollers upstream from the conveyor belt means is lower than that by the conveyor belt means, and the transport force of the conveyor belt means is smaller than that of the pinch rollers. When the document is in engagement with both the pinch rollers and the conveyor belt means the document is transported at a low speed restricted by the transport speed of the pinch rollers, and when released from the pinch rollers, the document is freed from the restraint by the transport speed of the pinch rollers. The document is then further transported at the high speed of the belt means. Thus, the document scan speed changes from low to high during scanning and fails to ensure a constant-speed scanning operation.

The conveyor belt means has a conveyor belt, a drive roller provided inside the belt for driving the belt, and a driven roller to be driven by the drive roller and biasing the conveyor belt in the direction of transport of the document. Accordingly, the conveyor belt is held tensioned at all times to transport documents with good stability. An adjacent transport path for accepting the document transported by the conveyor belt means is provided on the downstream side of the driven roller which is movable inside the conveyor belt. A transport guide is interposed between the driven roller and the adjacent transport path. It is desired that the distance between the transport guide and the portion of the conveyor belt biased by the driven roller (hereinafter referred to as the "movable tensioned portion") be held constant so that the document can be reliably transferred from the conveyor belt means to the adjacent transport path.

Nevertheless, the transport guide is fixedly provided, whereas the conveyor belt end immediately adjacent thereto is moved by the movement of the driven roller toward the document transport direction, altering the clearance between the movable tensioned portion of the conveyor belt and the transport guide. As a result, the document will not be guided properly when delivered from the transport path provided by the conveyor belt to the transport path afforded by the transport guide. Hence, there is a likelihood of a jam or of advance of the document in an improper direction.

The recirculating document handler described further has a container unit movable toward the document transport direction for receiving the document returned to the containing portion after the document has been fed to the document reading portion and transporting the document onto the remaining documents accommodated in the containing portion. The container unit, which is provided in the containing portion, has an upper portion greatly projecting beyond the upper surface of the containing portion, i.e. the top side of the document handler.

Since the document handler will be treated like the usual document cover, books or like articles will often be placed on the containing portion. If the container unit is moved in the document transport direction at this time, the upper portion of the container unit projecting above the containing portion will be under load from the article. Further, even if the book or like article is not, placed on, the document handler the unit upper portion is likely to be unload from the operator during the movement of the unit since this portion is greatly projected beyond the top side of the document handler. When the container unit is thus loaded at its upper portion, there arises the problem of the load causing damage to the drive mechanism or the container unit.

The container unit is movable in the document feed direction to handle documents of different sizes to be returned to the containing portion. However, the container unit is adapted to accept documents of slightly different sizes without being moved, for example, to receive a document of legal size and thereafter receive a document of A4 size which is slightly different from the legal size. The container unit is so adapted by being provided with a document receiving opening which is tapered. The tapered opening enables the container unit to handle documents of slightly different sizes, whereas the receiving opening, which is too wide, permits the received document to warp, sometimes failing to receive documents properly with good stability.

The container unit has a discharge roller or its inside for discharging the received document to the containing portion and for transporting the document onto the stack of documents to be fed, and a guide wall disposed at the front of the unit, with respect to the document feed direction, for pushing the rear end of the document during the transport with respect to the document feed direction. The At this time, the discharged document is likely to enter a space between the guide wall and the bottom plate of the containing portion. Furthermore, the friction between the document being transported and the bottom plate of the containing portion is likely to permit the document rear end to escape upward along the guide wall in sliding contact therewith. Such an escape of the document along the guide wall will occur also when the distance between the guide wall and the return document holder, or the distance between the guide wall and a feed document holder disposed downstream from the holder with respect to the document feed direction is made equal to the width of the document.

SUMMARY OF THE INVENTION

The main object of the present invention is to provide a recirculating document handler by which a multiplicity of originals set in a containing portion can be reliably fed in a proper state to an original image reading portion of an image forming apparatus one sheet after another and thereafter be reliably returned to the containing portion.

Another object of the present invention is to provide a recirculating document handler of the type mentioned which has original holding means so adapted that the original fed to the image reading portion of the image forming apparatus and thereafter returned to the containing portion can be properly arrested on the originals to be fed, the holding means further permitting the originals set in position for feeding to be fed in a proper state.

Another object of the present invention is to provide a recirculating document handler of the type described which permits the second original to be fed properly without being interfered with by the original already fed to the image reading portion of the image forming apparatus and thereafter returned to the containing portion.

Another object of the present invention is to provide a recirculating document handler of the type described which is adapted to transport the original over the image reading portion of the image forming apparatus at a constant speed when an original moving scan mode is selected for the apparatus.

Another object of the present invention is to provide a recirculating document handler of the type described which comprises transport belt means for transporting the original delivered from the containing portion onto the original image reading portion of the image forming apparatus in pressing contact therewith, the transport belt means having a transport belt, a drive roller disposed inside the transport belt for driving the transport belt, and a driven roller to be driven by the drive roller and biasing the belt toward the original transport direction, the handler being adapted to reliably transfer the original from the transport belt means to transport guide means adjacent to the belt means.

Another object of the present invention is to provide a recirculating document handler which will operate free of any trouble even if the top side of the handler is loaded by an action of the operator or with a book or the like placed thereon.

Another object of the present invention is to provide a recirculating document handler of the type described wherein the containing portion is internally provided with a container unit movable in the original transport direction and adapted to receive originals of different sizes each in a proper state according to the size and to accommodate the originals therein after each of the originals is returned to the containing portion from the reading portion of the image forming apparatus.

Still another object of the present invention is to provide a recirculating document handler of the type described wherein the containing portion is internally provided with a container portion adapted to receive the original returned from the reading portion of the image forming apparatus and reliably transport the original onto the originals to be fed.

These and other objects, advantages and features of the invention will become apparent from the following description thereof taken in conjunction with the accompanying drawings which illustrate specific embodiments of the invention.

TABLE A shows the relationship between the original size and the original inlets and the original outlets.

DESCRIPTION OF THE PREFERRED EMBODIMENTS

An embodiment of the invention will be described with reference to the drawings.

Figure 1:
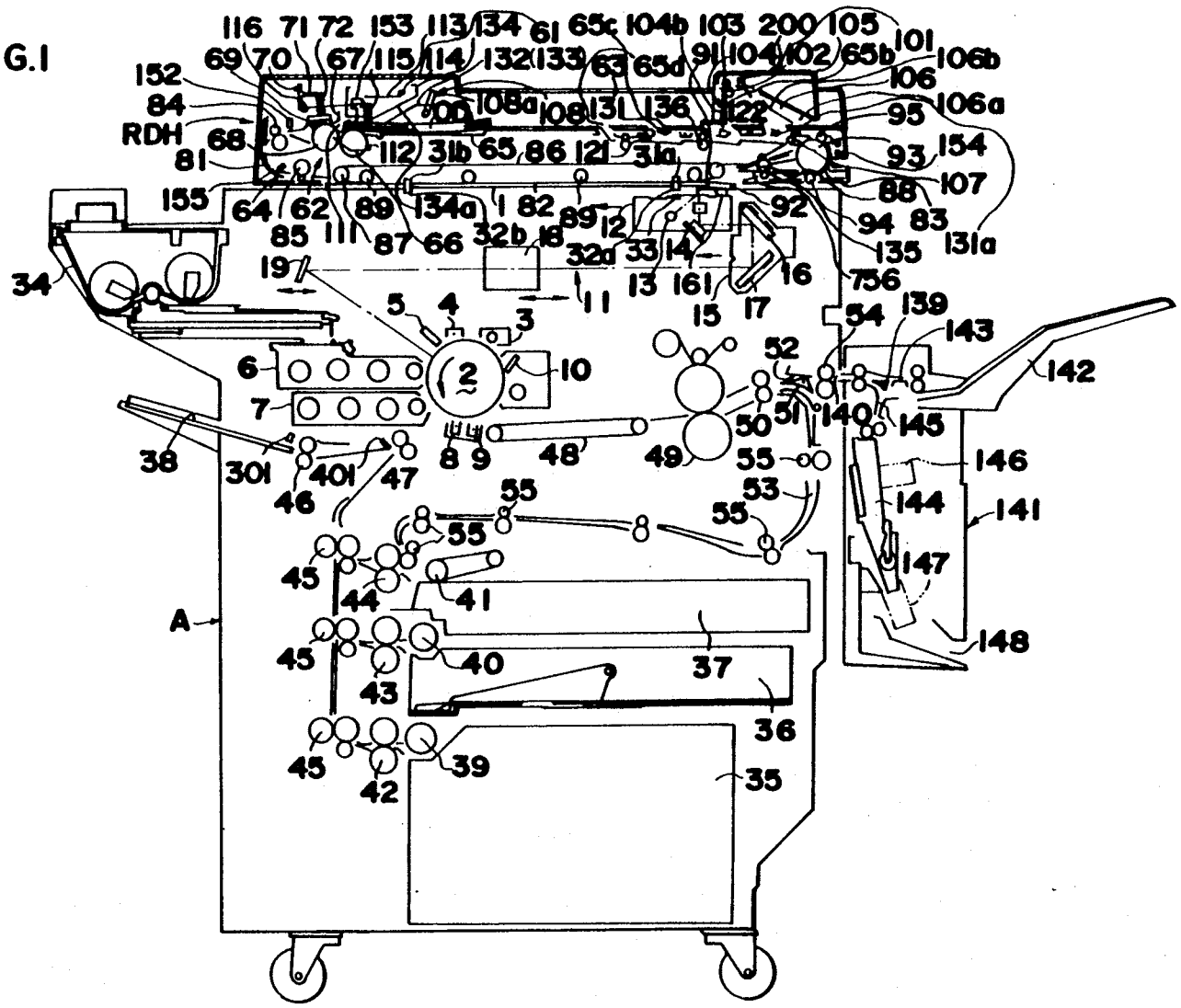
FIG. 1 is a diagram showing the overall construction of a copying machine embodying the invention.
Figure 2:
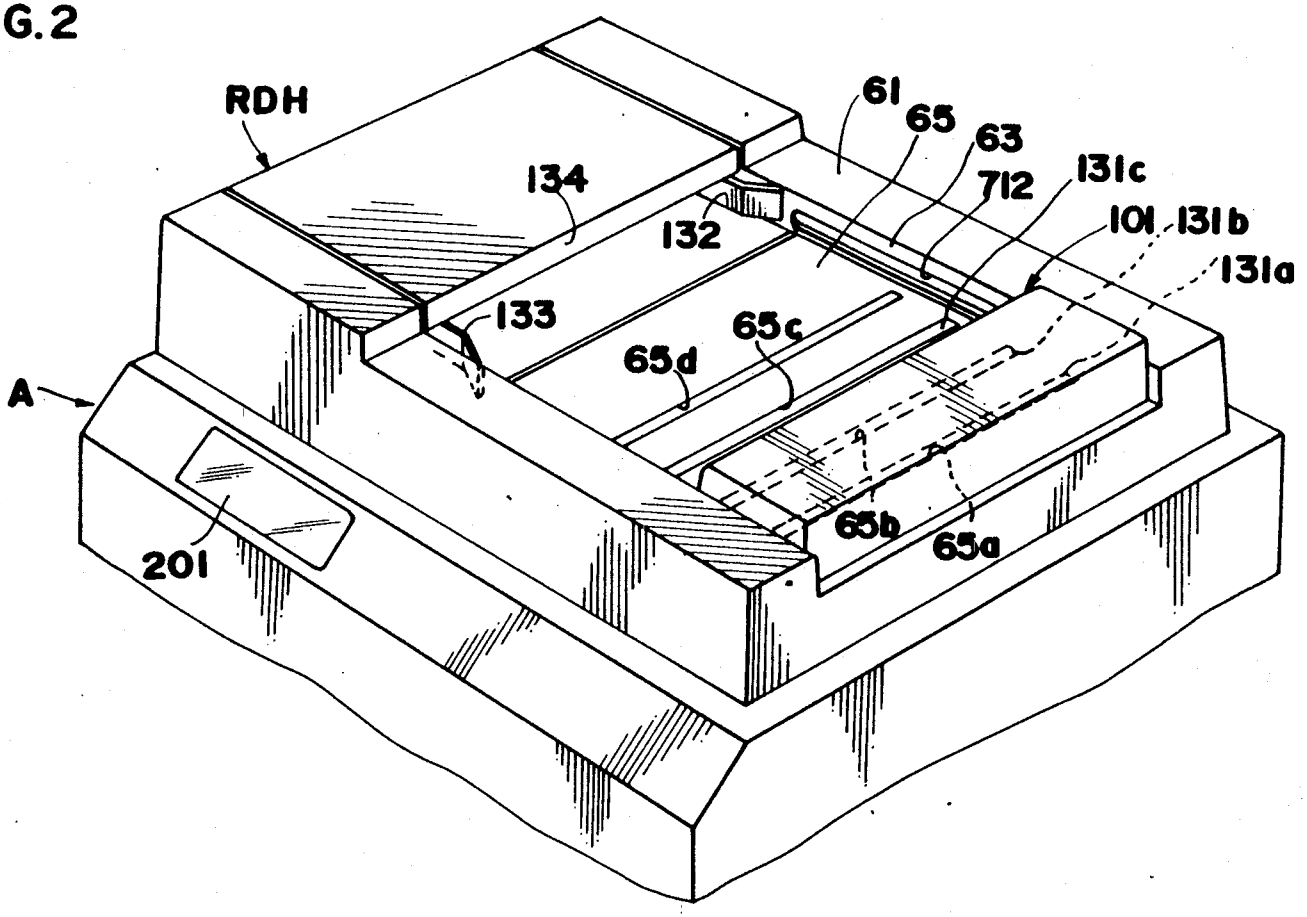
FIG. 2 is a fragmentary perspective view of the appearance of the machine.

The present embodiment comprises a recirculating document handler RDH as attached to a copying machine A as shown in FIGS. 1 and 2.

With reference to FIG. 1, the copying machine A has a glass platen 1 at the top of its body. A photosensitive drum 2 is provided in the upper portion of the interior of the body approximately centrally thereof and is rotatable counterclockwise. Arranged around the drum 2 are an eraser lamp 3, sensitizing charger 4, eraser 5 comprising an LED array, developing units 6, 7, transfer charger 8, separating charger 9 and cleaner 10 of the blade type. These components are arranged one after another in the direction of rotation of the drum 2 in the order mentioned. The drum 2 is formed over its surface with a photosensitive layer, from which residual charges are removed by the eraser lamp 3 and which is thereafter uniformly charged by moving past the sensitizing charger 4.

A projection optical system 11 is disposed under the glass platen 1 for projecting an image of an original on the glass platen 1 on the charged surface of the drum 2. The projection optical system 11 has an exposure lamp 13 and a first mirror 14 which are supported on a first slider 12 serving as a scanner and movable along the lower surface of the glass platen 1, second and third mirrors 16, 17 supported on a second slider 15 operatively related with the first slider 12, a projection lens 18 and a fourth mirror 10.

The first and second sliders 12, 15 are driven by a scan motor (not shown) for moving the exposure lamp 13 and the first mirror 14 at a speed of V/n (wherein n is a magnification) relative to the peripheral speed V of the drum 2, and for moving the second and third mirrors 16, 17 at a speed of V/2n. The original held in position on the glass platen 1 is scanned by the movement of the exposure lamp 13 and the first mirror 14, whereby the drum 2 is exposed in the form of a slit to the entire original image via the second and third mirrors 16, 17, projection lens 18, and fourth mirror 19 to thereby form on the drum 2 an electrostatic latent image corresponding to the entire image of the original. Thus, the original can be copied in a optical system moving scan mode. The movement of the second and third mirrors 16, 17 prevents the change in the length of the optical path despite the movement of the first mirror 14.

With the exposure lamp 13 and the first mirror 14 held at rest as so positioned relative to the platen 1 as to make an image exposure, the projection optical system 11 is also adapted to scan an original which is transported on the platen 1, whereby the drum 2 is exposed in the form of a slit to the entire image of the original. Thus, the original can be copied in an original moving scan mode. The original is transported on the glass platen 1 by the document handler RDH.

Further the projection optical system 11 projects the image for an exposure at a varied magnification, i.e., at a varied copying magnification by having its projection lens 18 shifted axially thereof by a magnification varying motor (not shown).

With the variation in the copying magnification, the scanning speed is altered according to V/n. In the optical system moving scan mode, the speed of movement of the exposure lamp 13 and the first mirror 14 is altered, whereas in the original moving scan mode, the speed of transport of the original is altered in corresponding relation with the varied magnification.

The electrostatic latent image formed on the drum 2 by the projection of the original image is developed with toner to a visible image by moving past the developers 6 and 7. The toner image, when thereafter reaching the transfer charger 8, is transferred onto copy paper forwarded as registered with the toner image. After the transfer, the remaining toner is removed by the cleaner 10 from the drum surface, which is thereafter treated by the eraser lamp 3 and the sensitizing charger 4 for the subsequent exposure.

The developing unit 6 contains a black developer, and the developer unit 7 is for use with a developer, such as red one, other than the black. Either one of the developing units 6, 7 can be selected for developing the latent image. The developing unit in use can be changed over to the other one while developing the latent image formed on the drum 2 by a single exposure, whereby the color of the copy image to be formed on the copy paper fed by a single pass can be changed at an intermediate portion of the image. This copy operation mode will be referred to as the "simultaneous color printing mode."

The position where the color is to be changed in the simultaneous color printing mode can be set by a shifting index 31*a* or 31*b* provided at one side of the glass platen 1 to the desired color change position of the original on the platen 1. While the first slider 12 is in scanning movement in the optical system moving scan mode, a reed switch 33 on the first slider 12 detects a magnet 32*a* or 32*b* attached to the index 31*a* or 31*b* to thereby detect the set position, whereupon the developing unit in use is switched to the other one.

The developing unit 6 containing the black developer, the toner of which is consumed in a large amount, can be replenished with the toner from a toner supply device 34 which is disposed in an upper side portion of the body of the copying machine A.

The copy paper to be used for the image transfer is fed from one of a first paper supply 35, second paper supply 36 and paper resupply portion 37 which are provided in the lower half of the body of the machine A or from a manual feed table 38 provided at a side portion of the body. The first and second supplies 35, 36 and the resupply portion 37 are respectively provided with pickup rollers 39, 40, 41 for sending out the paper and pairs of separating rollers 42, 43, 44 for separating one sheet from another. The sheet of paper thus separated off is then forwarded by a corresponding pair of feed rollers 45. The copy paper manually fed by the table 38 is directly forwarded by a pair of feed rollers 46.

The copy paper thus forwarded is registered at its leading end with the toner image formed on the drum 2 by a pair of register rollers 47 and fed to the transfer station.

After the image transfer, the copy paper is separated from the drum 2 by the separating charger 9 and then sent to a fixing unit 49 by a conveyor belt 48. The toner image transferred onto the paper is fixed thereto by the unit 49 and sent out. After the fixing treatment, the copy paper is sent into a discharge channel 52 or retransport channel 53 by a pair of transport rollers 50 according to the selected position of a switch member 51.

The copy paper, when led into the discharge channel 52, is discharged from the machine body by a pair of discharge rollers 54. When guided into the retransport channel 53, the paper is sent into the resupply portion 37 by pairs of transport rollers 55 face up with the image bearing surface facing upward or face down with the image bearing surface facing downward, for double copying. The paper sent in face up is fed again to the transfer station face down, so that copy images are formed on both paper surfaces (duplex copy). The copy paper sent in face down is fed again for transfer face up and therefore makes a composite copy.

Figure 3:
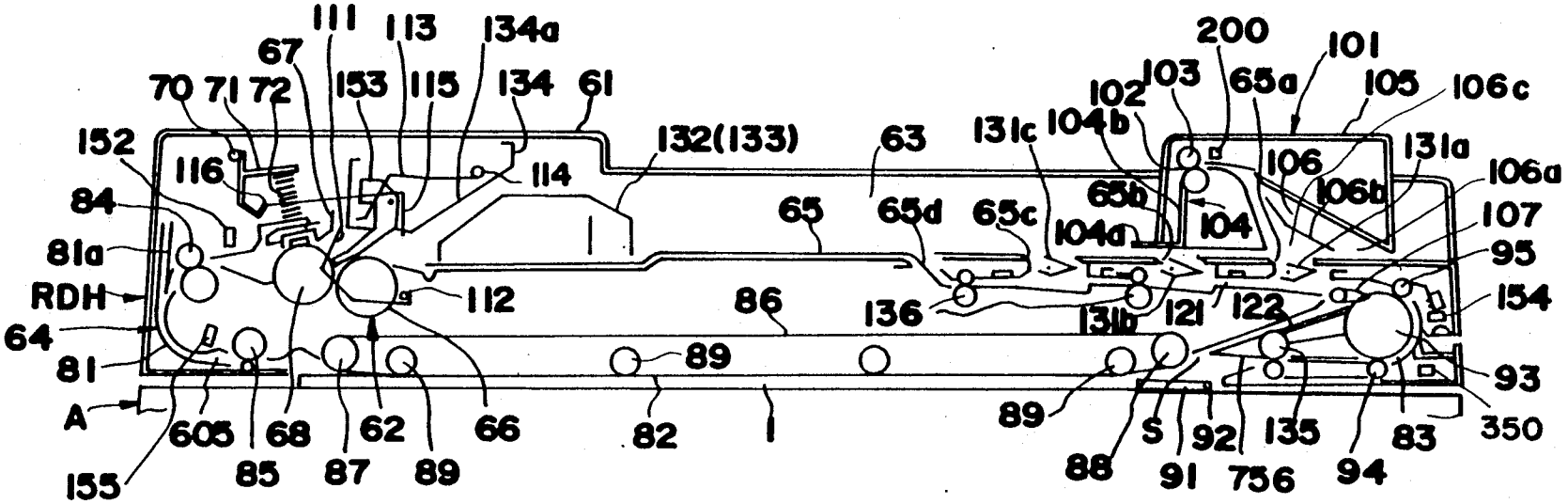
FIG. 3 is an enlarged sectional view of a recirculating document hander.

With reference to FIGS. 1 and 3, the recirculating document handler RDH has a case 61 of the cover type for covering the glass platen 1 at the top of the machine body. The case 61 is provided with an original containing portion 63 for accommodating as stacked up therein originals OD which are to be sent out by feed means 62 one by one, and a recirculating transport channel 64 for transporting therethrough the original OD sent out from the portion 63 onto the glass platen 1 and thereafter returning the original OD from the platen 1 to the containing portion therethrough.

The case 61 is removably connected by a hinge to the top side of body of the copying machine A and is openable about the hinge connection.

The containing portion 63 is in the form of a recess in the upper side of the case 61 as seen in FIGS. 1 to 3. As shown in FIG. 2, a predetermined number of originals OD can be placed as stacked up into the portion 63 by being guided by an upper guide 134 and opposed side guides 132, 133. The feed means 62 has a pickup roller 66 disposed at the forward end of the bottom plate 65 of the containing portion 63 and positioned on the lower side of the plate 65 with the top of the roller substantially flush with the plate, and a preseparating piece 67 disposed above and immediately ahead of the roller 66 with an original delivery clearance formed therebetween. Thus, some of the stacked originals OD are successively delivered by the pickup roller 66 from the lower position except for those in the upper position which are restrained in position by the preseparating piece 67 against delivery. This precludes many originals OD from being delivered from the containing portion 63 at a time, ensuring ease of subsequent separation.

The feed means 62 further has a feed roller 68 disposed immediately ahead of the pickup roller 66, and a separating pad 69 in pressing contact with the upper portion of the feed roller 68. A small number of originals OD preseparated off as above are brought by the pickup roller 66 to the position where the separating pad 69 is in contact with the feed roller 68. At this time, the pad 69 impedes the advance of the originals OD in the upper layer, permitting the feed roller 68 to forward the lowermost original only.

The preseparating piece 67 and the separating pad 69 are attached to a lever 71, which is biased downward about a pivot 70 under gravity. Since the lever 71 is also biased by a pressure spring 72, the pad 69 is held in pressing contact with the feed roller 68 with good stability. In this state, the preseparating piece 67 is positioned at a predetermined level immediately ahead of the pickup roller 66. The preseparating piece 67 may alternatively be secured to the machine body.

At one side of the preseparating piece 67 toward the roller 66, there is an original stopper 111 for temporarily retaining the stacked originals as set in position in register. The stopper 111 is pivotally movable about a rotary pin 112 selectively to an operative position or a nonoperative position as by an unillustrated solenoid. The stopper 111 is held in the nonoperative position during the feed of the original OD. Further disposed above the pickup roller 66 is an original holder 113 for exerting a pressure on the set originals to assist in the feeding operation. The holder 113 is supported by a pivot 114 and is pivotally movable as by an unillustrated solenoid selectively to an operative position or an nonoperative position. During the feed of the original OD, the holder 113 is in the operative position. Return original stoppers 115 are provided at a position upstream away from the point of application of the feeding action by the pickup roller 66 and the original holder 113 with respect to the feed direction.

Figure 4:
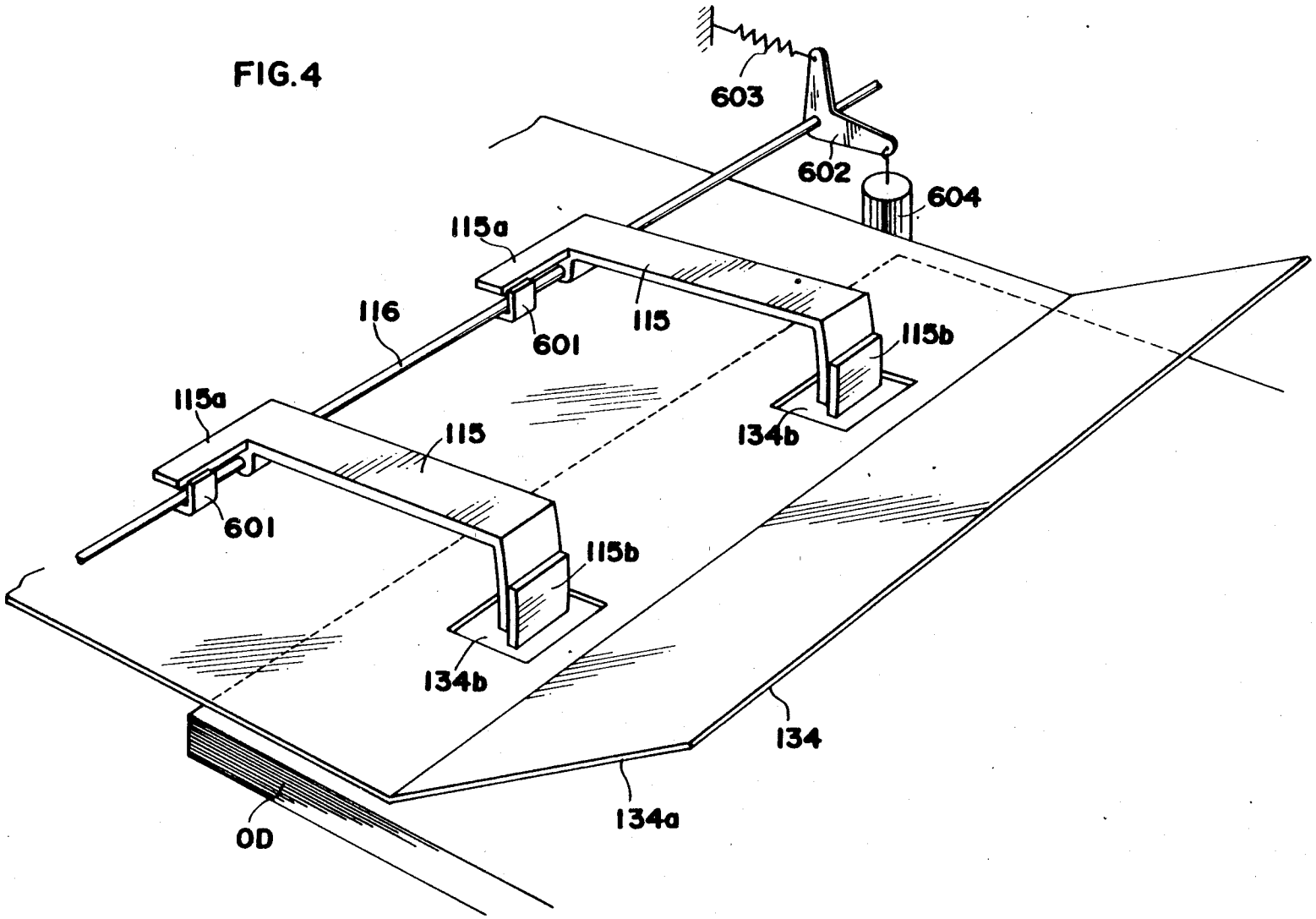
FIGS. 4 and 5 are perspective views showing return original stoppers in operation.
Figure 5:
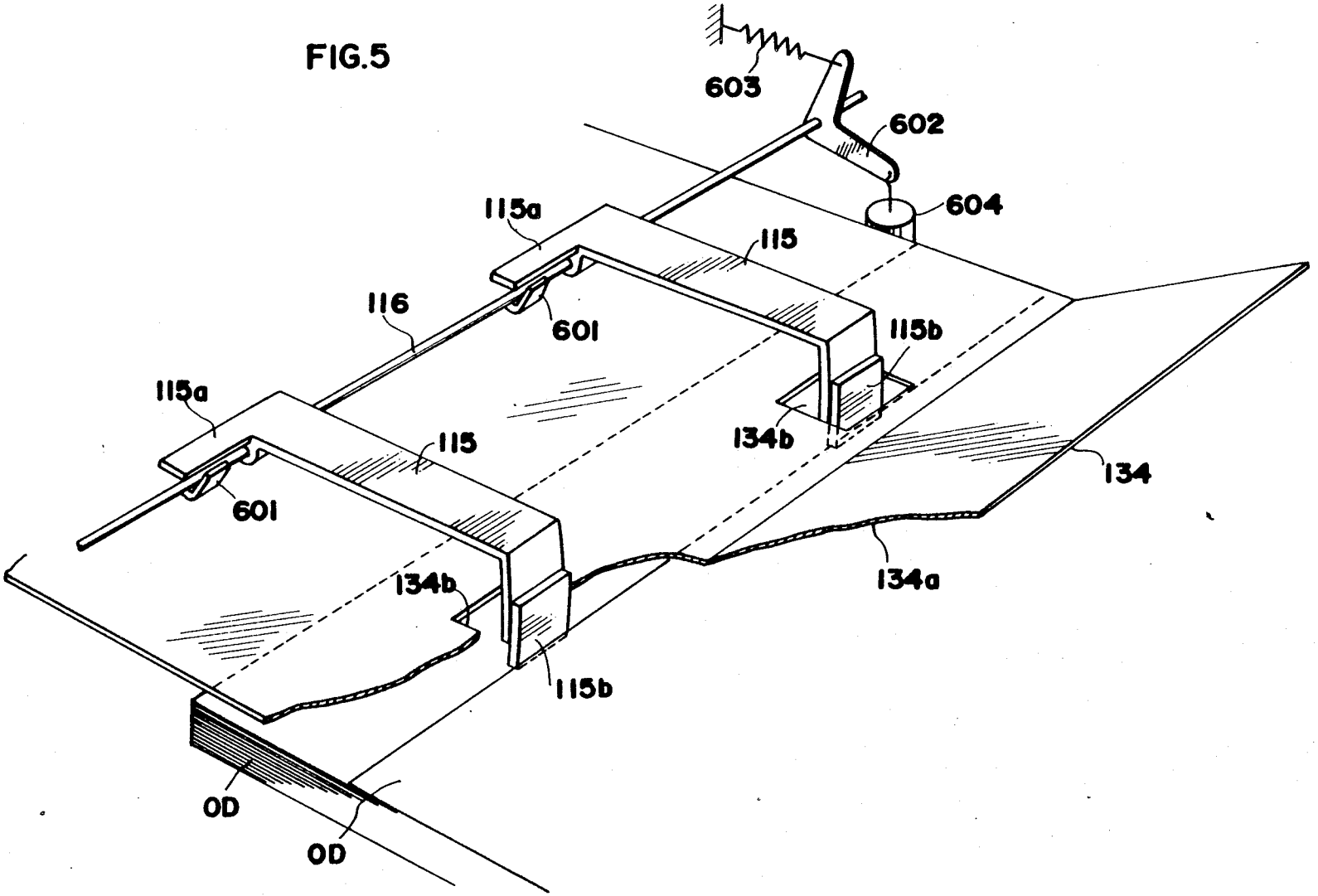

The return original stoppers 115, which are provided in a pair, are pivotally movable as supported by a pivot 116, and exert an action when projecting downward through windows 134*b* in the upper guide 134 as shown in FIG. 5 or are retracted upward to a non-operative position as seen in FIG. 4. The pivot 116 fixedly carries a stopper raising piece 601 opposed to a lateral driven piece 115*a* of each stopper 115. When moved counterclockwise in FIG. 4, the raising piece 601 pushes the opposed driven piece 115*a*, lifting the original stopper 115 to the nonoperative position as shown in this drawing, whereas when in the position of FIG. 5 as moved clockwise, the raising piece 601 is away from the opposed driven piece 115*a* without lifting the return original stopper 115. In the latter state, the return original stopper 115 is free to move on the pivot 116 and therefore moves down until it is received by and rests on the stack of set originals OD as shown in FIG. 5. Accordingly, even if the originals OD have undulations or a locally raised portion, the stoppers 115 will not be raised off the stack but bear thereon reliably. As a result, the returning original OD will not advance to a position under either of the stoppers 115 but is arrested by the stoppers on contact therewith. This obviates the likelihood of skewing.

Each return original stopper 115 has affixed to the front side of its forward end a rubber or like elastic pad 115*b* for ensuring effective contact of the return original OD with the stopper, preventing the return original OD from passing under the stopper more reliably.

The point of application of the pressure exerted by each stopper 115 on the originals OD set in position to offer resistance to transport is positioned upstream from the point of application of the transport force by the pickup roller 66 on the originals OD with respect to the feed direction, so that the resistance acts to retain upper originals OD which tend to be delivered by the transport force. Consequently, the resistance will act to stretch these originals OD but will not allow them to escape from the transport path or wrinkle them. Thus, the above arrangement eliminates the objectionable likelihood that the original OD to be fed will be wrinkled, cause a jam or develop trouble during transport.

Acting on the pivot 116 via a lever 602 are a spring 603 for holding the stoppers 115 in the nonoperative position, and a solenoid 604 for bringing the stoppers 115 to the operative position against the spring 603. The stoppers 115 are usually in the nonoperative position so as not to interfere with the originals OD to be set or replaced but are brought to the operative position every time one original is to be fed, to arrest the return original OD at an intermediate position on the set originals OD as shown in FIG. 5 and to thereby distinguish the set originals OD from the return original OD. This enables a simple sensor 153, which is kicked by the original OD, to detect the absence of each original OD easily and repeatedly when it has been completely fed.

With reference to FIGS. 1 and 2, the recirculating transport channel 64 comprises a feed bent channel portion 81 for guiding the original OD fed by the feed means 62 onto the glass platen 1 therethrough, a straight channel portion 82 formed along the upper surface of the platen 1, and a return bent channel portion 83 for returning the original OD on the platen 1 to the original containing portion 63 therethrough, these channel portions being continuous with one another. The feed bent channel portion 81 is provided at its starting end with a timing roller 84 rotatable at a slightly higher speed than the feed roller 68, and at its terminal end with a pair of pinch rollers 85. The timing roller 84 is held at rest for a predetermined period of time when the original OD is to be delivered thereto by the feed means 62. The timing roller 84 is driven after the leading end of the original OD has been brought into pressing contact with the nip of roller 84 and an idle roller opposed thereto to fit to the nip properly. This remedies the possible skew of the original OD. With the start of rotation, the timing roller 84 withdraws the original OD from the feed means 62 and forwards the original into the feed channel portion 81. At this time, the feed roller 68 is idly rotated by the advancing original through the action of a one-way clutch incorporated therein.

The speed of the pair of pinch rollers 85 is equal to or slightly lower than the speed of the timing roller. This precludes the variation in the speed of transport of the original OD that would occur upon the release of the original OD from the timing roller 84. Accordingly, even if the machine is in operation for copying in the original moving scan mode, variations in the transport speed exert no influence on the copy image. On the other hand, the transport channel portion has an escape portion 605 for accommodating a slack in the original OD due to the difference in speed between the rollers 84 and 85.

The straight channel portion 82 is provided by the glass platen 1 and a transport belt 86 in pressing contact with the upper surface of the platen. The belt 86 is reeved around a drive roller 87 driven by an unillustrated motor and a driven roller 88, disposed below the bottom plate 65 of the original containing portion 63 and held in pressing contact with the platen 1 by backup rollers 89. This enables the transport belt 86 to accept on the platen 1 the original OD transported through the bent channel portion 81 and between the pinch rollers 85 and to deliver the accepted original OD into the return bent channel portion 83.

Like the relation of the pinch rollers 85 to the timing roller 84, the transport belt 86 is driven at the same speed as or a slightly lower speed than the pinch rollers 85 disposed upstream from the belt 86 with respect to the transport direction. Consequently, the original OD is transported on the platen 1 by the belt 86 at a constant speed. This is especially advantageous to the copying operation in the original moving scan mode.

An original scale 91 is provided under the driven roller 88. The scale 91 is supported at its rear end by a pivot 92 on the body of the copying machine A. The front end face of the original scale 91 is brought to a usual position lower than the glass platen 1 or to a stopper position higher than the platen 1 under the control of drive means such as an unillustrated solenoid. When brought to the usual position, the scale 91 guides the original OD delivered from the glass platen upward into the return bent channel portion 83. When the scale 91 is in the stopper position, the original OD forwarded on the glass platen toward the bent channel portion 83 is arrested at its leading end by the front end face of the scale and is held in a predetermined printing position on the glass platen 1.

The original OD needs to be thus held in position in the optical system moving scan mode but need not be so positioned in the original moving scan mode.

The return bent channel portion 83 is provided at an intermediate part thereof with a transport roller 93 having a large diameter, and driven rollers 94, 95 in pressing contact with the lower and upper portions, respectively, of the peripheral surface of the transport roller 93, whereby the original OD delivered from the platen 1 into the bent channel portion 83 is transported while being bent along the peripheral surface of the roller 93 and returned to the original containing portion 63.

At the rear end portion of the containing portion 63, a rear end guide unit 101 is disposed for guiding the rear end of the original OD to be accommodated and forwarding the original OD into contact with the original stoppers 115. The guide unit 101 is movable forward and rearward inside the containing portion 63 according to the size of originals. The guide unit 101 has in the upper portion of its front wall a discharge opening 102 provided with a pair of discharge rollers 103. A discharge sensor 200 for detecting discharge of the original by the pair of discharge rollers 103 is disposed upstream from these rollers 103 with respect to the direction of discharge. The guide unit 101 further has an L-shaped guide wall 104 under the discharge opening 102. The guide unit 101 receives with its guide wall 104 the rear end of the original OD discharged from the opening 102 and moves from the receiving position toward the feed means 62 to bring the original OD into contact with the original stopper 111 and thereby place the original OD in position. The guide wall 104 has a lower end piece **104*a* for receiving the rear end of the original OD from below. This eliminates the likelihood that the original OD will enter a clearance between the guide wall 104 and the bottom plate 65 of the containing portion 63 when the original OD is pushed forward by the guide wall 104**.

The L-shaped guide wall 104 of the guide unit 101 has an upright portion **104*b* which is rough-surfaced by sandblasting or formed with surface irregularities and is thereby given a high coefficient of friction. This obviates the tendency of the rear end of the return original OD being pushed forward by the guide wall 104 to slidingly escape upward along the upright guide wall portion 104*b* owing to the friction between the original OD and the bottom plate 65, and thus permitting the original OD to be pushed into contact with the stopper 111** reliably so as to be positioned in place.

The guide unit 101 has inside a cover 105 of synthetic resin an original discharge channel 106 defined by a rear wall of the cover 105 and the guide wall 104 and having at its lower end an original inlet **106*a* in the form of a large opening. The discharge channel 106 is tapered toward the discharge opening 102 and guides the original OD received from the inlet 106*a* toward the pair of discharge rollers 103, which in turn delivers the original from the discharge opening 102. The onehalf portion of the discharge channel 106 toward the inlet 106*a* is provided with a partition 106*b* dividing the channel in two to prevent the received original OD from becoming unstable owing to the excessively large channel space. The original outlets 65*a* to 65*d* to be described below and formed at different positions for different sizes of originals OD are also made to accommodate by the partition 106*b*** to slight differences between original sizes that would otherwise cause trouble.

The bottom plate 65 of the containing portion 63 is formed with above-mentioned original outlets **65*a* to 65*d*. An auxiliary transport channel 121 communicating with these outlets in common extends along the bottom plate 65 thereunder. Further provided is a return transport channel 122 for turning the original OD upside down upon delivery from the bent channel portion 83 and reversely transporting the original to the straight channel portion 82**.

The auxiliary transport channel 121 or the return transport channel 122 is selected by a switch member 107.

The guide unit 101 is moved stably by being guided by the inner surface of the containing portion 63. It is automatically movable to an original discharge position according to the size of copy paper selected by drive means shown in FIG. 6. After all the originals have been returned, the guide unit 101 is temporarily advanced to a predetermined pushing-out position for the subsequent original feeding operation. Further when the original feeding operation has been completed, the guide unit 101 is returned to the most retracted position, i.e., to the home position shown in FIGS. 2 and 3 so as not to become an obstacle to the setting or replacement of originals OD.

Figure 15:
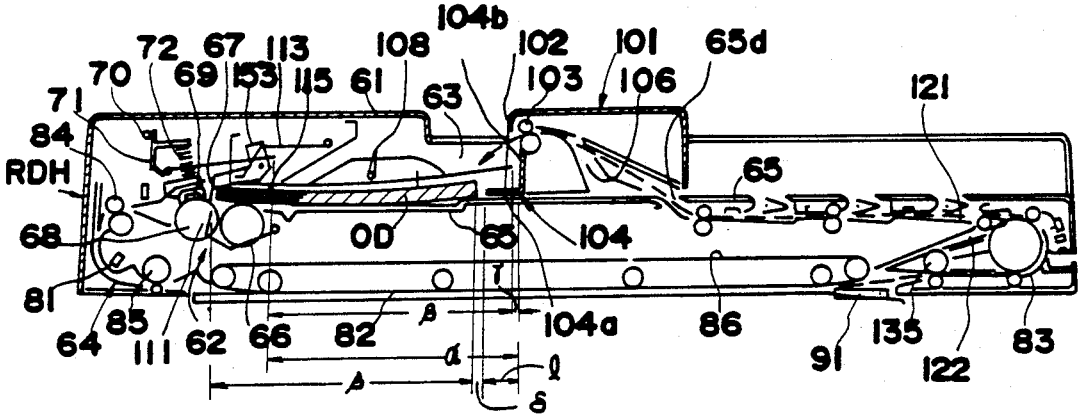

With reference to FIG. 15, the original discharge position is such that the distance $\alpha$ of the upright portion 104*b* of the L-shaped guide wall 104 from the return original stoppers 115 with which the return original OD is brought into contact by the guide unit 101 is the detected original size $\beta$ plus an allowance $\gamma$. The discharge position is thus determined so that the return original OD delivered into contact with the return original stoppers 115 will smoothly settle in the space between the stoppers and the guide wall upright portion 104*b*. The lower end piece 104*a* for receiving the rear end of the return original OD has a length l which is greater than the allowance $\gamma$ and is thereby adapted to receive the rear end reliably. Further the guide unit 101 is so positioned that the forward end of the lower end piece 104*a* is at an allowance distance $\delta$ from the rear ends or the originals OD previously set in position by the original stopper 111.

Figure 17:
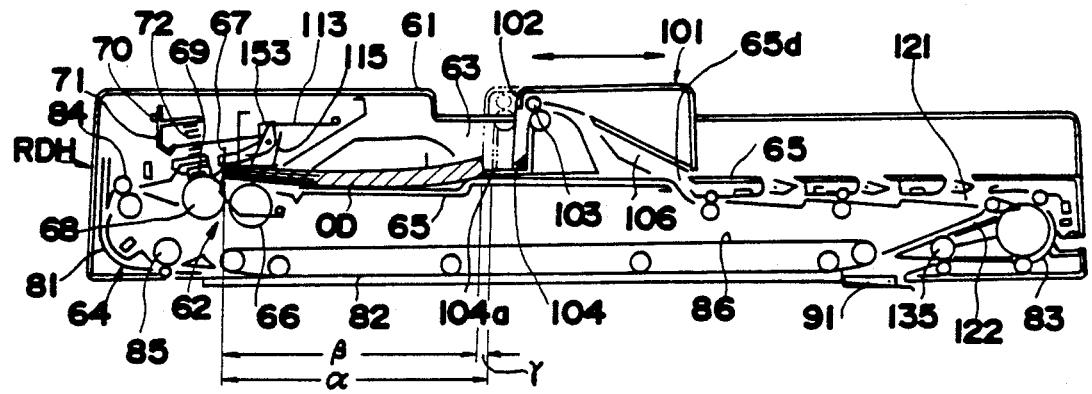

The guide unit 101 is advanced to the original pushing-out position indicated in phantom line in FIG. 17 to thereby push the return originals OD into contact with the stopper 111 and set them in position again. In this position, the upright portion 104*b* of the L-shaped guide wall 104 is at the distance $\alpha$ from the stopper 111 to provide an allowance $\gamma$ for the original size $\beta$. This obviates the likelihood that the return original OD will be pushed forward against the stopper 111 to excess and become thereby damaged.

At different positions corresponding to different sizes of originals, the guide unit 101 has its original inlet 106*a* or 106*c* opposed to one of the original outlets 65*a* to 65*d* formed in the bottom plate 65 of the containing portion 63. When the inlet 106*a* or 106*c* is opposed to one of the outlets 65*a* to 65*d*, the position of the guide unit 101 is further adjustable in accordance with the size of original within a range in which the opposed relation can be maintained therebetween. This accommodates the guide unit 101 to the difference between the A series and the B series of JIS standards, other sizes in millimeters or inches or the difference in the orientation of originals, i.e., lengthwise or widthwise feed.

TABLE A shows the combinations of the inlets 106*a* and 106*c* and the outlets 65*a* to 65*d* for different sizes of originals.

With reference to TABLE A, the outlets 1 to 4 correspond to the outlets 65*d* to 65*a*, respectively, and INLET, LEFT refers to the inlet 106*a*, and INLET, RIGHT to the inlet 106*c*. Further T represents transport of an original with the long side thereof across the transport direction, while Y means transport of an original with the short side thereof across the transport direction.

Figure 53:
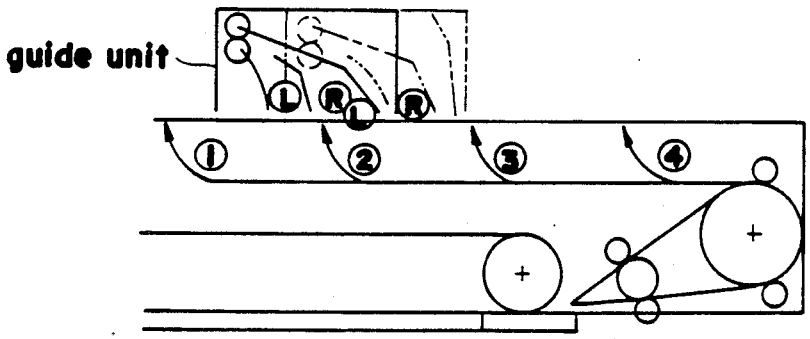
FIG. 53 is a diagram showing the relationship in position between original inlets of the rear end guide unit and original outlets for sending out originals into the inlet.

For example, when an original of the size B5T is to be transported, the inlet 106*c* of the guide unit 101 is opposed to the outlet 2 as shown in FIG. 53. Further when the transport of the original B5T is to be followed by the transport of an original A4T, the guide unit 101 is moved to the broken-line position of FIG. 53 to oppose the inlet 106*a* of the unit 101 to the outlet 2. Thus, the provision of two inlets in addition to four outlets makes the document handler of the invention accommodate to great differences and small differences between original sizes.

The outlets 65*a*, 65*b*, 65*c* are provided with original guide plates 131*a*, 131*b*, 131*c*, respectively, which serve also as closures. The guide plate of the outlet opposed to the inlet 106*a* is opened for the communication of the inlet with the auxiliary transport channel 121. Accordingly, upon the original OD sent out from the bent channel portion 83 into the auxiliary transport channel 121 reaching one of the outlets 65*a* to 65*c* opposed to the inlet 106*a*, the corresponding one of the guide plates 131*a* to 131*c* guides the original upward into the original discharge channel 106. When the inlet 106*a* is opposed to the outlet 65*d*, the original guide plates 131*a* to 131*c* are in their raised position, with the result that the original OD sent into the auxiliary transport channel 121 directly reaches the outlet 65*d* and is led into the discharge channel 106.

A mechanism will be described for opening and closing the original guide plates 131*a* to 131*c* at the outlets 65*a* to 65*c* for the different positions of the guide unit 101.

Figure 6:
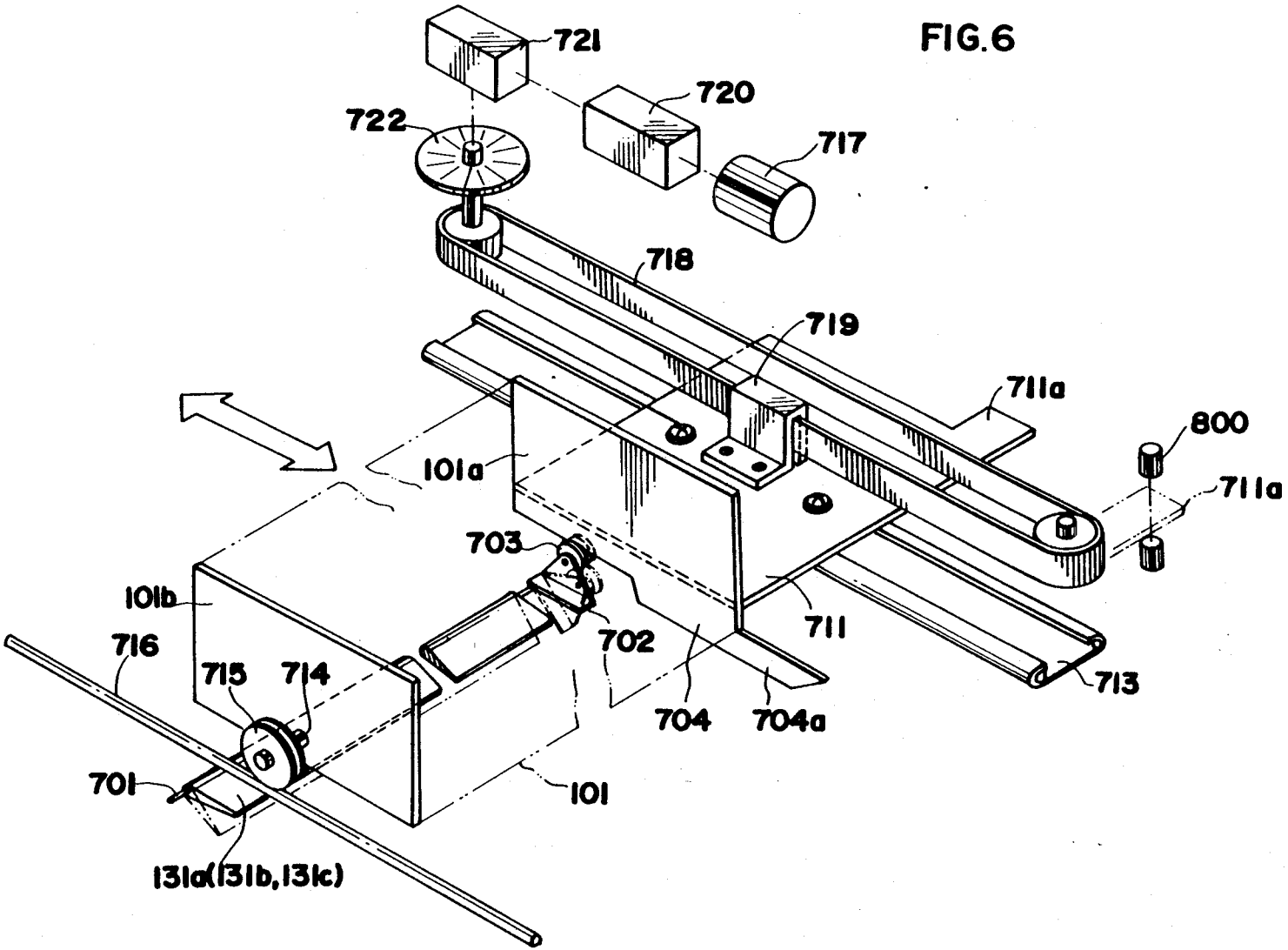
FIG. 6 is a perspective view showing a structure for associating a rear end guide unit with an original guide plate.

With reference to FIG. 6, the guide plates 131*a* to 131*c* are supported on respective pivots 710 each fixedly carrying a frame 702. A driven roller 703 is mounted on the frame. The inner side wall 101*a* of the guide unit 101 is formed at its lower edge with a cam 704 positionably as opposed to the driven rollers 703. When the guide unit 101 is brought to one of the different positions, the driven roller 703 for the corresponding one of the guide plates 131*a* to 131*c* is depressed by a downward projecting edge 704*a* of the cam 704, whereby the guide plate concerned is opened.

As shown in FIG. 6, the inner side wall 101*a* of the guide unit 101 has fixed thereto a connecting plate 711 extending through a slit 712 (FIG. 2) in the case 61 and movably supported on an arcurate rail 713 inside the case, whereby the inner side of the unit 101 is guided. A roller 715 on a shaft 714 projecting from the outer side wall 101*b* of the guide unit 101 assists in the movement of the unit. The roller 715 is supported on a rail 716 inside the case 61 to reduce the resistance to the movement and serves to avoid staining that would result if the roller 715 is in contact with the bottom plate of the case 61.

The connecting plate 711 is attached by a connector 719 to a timing belt 718 coupled to a drive motor 717. The timing belt 718, when driven by the motor 717, moves the guide unit 101. The timing belt 718 is coupled to the motor 717 via speed change means 720 and slipping means 721. A pulse disc 722 for detecting the position of the guide unit 101 is disposed downstream from the slipping means 721. Through the arrangement described and including the speed change means 720 and the slipping means 721, the rotation of the motor 717 is transmitted to the timing belt 718. As already stated, it is likely that a book or like article will be placed on the original containing portion 63 since the document handler RDH is handled like a document cover, and if the guide unit 101 is then driven, the article will exert a load thereon. Furthermore, the guide unit 101, projecting greatly beyond the top side of the handler RDH, is likely to be subjected to a load during operation by the operator. In such an event, the slipping means 721 produces slippage under the load, rendering the drive mechanism or the guide unit 101 free of damage.

The pulse disk 722 represents the actual movement of the guide unit 101 since it is located downstream from the slipping means 721, detecting occurrence of slippage and the amount of slippage from the difference between the actual amount and the amount of rotation of the motor 717. For example, if the number of pulses counted actually by the disk 722 in a predetermined period of time is less than the number of pulses to be counted during the same period while the drive motor 717 is in normal rotation, the reduction in the number of pulses indicates a corresponding amount of slippage. Accordingly, it is possible to give a warning by use of a buzzer 350 (shown in FIG. 3) and stop the motor based on the result of detection. Furthermore, the amount of slippage detected makes it possible to recognize the current position of the guide unit 101 and properly position the unit 101 after the remedy of the slippage. With the present embodiment, however, the guide unit 101 is returned to the home position once in such an event. The return to the home position is detected by a sensor 800 which detects a projection 711*a* of the connecting plate 711.

Referring to FIG. 3 again, the switch member 107 is shifted to an upper position when the back side of the original is to be copied in a duplex original mode. The original OD sent out from the bent channel portion 83 is then guided by the member 107 into the return transport channel 122. At this time, the transport belt 86 is reversely driven to guide the inverted original OD from the channel 122 to the specified position on the platen 1 again.

One of the guides 132, 133 provided at opposite sides of the front end of the containing portion 63, i.e., the guide 133, is movable to press the set originals OD against the other guide 132 which is fixed (see FIG. 2). The widthwise size of the originals is detected from the pressing position of the guide 133. The original receiving space defined by the guides 132, 133 has an increased width toward the guide unit 101 so that originals can be received with ease.

As seen in FIG. 3, the upper guide 134 at the forward-end upper portion of the case 61 has a slanting guide face 134*a* for restricting and guiding the leading end of stack of originals OD to be inserted into the containing portion 63 so that the leading end of proper bulkiness will be positioned on the pickup roller 66.

A transport roller 135 is provided at an intermediate portion of the return transport channel 122. A suitable number of transport rollers 136 are also disposed at intermediate portions of the auxiliary transport channel 121.

Figure 7:
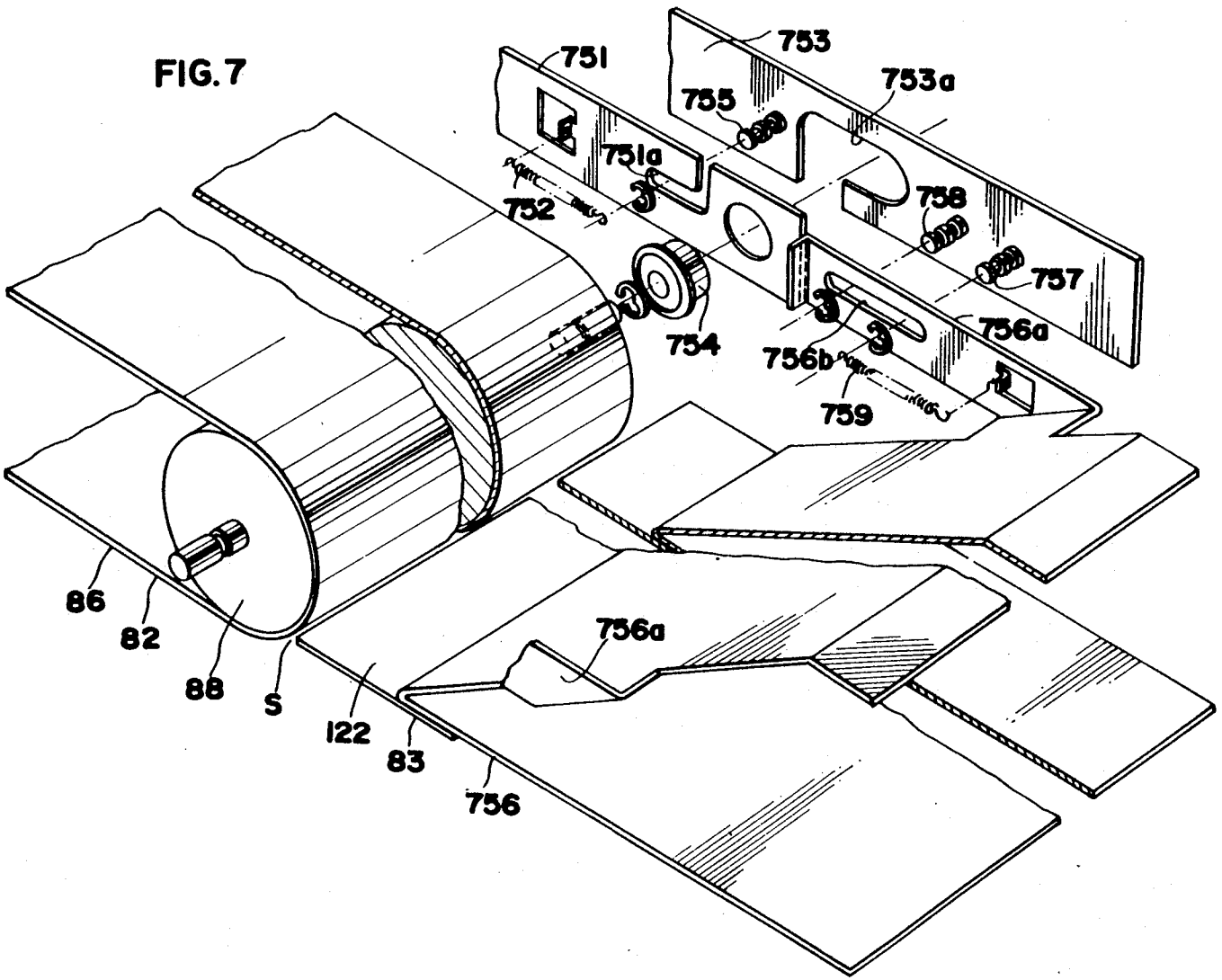
FIG. 7 is a perspective view showing a structure for associating a transport belt and a transport guide subsequent thereto.

The driven roller 88 provided with the transport belt 86 therearound has its shaft supported by a slide plate 751 movably supported by a frame 753 inside the case 61 as shown in FIG. 7 and holds the belt 86 tensioned by being biased by a spring 752. The slide plate 751 has a bearing 754 fitted therein and guidable by an L-shaped guide aperture 753*a* formed in the frame 753. The slide plate 751 itself has an L-shaped guide aperture 751*a* and is slidable by being guided by a pin 755 on the frame engaged in the aperture 751*a*. On the other hand, a V-shaped guide plate 756 provided at the junction of the return transport channel 122 and the straight channel portion 82 is made movable forward and rearward with pins 757, 758 on the frame 753 fitted in a slot 756*b* in a connecting piece 756*a* formed at each side of the guide plate 756. The connecting piece 756*a* is made movable with the slide plate 751 in contact therewith by being biased by a spring 759 acting between the piece 756*a* and the pin 757. Accordingly, even if the end position of the transport belt 86 is altered by the movement of the driven roller 88, the guide plate 756 follows this movement to hold a constant distance S between the belt 86 and the plate 756. This permits the original OD to advance from the straight channel portion 82 into the bent channel portion 83 or from the return transport channel 122 into the straight channel portion 82 smoothly at all times, precluding a paper jam or preventing the original OD from advancing improperly.

With reference to FIG. 1, the body of the copying machine A has a paper discharge opening 140 provided with a finisher 141. The finisher 141 has a discharge passage 143 for delivering the copy discharged from the opening 140 to a paper tray 142, and a stacking transport passage 145 branching from an intermediate portion of the discharge passage 143 and extending to a stacking portion 144. By shifting a switch member 139, the copy discharged into the passage 143 is guided to the paper tray 142 or the stacking portion 144 selectively.

Figure 8:
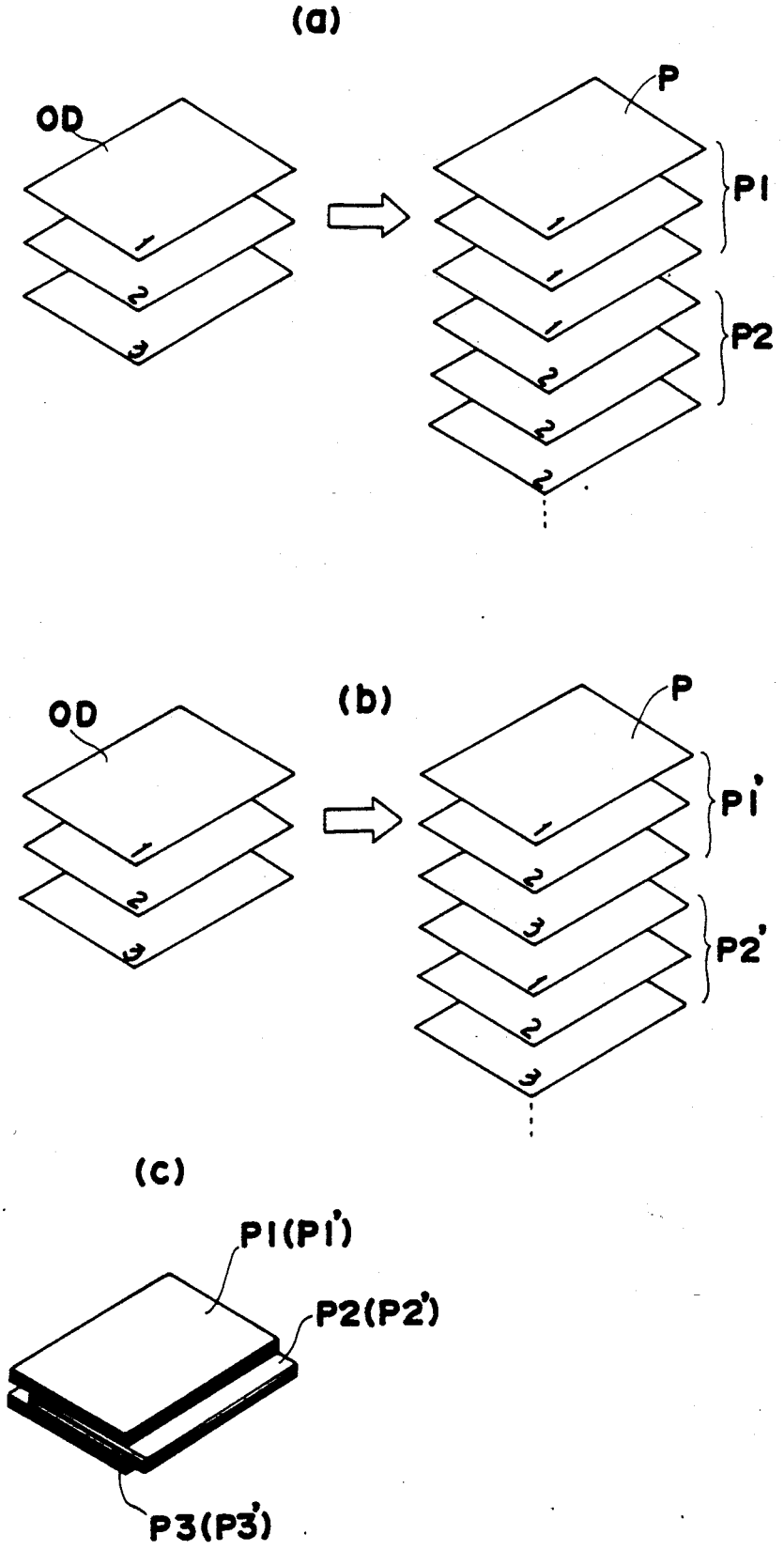
FIG. 8 is a perspective view showing examples of assorted copy groups.

The paper tray 142 receives copies delivered thereto one after another to stack them up thereon. In the case where the same original OD is copied continually repeatedly, the resulting copies P stacked up are in the form of copy groups P1, P2, . . . as seen in FIG. 8 (a). In the case where a multiplicity of originals are continually copied one by one, the resulting copies P are stacked up as sorted out in copy groups P1′, P2′, . . . each having pages in order as seen in FIG. 8 (*b*).

When the paper tray 142 is laterally shifted when receiving the copy groups P1, P2, . . . or P1′, P2′, . . . , the copy groups P1 (P1′), P2 (P2′), P3(P3′), . . . can be placed thereon as displaced from one another as shown in FIG. 8 (*c*) to ensure facilitated sorting.

Figure 9:
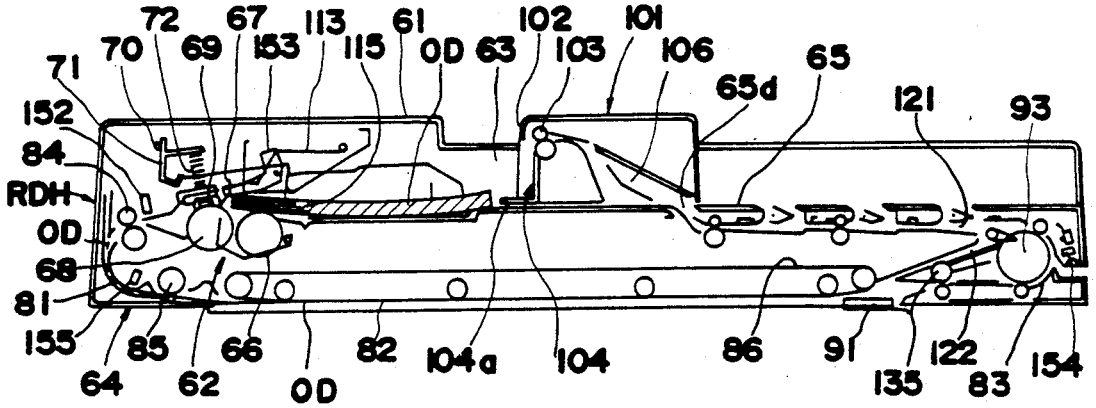
FIGS. 9 to 11 are sectional views showing how originals are handled by a two-in-one operation of the handler.

Originals can be handled by the document handler RDH in the so-called two-in-one mode wherein two originals fed in succession are copied at the same time as arranged side by side. For this purpose, the bent channel portion 81 is provided, downstream from and immediately adjacent to the timing roller 84, with a branch channel 81*a* branching from the channel portion 81 toward the upstream direction with respect to the original feed direction. The original OD sent out from the containing portion 63 first is temporarily halted at such a position that the rear end of the original is located between the branching point of the branch channel 81*a* and the pair of pinch rollers 85, and the pinch rollers 85 and the belt 86 are thereafter reversely driven to reversely transport the preceding original OD utilizing the branch channel 81*a* so that the rear end thereof is positioned away from the pair of pinch rollers 85 by a distance equal to or smaller than the distance between the timing roller 84 as indicated in a broken line in FIG. 9.

Figure 10:
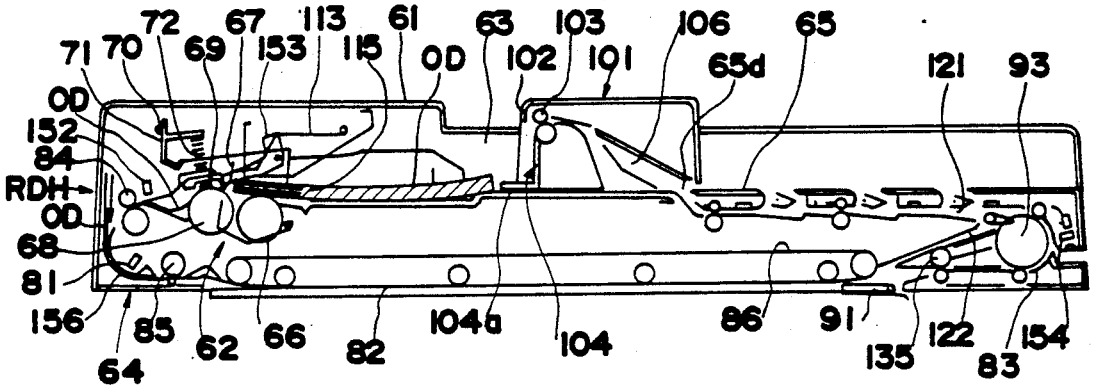

Subsequently, the next original OD is transported to the timing roller 84 as seen in FIG. 10.

Figure 11:
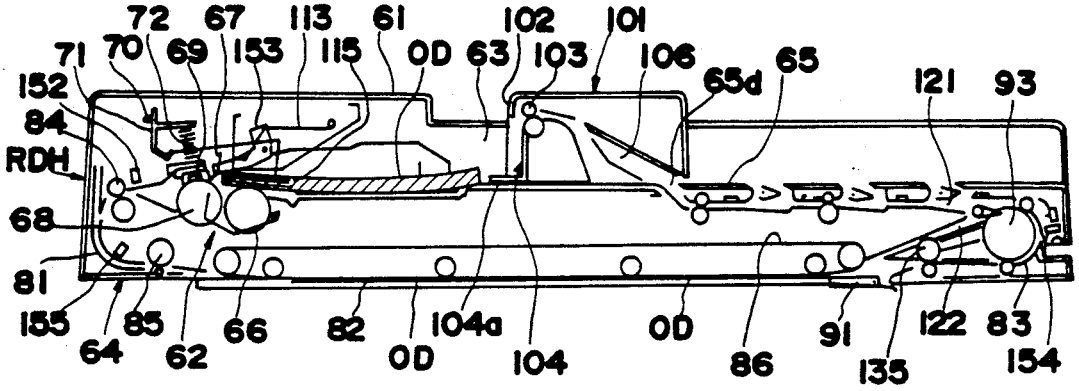

The two originals OD are thereafter transported onto the glass platen 1 at the same time and positioned in place for an exposure, with the preceding original OD in contact with the original scale 91 as seen in FIG. 11.

The spacing between the two originals OD to be fed onto the platen 1 is adjustable according to the amount of reverse transport of the preceding original OD. No space may be left between the two originals as the case may be. Even when there is a small space therebetween, the space can be eliminated by transporting the following original into contact with the preceding original OD.

The two originals OD copied are returned to the containing portion 63 as is the case with a single original. However, if they are returned as they are, the leading end of the following original OD to be discharged is likely to kick the rear end of the original OD discharged previously, and will not be accommodated in the portion 63 properly or will be placed under the preceding original to result in an error in the order of accommodation. Accordingly, the speed of transport by the discharge rollers 103 is made higher than that of the transport roller 93, etc. upstream from and adjacent to the rollers 103 so that the preceding original OD when nipped between the discharge rollers 103, can be discharged at a higher speed than the following original OD until the following original is nipped between the discharge rollers 103. Consequently, the above-mentioned problem is avoidable since the preceding original OD is discharged as spaced apart from the next original by a large distance.

The stacking portion 144 accepts copies discharged one after another and stacks them up. The copies are stacked up as grouped or sorted as stated above according to the copy mode concerned. As seen in FIG. 1, the stacking portion 144 is provided with a stamper 146 or stapler 147.

The stamper 146 or stapler 147 is selectively operated when a group or set of copies have been stacked to produce a predetermined impression thereon or bind the copies together. Every time the stamping or binding has been completed, the stacking portion 144 releases the copies and discharges them from an outlet 148.

The recirculating document handler RDH is used in the following manner.

First, it is desired to move the guide unit 101 and the movable guide 133 of the original containing portion 63 to the position of a maximum size and then place a specified number of originals into the containing portion 63 as stacked up, so that the originals OD can be placed in without being interfered with by the guide unit 101 or the movable guide 133. However, if the rearmost position of the guide unit 101 is made its home position, the unit need not be moved by hand.

Figure 12:
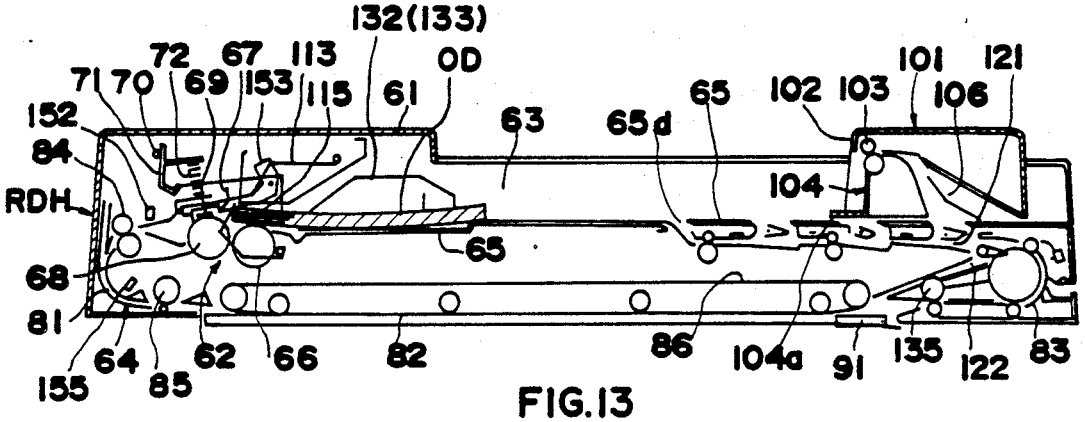
FIGS. 12 to 22 are sectional views for illustrating the operation of the handler in original scan modes.

To place the originals OD into the portion 63, the forward end of the group of originals OD held by hand at its rear end is forwardly inserted into the space under the upper guide 134 into contact with the original stopper 111 (FIG. 12). In this way, the group of originals OD can be placed approximately in the specified feed position by the stopper 111. If the pickup roller 66 is in a free state at this time, the originals OD can be inserted as above smoothly. When the print switch is depressed in this state, the pickup roller 66 and the feed roller 68 are driven, whereby one of the stacked originals OD is sent out from the lowermost position. When the sent-out original OD reaches the timing roller 84, this roller has not been driven, so that the original fed thereto has its leading end properly fitted to the nip of the timing roller 84 and is thereby prevented from skewing. Subsequently, the timing roller 84 is initiated into rotation, transporting the original OD into the bent channel portion 81. Immediately adjacent to and upstream from the timing roller 84 at the channel portion 81, a sensor 152 is provided for determining when to drive the timing roller, etc.

The size of the original OD transverse to the feed direction is detected from the position of the movable guide 133. The size of the original along the feed direction is detected by a sensor 155 disposed at an intermediate portion of the bent channel portion 81. The sensor 155 detects the latter size by measuring the period of time from the detection of leading end of the original until the detection of rear end thereof. The transverse size, which is limited, can alternatively be detected according to whether the original OD is detected by a sensor disposed at a suitable position along the width of the feed path.

The overall size of the original OD is detected from these two items of detected data to automatically select the corresponding size of copy paper.

Figure 13:
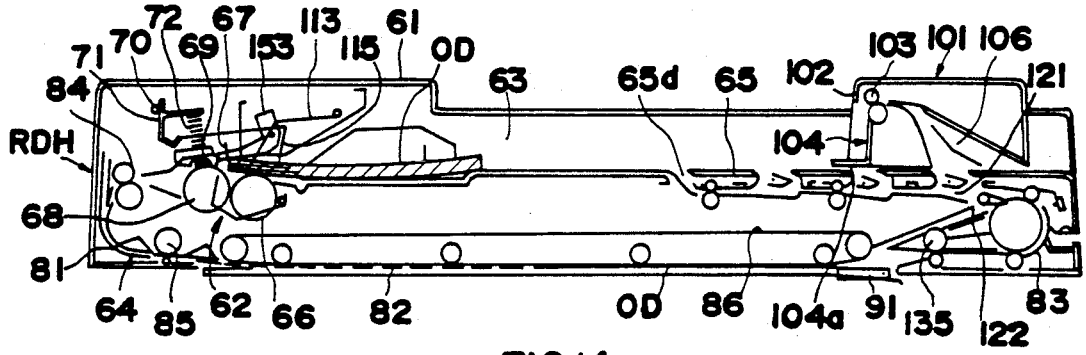

The original OD transported through the bent channel portion 81 is sent into the straight channel portion 82 on the glass platen 1 by the pair of pinch rollers 85 and the transport belt 86 which are driven at the same time, for further transport along the channel portion 82 (FIG. 13). When the copying machine A is in the optical system moving scan mode, the original stopper (scale) 91 is in its raised position. The original OD transported forward comes into contact with the stopper 91, whereby the original OD is halted at the specified printing position on the glass platen 1. The original OD, if skewing, is properly positioned by the leading end thereof coming into proper fitting contact with the stopper 91.

Figure 14:
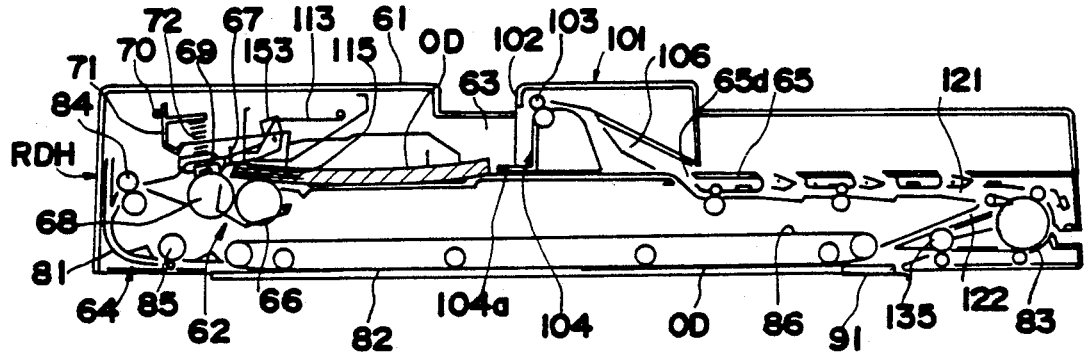

Alternatively the guide unit 101 may be advanced to the position of FIG. 14 corresponding to the feed direction size of the original OD detected by the sensor 155. Upon the original OD coming into proper fitting contact with the stopper 91, the transport belt 86 is brought out of operation, and in this state, an exposure is made in the optical system moving scan mode for printing. Before or after the completion of printing, the stopper 91 is lowered. Further, on completion of printing, the transport belt 86 is driven again and the return bent channel portion 83 is allowed to function. At the same time, the pair of discharge rollers 103 on the guide unit 101 is also driven.

After printing, the original OD on the glass platen 1 is transported by the driven belt 86 through the bent channel portion 83, auxiliary transport channel 121, original outlet **65*d*, original inlet 106*a* and original discharge channel 106 to the pair of discharge rollers 103 in the illustrated case. These rollers 103 deliver the original from the discharge opening 102 to the containing portion 63 (FIG. 15). Since the discharge rollers 103** comprise portions arranged at different levels, the original OD to be discharged is caused to form a longitudinal wave along the transport direction and thereby made to advance straight effectively.

During this transportation phase an auxiliary transport wheel 108 will be in rotation which has urethane or like elastic transport blades **108*a* and is disposed in the containing portion 63 upstream from the feed means 62 to exert an elastic forwarding action on the return original OD to be accommodated first in the containing portion 63. As a result, the original can be delivered to the specified position in contact with the return original stoppers 115** more reliably.

A suitable period of time before the completion of copying of the original OD on the glass platen 1 or after the completion of copying, the feed means 62 operates again to send out the lowermost original OD from the containing portion 63. The original OD is then fed for printing and thereafter returned to the containing portion 63 in the same manner as the preceding original.

Figure 16:
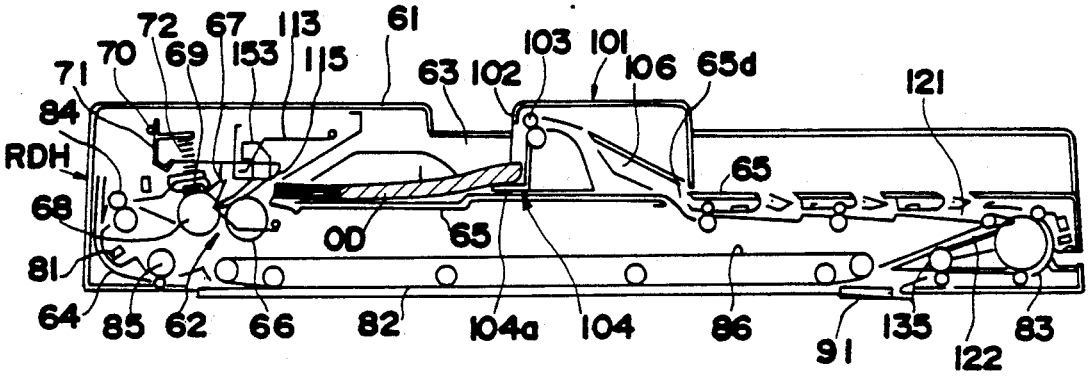

When the last of the stacked original OD has been sent out the absence sensor 153 detects this by falling (FIG. 16).

When the last copied original OD has been discharged into the containing portion 63, the handler is in the state shown in FIG. 16.

Figure 23:
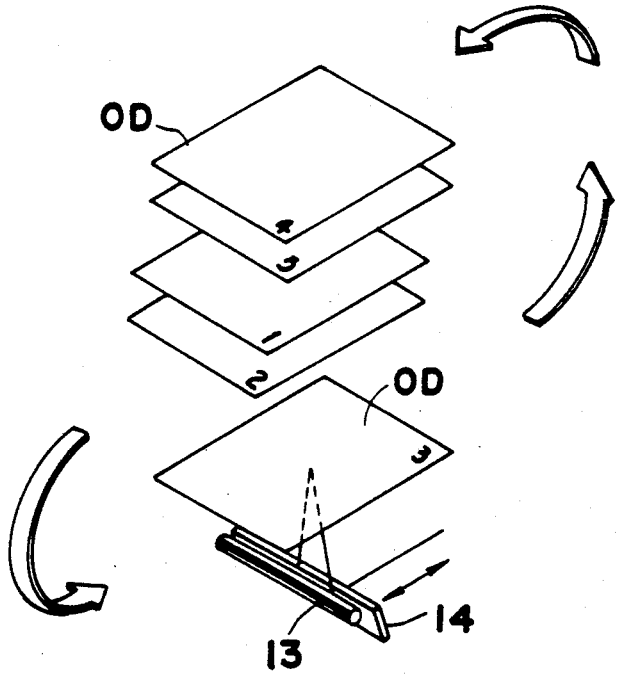
FIGS. 23 and 24 are perspective views showing the movement of originals in an optical system moving scan mode, and the resulting copies as obtained in a grouping mode.
Figure 24:
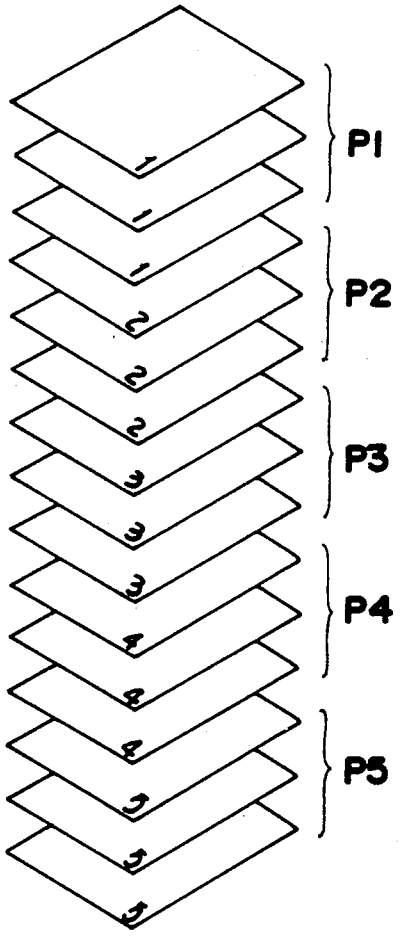

FIG. 23 shows the movement of the originals OD in the above operation. Each original OD is scanned a plurality of times, whereby groups of copies P1 to P5 are obtained as shown in FIG. 24.

In the sorting mode, each returned original OD is repeatedly fed and copied until a predetermined number of copies are obtained as seen in FIG. 16. Before the originals are thus fed again, the guide unit 101 is advanced a specified distance from the position of FIG. 16 to the original pushing-out position. Consequently, the return originals OD are brought to the feeding position into contact with the original stopper 111 and set in place by being pushed at its rear end by the L-shaped guide wall 104.

Next, the guide unit 101 is slightly retracted as shown in FIG. 17 and waits at the original discharge position where the rear end of the return original OD is to be received. At the same time, the original stopper 111 is lowered to the nonoperative position, and the original holder 113 is lowered to its operative position. However, the holder 113 is preferably lowered by the time the guide unit 101 is retracted from the pushing-out position to the discharge position since if the originals OD have already been held between the pickup roller 66 and the holder 113 at that time, lower originals OD or the whole originals can be prevented from being retracted by the movement of the guide wall 104 supporting the rear ends of the originals OD when the guide unit 101 is retracted.

The reset originals are then fed again. When the predetermined number of copies have been made, the guide unit 101 is returned to the most retracted position, i.e., the home position of FIG. 22 so that the originals OD can be removed or changed conveniently.

Next, the operation of the handler in the original moving scan mode will be described. In this mode as in the optical system moving scan mode, originals OD are set in place and made ready for feeding as shown in FIGS. 12 to 14 for the detection of size of the originals OD and the movement of the guide unit 101 to the corresponding position to the size. However, the original scale 91 remains lowered, and the original OD is not positioned in place on the glass platen 1.

After the size detection, the lowermost original OD is discharged into the containing portion 63 as seen in FIG. 15, and the remaining originals OD set in the portion 63 are thereafter all fed in succession and discharged into the containing portion 63 as shown in FIG. 16. The number of set originals OD is counted by this procedure since copy paper is fed before the feed of the original OD for high-speed production of many copies. In the case where copy paper is fed first and if the number of set originals OD is then not known, the last original can not be identified, so that when the last original has been copied, the preceding copy paper sheet will be discharged uselessly without bearing any copy image. The waste of copy paper can be avoided by detecting the number of originals.

Figure 18:
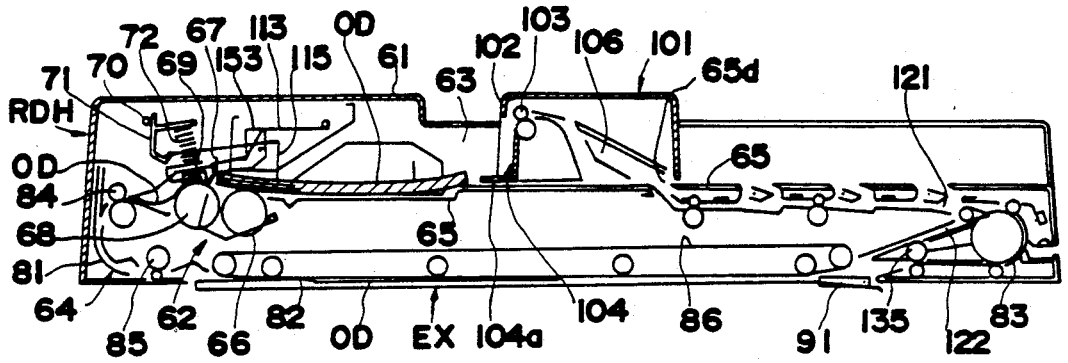
Figure 19:
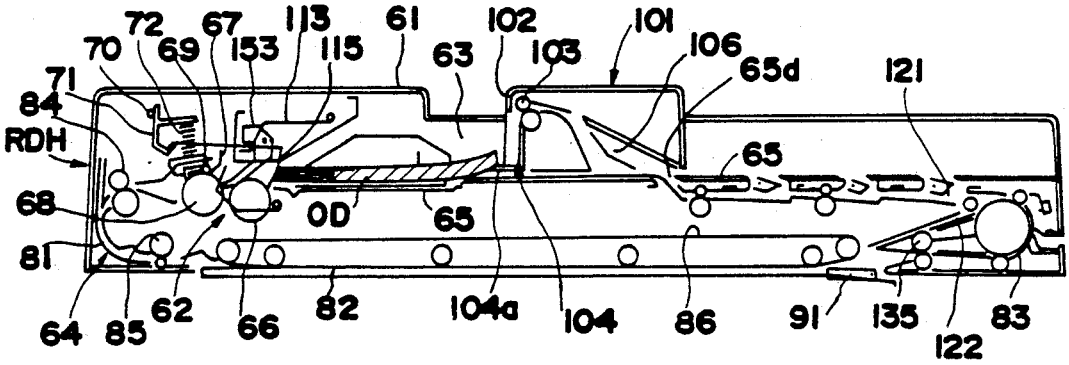
Figure 20:
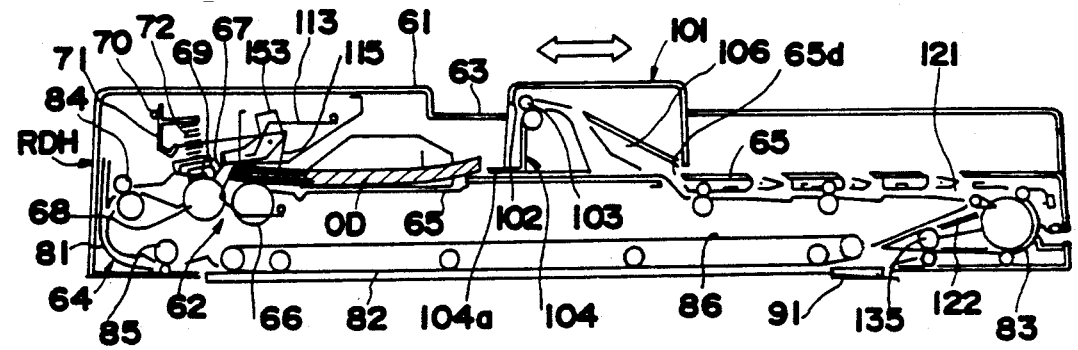
Figure 21:
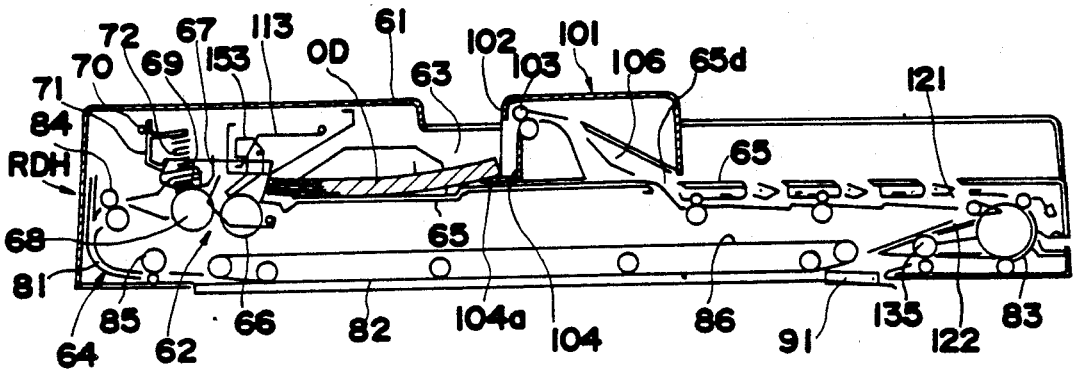
Figure 22:
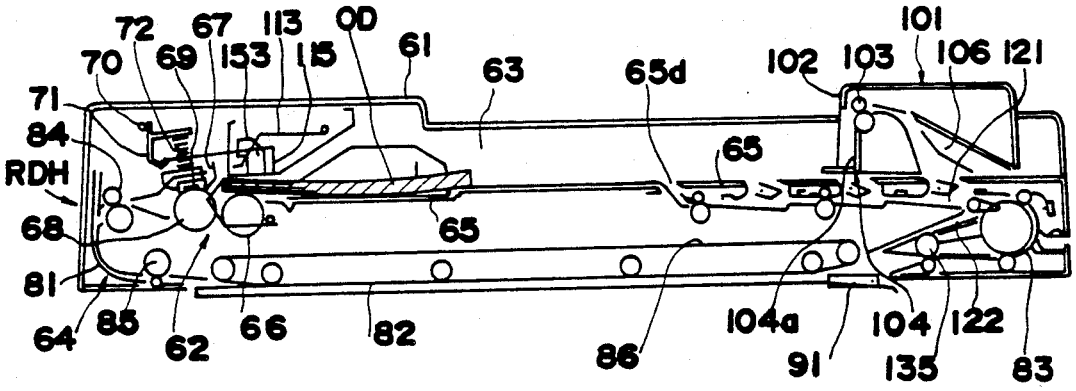

After the detection of the number of originals, the return originals OD are set in the feeding position again as seen in FIG. 17 and then fed again in succession, each from the lowermost position. The original OD thus fed, when moving past an exposure position EX shown in FIG. 18, is exposed to light for copying in the original moving scan mode. After all the originals OD have been returned to the containing portion 63 after copying as shown in FIG. 19, the guide unit 101 is temporarily advanced from the position of FIG. 19 to set the return originals in the feeding position of FIG. 20 and is thereafter returned to the original position shown in FIGS. 19 and 20. After a predetermined number of copies have been made in this way as seen in FIG. 21, the guide unit 101 is returned to the home position (FIG. 22).

Figure 25:
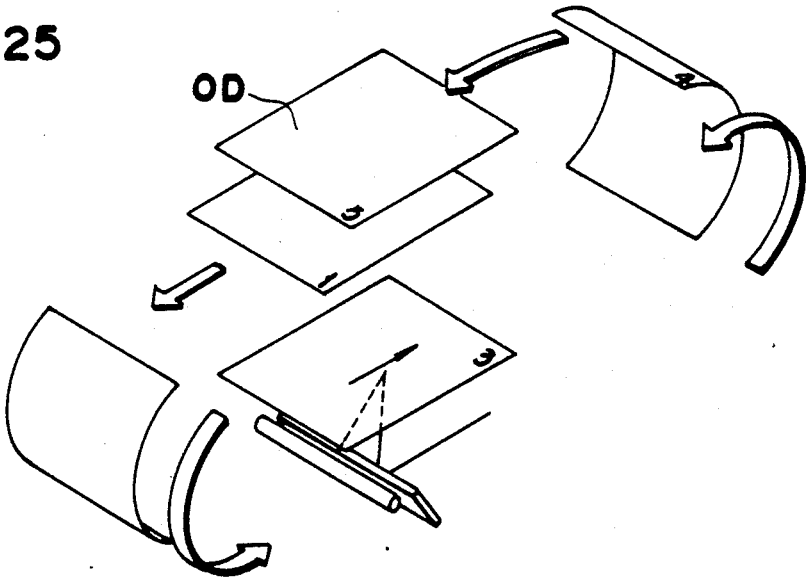
FIGS. 25 and 26 are perspective views showing the movement of originals in an original moving scan mode and the copies obtained in this mode and assorted in a sorting mode.
Figure 26:
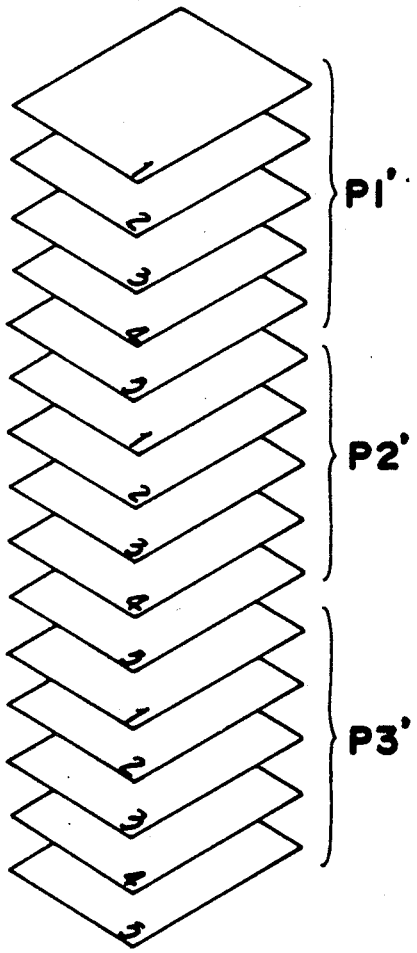

FIG. 25 shows the movement of the originals during the above operation. Each original is repeatedly copied to make the predetermined number of copies to obtain copy groups P1', P2', P3', . . . as sorted as seen in FIG. 26.

On the other hand, depending on various conditions such as the size of originals, number of set originals, feeding interval and length of the original transport channel, the feed of the last original OD from the containing portion 63 is likely to overlap the discharge of the previously fed first original OD upon return. If this overlap occurs and the speed of discharge of the previous original OD is higher than the speed of feed of the last original OD the return original OD is likely to be positioned beneath the original OD being fed and forwarded along with the outgoing original OD, or the leading end of the return original OD will engage with the rear end of the original being fed to disturb the order in which originals are accommodated.

To avoid this problem, the present embodiment is adapted such that only after the first original OD has been discharged into the containing portion 63 will the succeeding originals OD be fed.

Stated more specifically, in the original this feed control procedure is invariably executed during the circulation of originals OD for counting. However, when the originals OD are transported for copying and the quantity of originals OD is already known because of the preceding counting operation, the feed control procedure thus descried need only be performed to prevent overlaps when there are not at least five originals OD. No feed control procedure is performed when there are at least five originals OD since at least one original OD remains in the containing portion 63 of the handler during feeding. The quantities of "not at least five" and "five or more" originals OD may be varied to accommodate various conditions which may be altered, such as document size, to permit the feed control procedure to be initiated whenever, during feeding for copying, at least one original OD will not remain in the containing portion 63 of the handler during feeding.

Next, the operation panel of the copying machine A will be described. With reference to the operation panel 201 shown in FIG. 27, a first operation area AR1 has arranged therein manual keys for selecting modes of first group which can be realized by controlling standard equipment ingeniously among other modes to be executed by the machine A, and indicator lamps corresponding to the modes of the first group. A second operation area AR2 has manual keys and indicator lamps for selecting modes of a second group to be realized with use of additional equipment. A third operation area AR3 has a print key 202 for starting a copying operation and manual keys, etc. for setting copying conditions in various modes, such as a numerical value display 203 comprising, for example, seven-segment LEDs for indicating three-digit values, ten numerical keys 210 to 210 corresponding to the numbers 1, 2, . . . , 9, 0, interrupt key 220 for specifying interrupt copying, clear-stop key 221, paper cassette selection key 222 for selecting one of paper cassettes provided at different levels to specify the desired size of copy paper therein, up and down keys 223 and 224 for stepwise varying and specifying the density of copy images, and auto-manual key 225 for selecting one of an automatic paper selection mode (APS) for automatically selecting the paper supply portion 35 or 36, an automatic magnification selection mode (AMS) for automatically selecting a magnification, and a manual selection mode, etc.

An operation area ED adjacent to the first operation area AR1 has arranged therein setting keys, indicator lamps, etc. relating to an editor copy mode which can be realized with use of unillustrated editor sheet and pen-type input device as additional equipment. When these means are not used, the operation area ED is covered with a slidable closure Z to make the operation panel 201 appear simplified.

Figure 27:
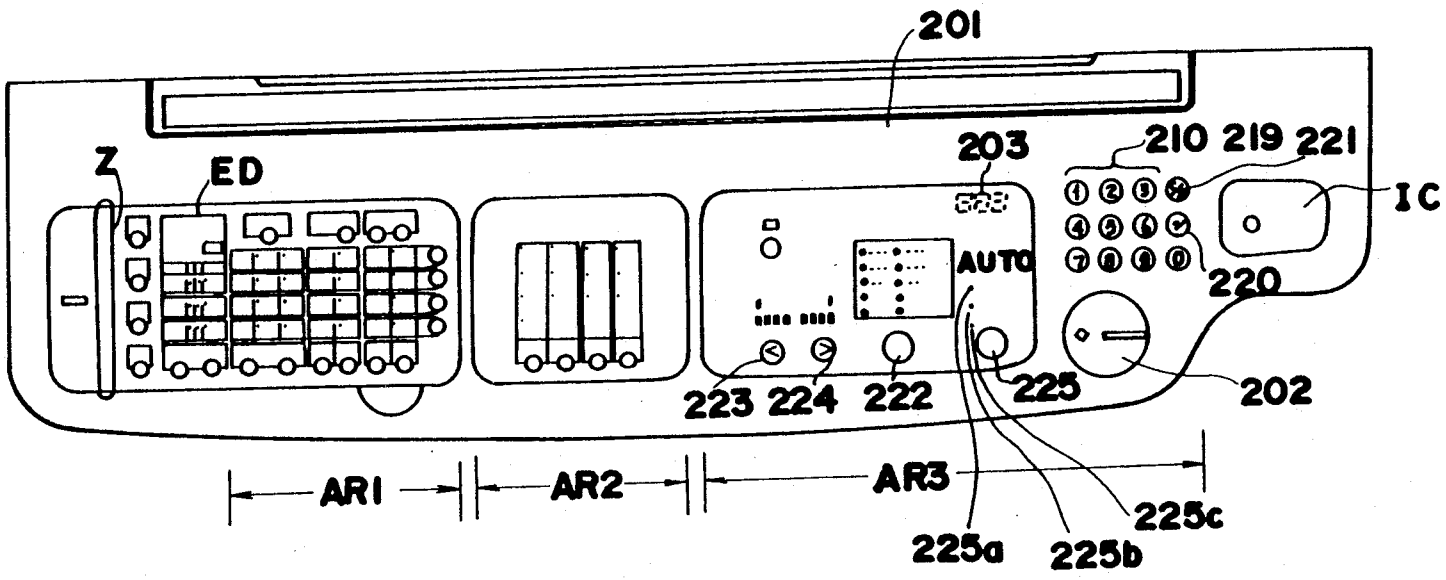
FIGS. 27 to 29 are plan views showing the operation panel of the copying machine in its entirety and also showing portions thereof on an enlarged scale.

The operation panel has as shown at the right end of FIG. 27 a data reading key IC for selecting modes and setting conditions with use of an IC card having stored therein data as to the modes and copying conditions.

Figure 28:
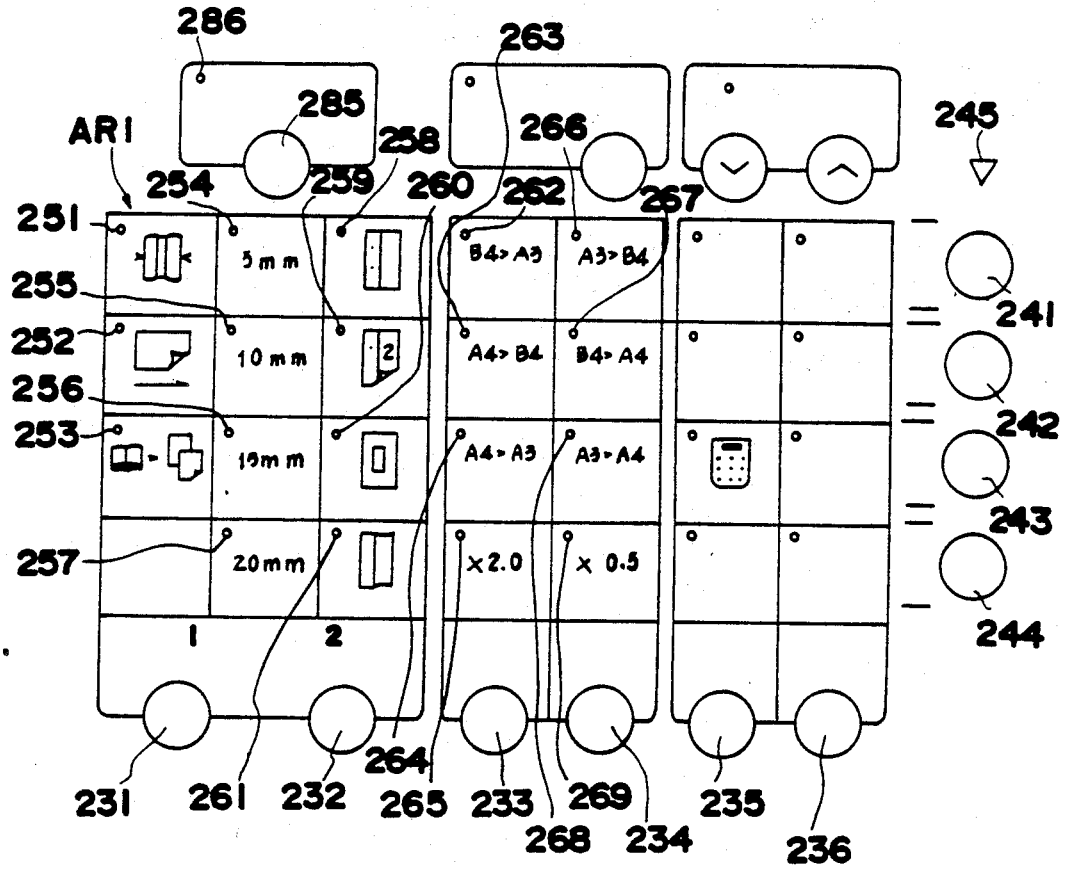

FIG. 28 is an enlarged fragmentary view showing the arrangement in the first operation area AR1 of the operation panel 201.

With reference to this drawing, a matrix arrangement is employed for the first operation area AR1 to realize simplified wiring and like hardware while permitting diversified selection with use of a small number of manual keys. More specifically, pictorial symbols corresponding to the respective modes or characters etc. representing the functions to be specified in the respective modes are in a checkerboard arrangement. The columns are provided at their lower ends with column specifying keys 231 to 236, one for each column as a rule, and row specifying keys 241 to 244 are provided at the right ends of the respective rows. Disposed above the row specifying key 241 is a selection input indicator lamp 245 comprising an LED or pilot lamp for showing that the control system is waiting for an input from the row specifying keys 241 to 244.

One of the column specifying keys 231 to 236 and one of the row specifying keys 241 to 244, when depressed, select one of the modes of the first group or the function in one mode.

The column specifying key 231 is used for specifying the left-end row of the drawing wherein squares are marked with pictorial symbols which represent an anamorphically magnification varying mode, noncopy mode and book mode as arranged downward. The column specifying key 232 is depressed for selecting one of a binding margin 1 copy mode, binding margin 2 copy mode, blank frame mode and punch hole erasure mode and a margin value for the specified mode. While the binding margin 2 mode is suitable for producing duplex copies, the copy paper is manually turned upside down by the operator for duplex copying with use of the standard equipment only.

The column specifying keys 233 and 234 are manual keys for selecting an enlarged copy mode and reduced copy mode, respectively. When either of these modes is selected, one of the row specifying keys 241 to 244 is depressed to select one of predetermined four magnifications.

The column specifying keys 235, 236 are manual keys relating to the function of selecting a desired magnification in the enlarged or reduced copy mode and are depressed for selecting magnification setting means, and selecting a magnification memory and a method of reading out the magnification.

The light of backlight LEDs 251 to 269 is made directly visible at the upper left corners of the squares marked with the pictorial symbols or descriptive characters in the first operation area AR1, as indicated by circle marks. These LEDs 251 to 269 each flicker while the corresponding mode or function is being selected. Upon completion of the selection procedure, the LED for the selected mode or function is held on, with the other LEDs turned off.

The procedure will be described for selecting the book copy mode, one of the standard modes, using some keys in the first operation area AR1.

In the initial state of the copying machine A, the print key 202 is on in green. Now, when the column specifying key 231 is depressed, the three LEDs 251 to 253 in the left-end column flicker in green, and the selection input indicator lamp 245 flickers to urge the operator to depress one of the row specifying keys 241 to 244, with the light of the print key 202 changed to red.

The row specifying key 243 is then depressed to select the book copy mode, whereupon among the flickering LEDs 251 to 253, only the LED 253 corresponding to the book copy mode is held on in green, and the other LEDs are turned off.

The print key 202 goes on again in green when the book copy mode selection procedure has thus been completed. The print key 202, when subsequently turned on, initiates a copying operation in the book copy mode, and the book is scanned twice with the exposure lamp 13 with different on periods and different scan lengths.

Figure 29:
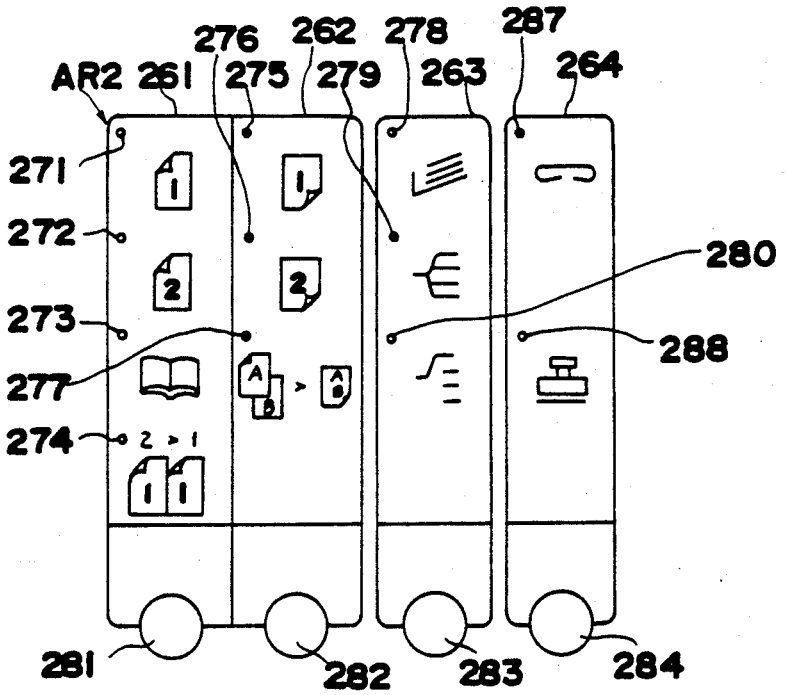

FIG. 29 is an enlarged fragmentary view showing the arrangement in the second operation area AR2 of the operation panel 201.

The second operation area AR2 is an area for selecting some modes relating to the additional equipment used for making a large quantity of copies conveniently, and also for selecting some of the functions of the additional equipment.

In the second operation area AR2, modes are selected which can be selected when the copying machine A is provided with additional equipment for automatically conducting a sequence of copying operations from the placement of originals through the orderly arrangement of the copies obtained so as to achieve an improved operation efficiency especially when producing a large quantity of copies. The additional equipment includes the recirculating document handler RDH, paper resupply portion 37, sorter (not shown) and finisher 141.

The second operation area AR2 has pictorial symbols representing items to be selected and arranged ingeniously along the thought of the operator contemplating steps for copying work. These items to be selected relate to: (1) the type of originals to be handled, (2) the layout of the copy images to be reproduced on copy paper, (3) how to assort the resulting copies, and (4) how to finally treat the copies (e.g., binding into sets of several copy sheets, or folding copies in two). For the operator to follow a selection procedure ',i step by step in the order of (1)→(2)→(3)→(4), the second operation area AR2 has four selection sections, i.e. an original selection section 261, layout selection section 262, assorting selection section 263 and copy treatment selection section 264 which are arranged from left to right in this order.

However, the selection section to be manipulated is limited according to the type of additional equipment used. For example, when an unillustrated sorter is used as the additional equipment, one of a nonsorting mode, sorting mode and grouping mode can be selected, or alternatively if the machine is not equipped with the sorter, the sorting mode or grouping mode can be selected, in respect of the assorting method (3). Further when the aforementioned copy treating means are used for the final treatment of copies (4), one mode can be selected from among a nontreatment mode, staple mode in which several copies are bound together with staples, stamp mode wherein an impression is produced by the stamper, and staple-stamp mode.

Collectively arranged in the original selection section 261 are the items to be selected in the RDH mode wherein the document handler RDH is used. However, since the original selection section 261 is provided as an area for selecting the type of originals as stated above, the book copy mode, which can be realized with the standard equipment, can also be selected in this section.

More specifically, the original selection section 261 has arranged therein pictorial symbols representing the items to be selected, i.e., single-faced original, duplex original, book original and two-in-one original. At a position to the left of each symbol thereabove, the light of a backlight LED is made directly visible as indicated by a circle mark. Thus, LEDs 271 to 274 are provided which, along with the pictorial symbols, individually represent different types of originals. One of these LEDs goes on when the corresponding type of original is selected by depressing an original type selection key 281 of the rotation type disposed below the original selection section 261.

The term "two-in-one original" refers to a set of originals arranged side by side and to be handled in the two-in-one mode.

When the single-faced original, duplex original or two-in-one original is selected by manipulating the original selection section 261, the originals to be copied are automatically fed and further transported or inverted by the document handler RDH, whereas the handler RDH is not used as a rule for book originals which are bulky. No copying operation is conducted in the book copy mode when originals OD set in the containing portion 63 are detected by the absence sensor 153.

A duplex original signal is turned on when the duplex original mode is selected by the original type selection key 281, but this signal is turned off when the single-faced original mode, two-in-one original mode or book division mode is selected.

Arranged in the layout selection section 262 are pictorial symbols and LEDs 275 to 277 respectively corresponding to the single-face copy mode, duplex copy mode and composite copy mode one of which is selectable by depressing a layout selection key 282, whereby how to use the paper resupply portion 37 is selected.

Figure 30:
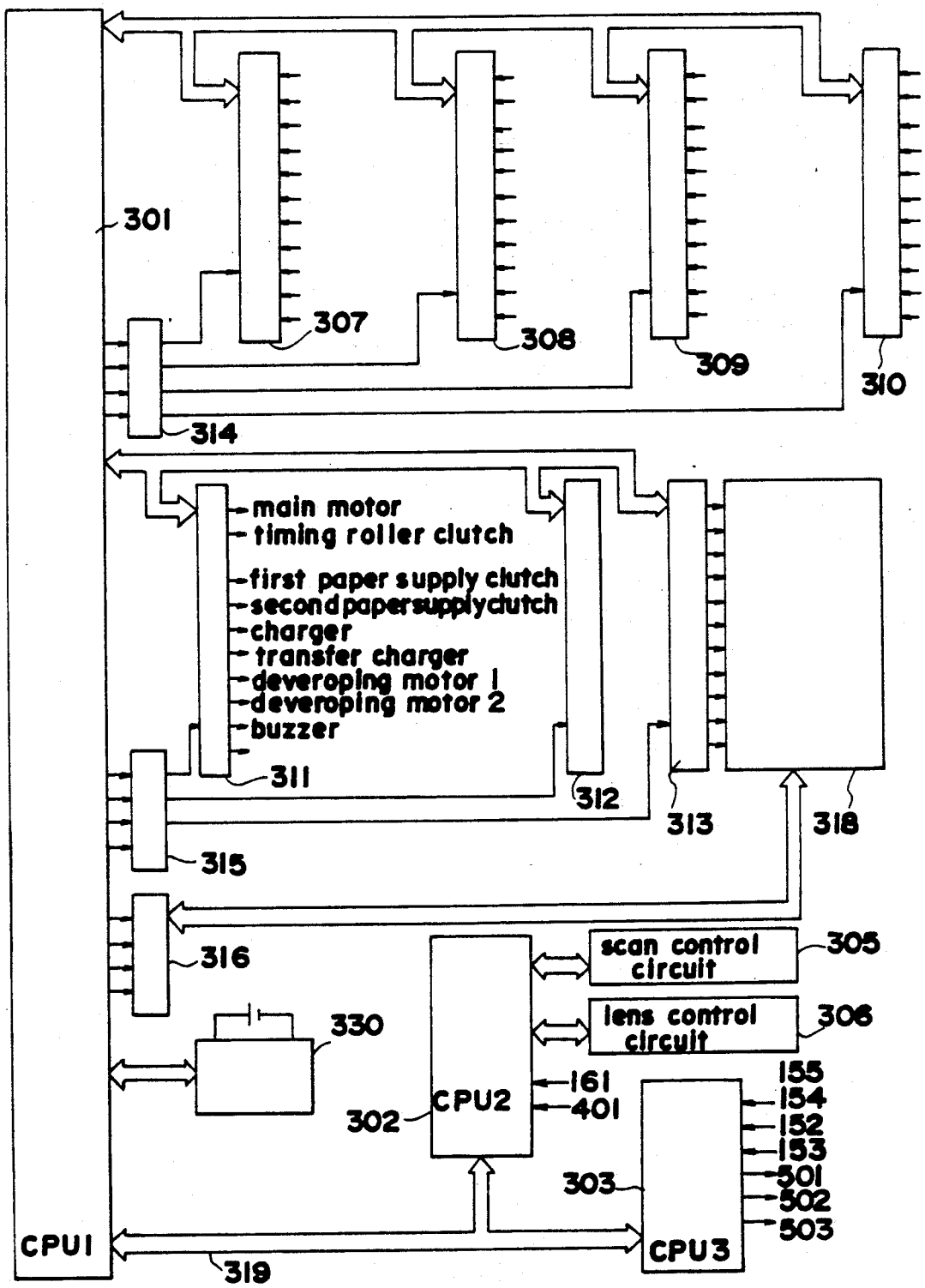
FIG. 30 is a block diagram of a control circuit.

FIG. 30 is a block diagram showing the control circuit of the copying machine A.

Input buffers 307 to 310 controlled by a first CPU 301 via a decoder 314 have connected thereto the manual keys arranged on the operation panel 201, and sensors and switches provided at various locations. Further connected to output buffers 311 to 313 controlled by the CPU via a decoder 315 are unillustrated main motor, developing motors 1 and 2 and clutches, the transfer charger 8, the sensitizing charger 4, and an indicator matrix circuit 318 for turning on the indicator lamps on the operation panel 201. Indicated at 316 is a decoder, and 330 is a RAM backed up with a battery.

The first CPU 301 communicates with a second CPU 302 and a third CPU 303 via a communication line 319. The second CPU 302, adapted to control the operation of the projection optical system 11, has connected thereto a scan motor control circuit 305, magnification varying lens control circuit 306 for shifting the projection lens 18, home position switch 161, timing switch 401 for producing a register timing signal to rotate the register roller 47, etc.

The third CPU 303, provided for controlling the document handler RDH, feeds control signals to a transport motor 501, paper feed motor 502 and inversion motor 503 and receives signals from various sensors 152, 153, 154 and 155 provided on the handler RDH.

Figure 31:
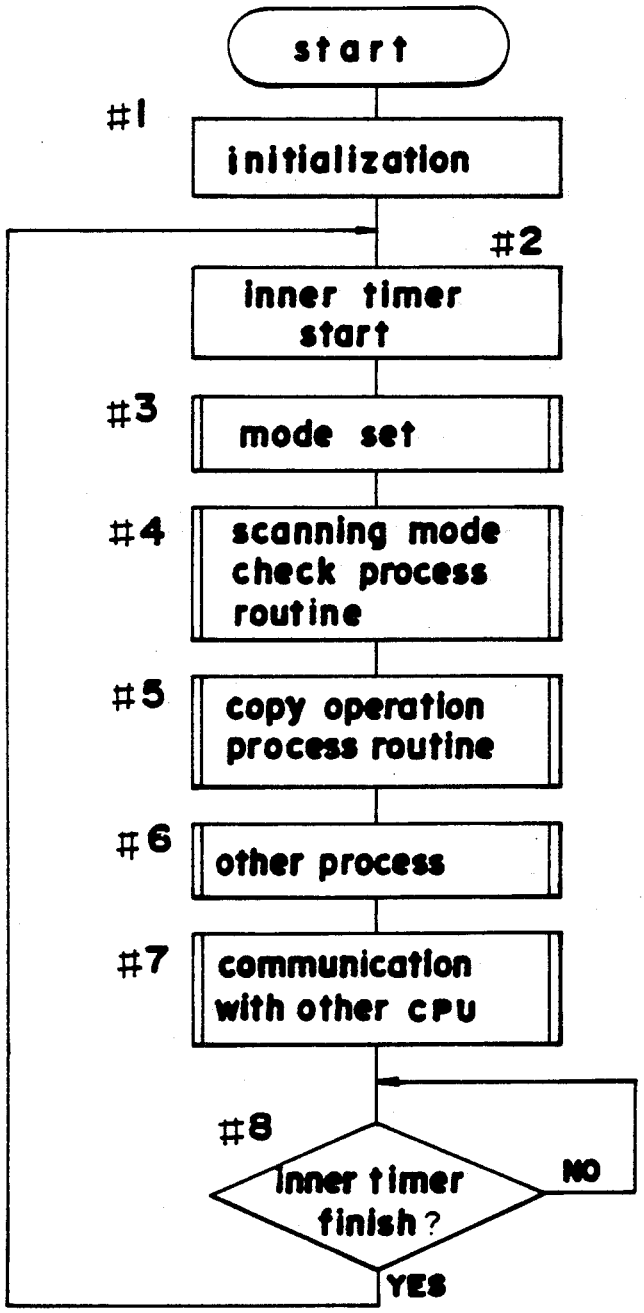
FIG. 31 is a flow chart showing the main routine of control operation of a first CPU.

The main operation control routines of the first, second and third CPUs will be described below with reference to the flow charts of FIGS. 31 et seq.

First, the operation of the first CPU 301 will be described. FIG. 31 is the main control routine to be executed by the first CPU 301. When the first CPU 301 is reset and the program is started, the sequence is started with step #1, wherein the microcomputer is initialized to clear the RAM and set various registers. and the main assembly of the copying machine A is initialized.

Next in step #2, an inner timer is started up which is incorporated in the first CPU 301 and set to a specified value by the initialization. In the subsequent steps #3 to #7, subroutines are called up in succession. On completion of the inner timer operation in step #8 following the completion of all the subroutines, one routine is completed. The sequence then returns to step #2.

The subroutine of step #3 is performed for the manipulated keys, i.e., AUTO selection, original selection, layout selection, second-group mode selection, sorter mode selection, simultaneous color mode selection and finish mode (with the finisher 141) selection keys. Step #4 checks the scanning mode as to whether it is the optical system moving scan mode or the original moving scan mode. A copy operation process subroutine is performed in step #5, other process is executed in step #6, and the first CPU 301 communicates with the second and third CPUs in step #7.

Figure 32:
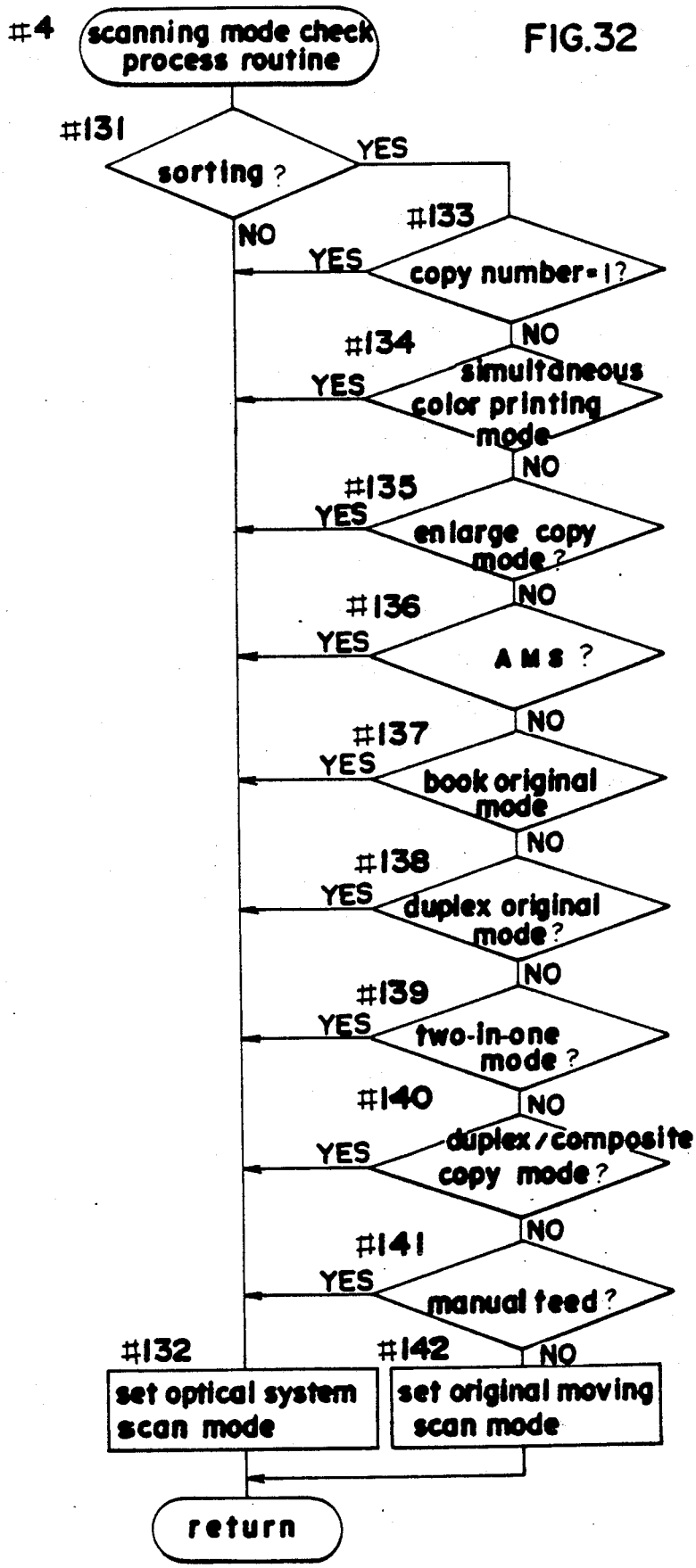
FIG. 32 is a flow chart showing a scanning mode check process routine.

FIG. 32 shows the scanning mode check process subroutine. This routine selects one of scan modes, i.e., optical system moving scan mode or the original moving scan mode is selected in preference in connection with other set modes. First in step #131, an inquiry is made as to whether the current mode is the sorting mode. If it is not the sorting mode, the sequence proceeds to step #132 to preferentially select the optical system moving scan mode since this mode is suitable in this case.

Further even if the current mode is the sorting mode, the optical system moving scan mode is selected when one copy is to be made, or when the current mode is the simultaneous color printing mode, enlarged copy mode, automatic magnification selection (AMS) mode, book original mode, duplex original mode, two-in-one mode, duplex copy mode, duplex/composite copy mode or manual feed mode, since in any of these cases, the original moving scan mode is not suitable or is difficult or impossible to realize (steps #133 to #142).

Figure 33:
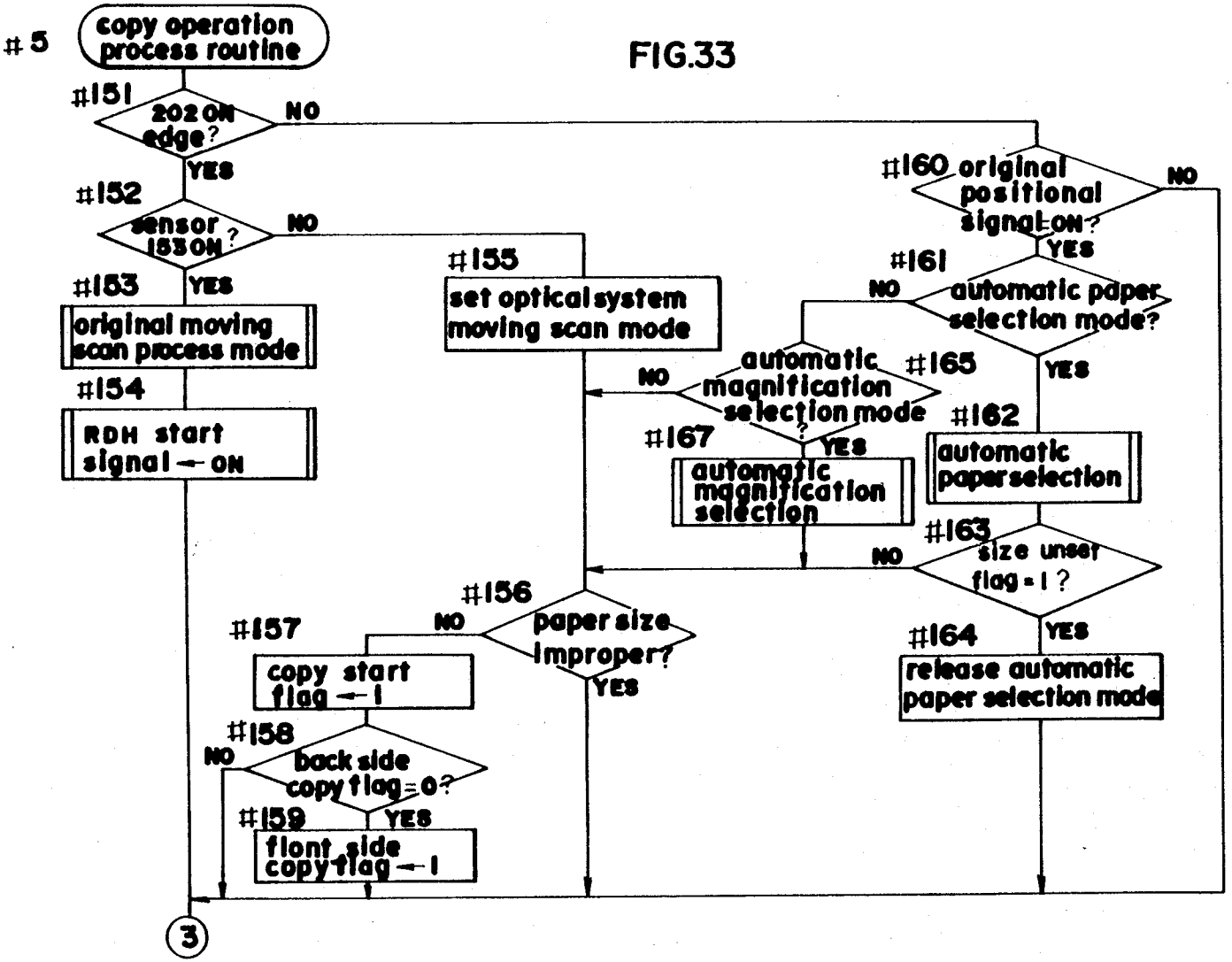
FIGS. 33 to 36 are flow charts showing a copy operation process subroutine.

FIGS. 33 to 36 show the copy operation process routine. As shown in FIG. 33, an inquiry is first made in step #151 of this routine as to whether the print key 202 is on edge. If the answer is in the affirmative and when the sensor 153 is found on in step #152, an original moving scan mode processing subroutine is called up in step #153.

Figure 37:
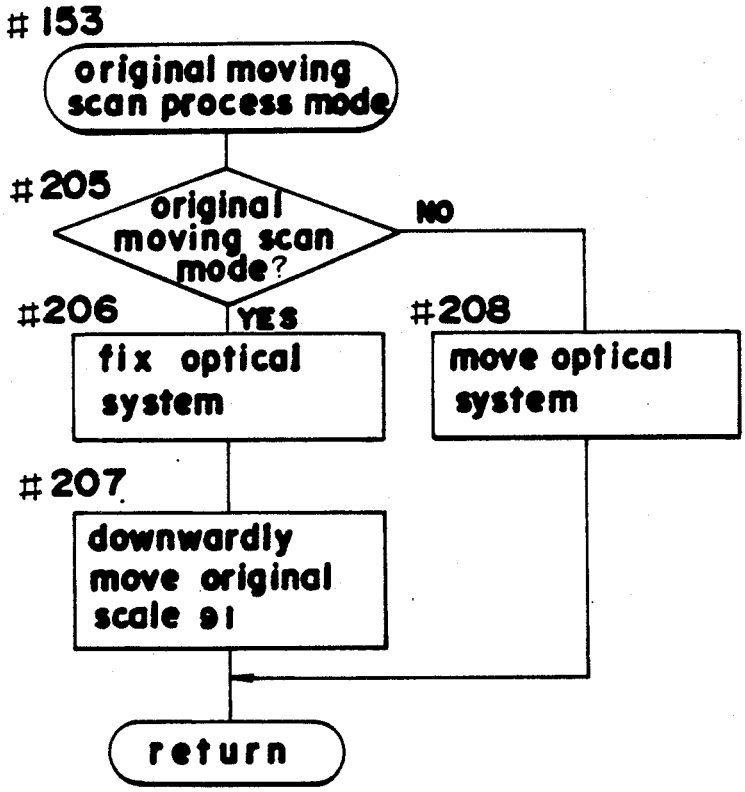
FIG. 37 is a flow chart showing an original moving scan process mode subroutine.

FIG. 37 shows this subroutine, in which an inquiry is made first in step #205 as to whether the machine is in the original moving scan mode. When the answer is affirmative, the exposure lamp 13 and the first to third mirrors 14, 16, 17 of the projection optical system 11 are moved to the position for this mode and fixed in position in step #206. The original scale 91 is fixed to the lowered position in step #207. If the machine is not in the original moving scan mode, the exposure lamp 13 and the first to third mirrors 14, 16, 17 of the optical system 11 are moved to the home position in condition for the optical system moving scan mode (step #208).

Figure 34:
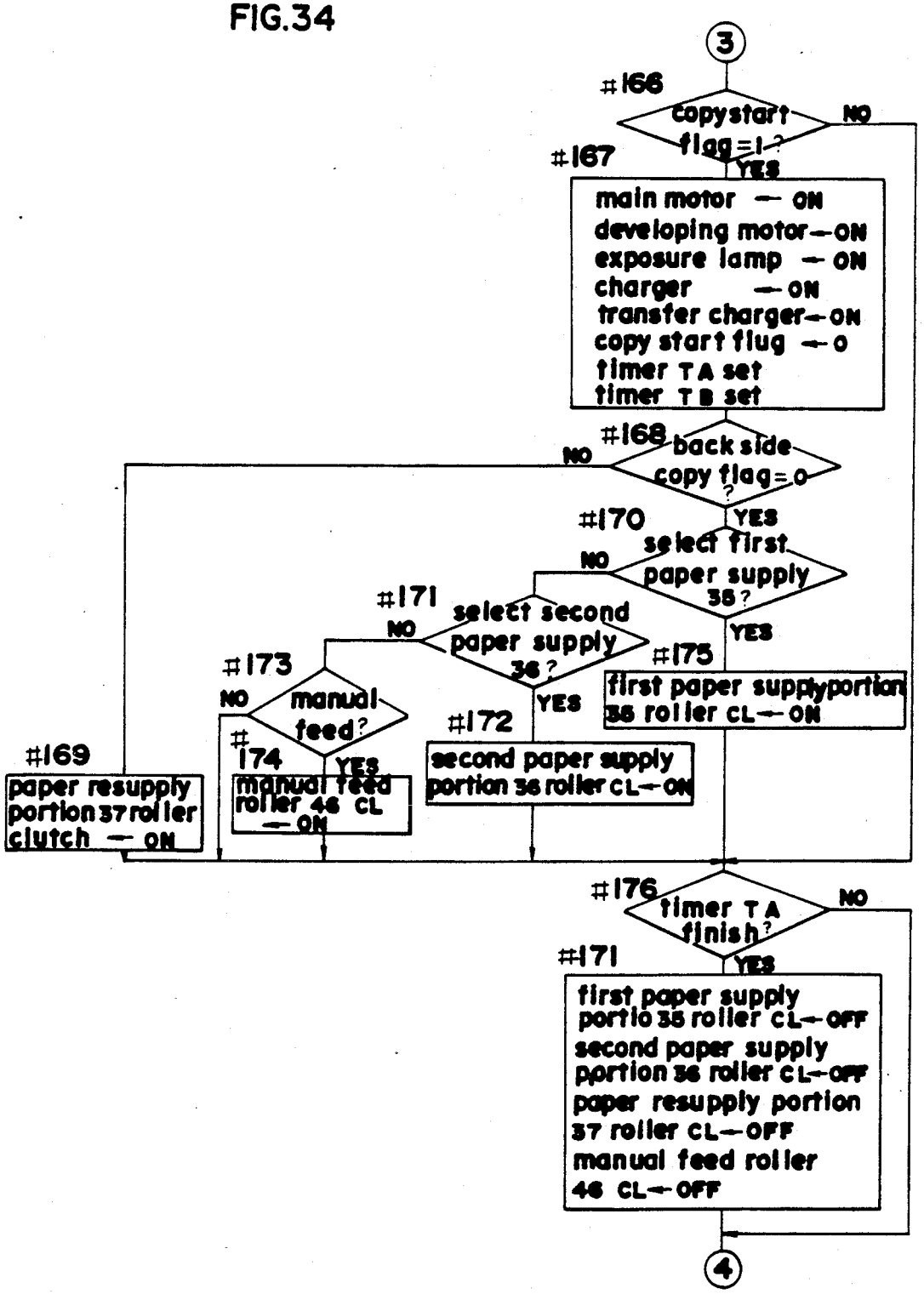

After the projection optical system 11 has been set in position for the current scan mode, the sequence returns to the copy operation process routine shown in FIG. 33, in which a start signal for the document handler RDH is turned on in step #154, followed by step #166 in the flow chart of FIG. 34.

If no original is found in the containing portion 63 in step #152 although the print key 202 is on edge, this indicates that the original is placed by hand without using the handler RDH. Accordingly, the machine is set in the optical system moving scan mode in step #155, and the exposure lamp 13 and the first to third mirrors 14, 16, 17 are moved to the home position.

Next, the copy paper size of the selected paper supply portion is checked as to whether it is improper (step #156). If the size is improper, the sequence proceeds directly to step #166 in FIG. 34. If otherwise, a copy start flag is set to "1" in step #157, and an inquiry is then made in step #158 as to whether a back side copy flag is "0". When this flag is not "0" but "1", FIG. 34, step #166 follows directly. If the flag u is "0", a front side copy flag is set to "1" in step #159 before step #166. The flag represents "possible" when it is "1", or "impossible" when "0".

When the print key 202 is not on edge in step #151, the sequence proceeds to step #160, in which an original positional signal is checked as to whether it is on. If it is not on, step #166 of FIG. 34 directly follows. If otherwise and when neither the automatic paper selection mode not the automatic magnification selection mode has been selected, this indicates manual selection, so that step #156 follows. If the machine is in either of these modes, the corresponding automatic selection step #167 or #162 is executed. In the case of the automatic magnification selection mode, step #167 is followed directly by step #156. In the other mode, step #162 of automatic paper selection is followed by step #156 only when a size unset flag is not "1". When this flag is "1", indicating that automatic paper selection is impossible, the automatic paper selection mode is canceled, whereupon FIG. 34, step #166 follows. The size unset flag, when "1", means that paper of the size to be used has not been set.

FIG. 34, step #166 checks whether the copy start flag is "1". Only when it is "1", the main motor, developing motor, exposure lamp 13, sensitizing charger 4 and transfer charger 8 in the body of the copying machine A are turned on and made ready to start a copying operation. The copy start flag is reset to "0", and paper feed timers TA and TB are set. Depending on the state of the flag for duplex copying and also on which one is selected from among the paper supply portions including the manual feed portion, the clutch of the selected one of the pickup rollers 39, 40, 41 of the supply portions 35 to 37 and the manual feed roller 46 is thereafter engaged to start feeding paper (steps #167 to #173). On completion of operation of the paper feed timer TA, the engaged clutch of the selected roller 39, 40, 41 or 46 is disengaged to complete feed of one sheet of paper (step #177).

Figure 35:
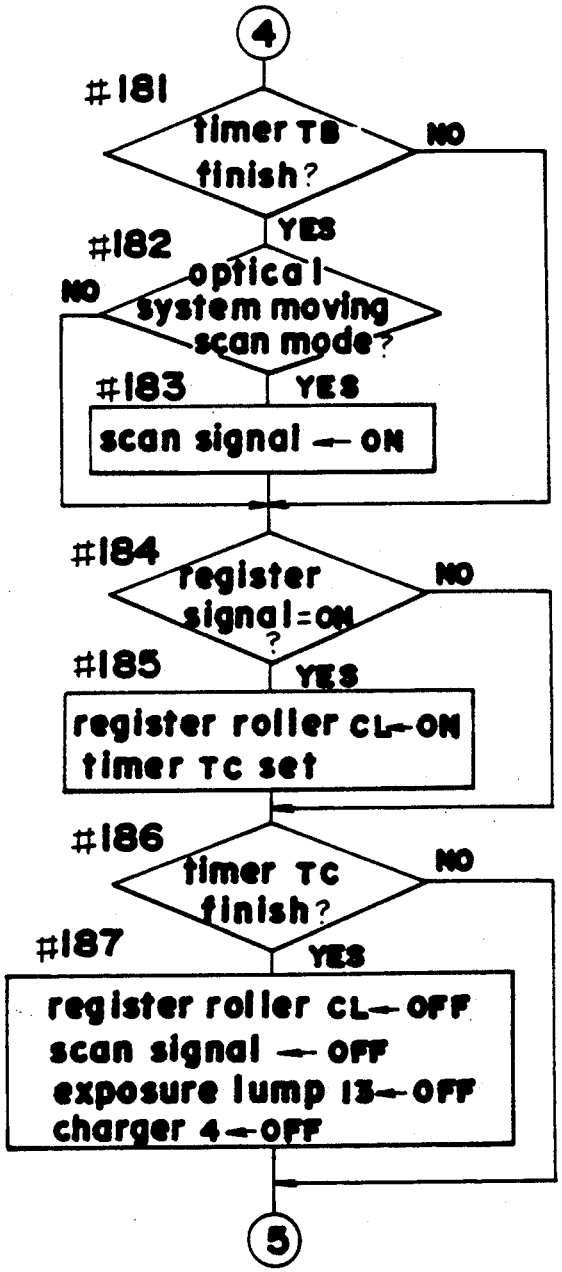

Subsequently, steps #181 to #187 in FIG. 35 are executed, in which the optical system moving scan mode is set on completion of operation of the paper feed timer TB, a scan signal is fed, the clutch of the register roller 47 is engaged in response to a register signal, and on completion of operation of transfer completion timer TC, the register roller (47) clutch is disengaged, the exposure lamp 13 and the sensitizing charger 4 are turned off and the scan signal is turned off, whereby a single exposure and transfer of the resulting image are completed.

Figure 36:
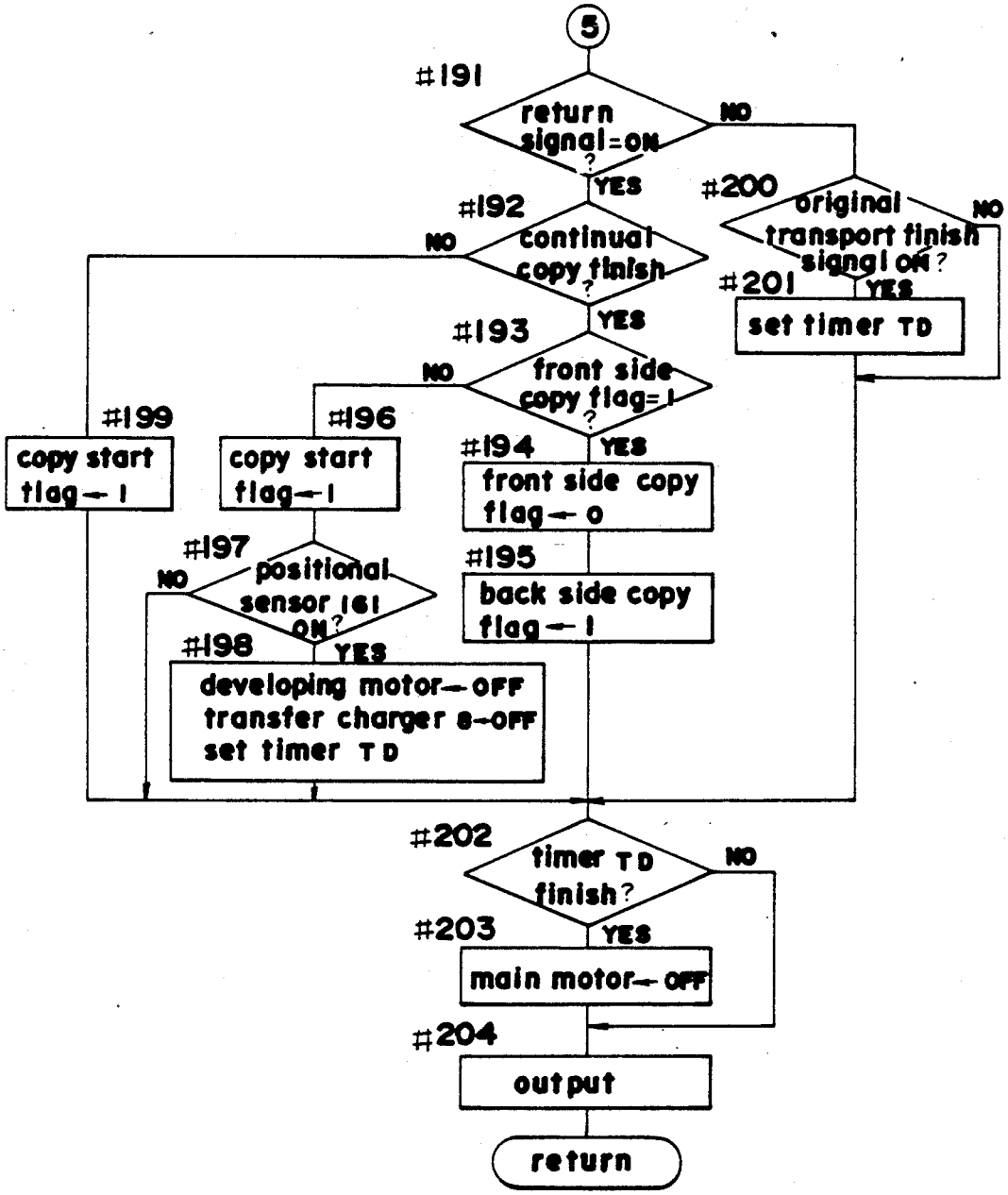

Further subsequently, step #191 of FIG. 36 checks whether a return signal is on for the projection optical system. If it is on, an inquiry is made in step #192 as to whether continual copy cycles have been completed. When the answer is affirmative, this indicates that the specified number of front side copies have been made Step #193 therefore checks whether the front side copy flag is "1". When it is "1", this flag is reset to "0", and the back side copy flag is set to "1" for back side copying operation (steps #192 to #195).

Unless the front side copy flag is "1" in step #193, the copy start flag is set to "1" in step #196, and step #197 inquires whether the first slider 12 of the optical system 11, as returned to the home position, is detected by the home position switch (positional sensor) 161. If the answer is negative, a further surface copying operation is conducted. When the answer is affirmative, indicating completion of copying operation, step #198 follows to turn off the developing motor and the transfer charger 8 and set an operation completion timer TD.

If the continual copy cycles have not been found completed in step #192, the copy start flag is set to "1" for continued copying operation (step #199).

On the other hand, when the return signal is found off in step #191, step #200 inquires whether an original transport finish signal is on. If it is on, indicating the completion of copying operation, the operation completion timer TD is set in step #201.

Subsequently, the completion of operation of the timer TD is detected in step #202, whereupon the main motor is turned off in step #203 to bring the entire copying operation A out of operation, and the result achieved is output (step #204).

Figure 38:
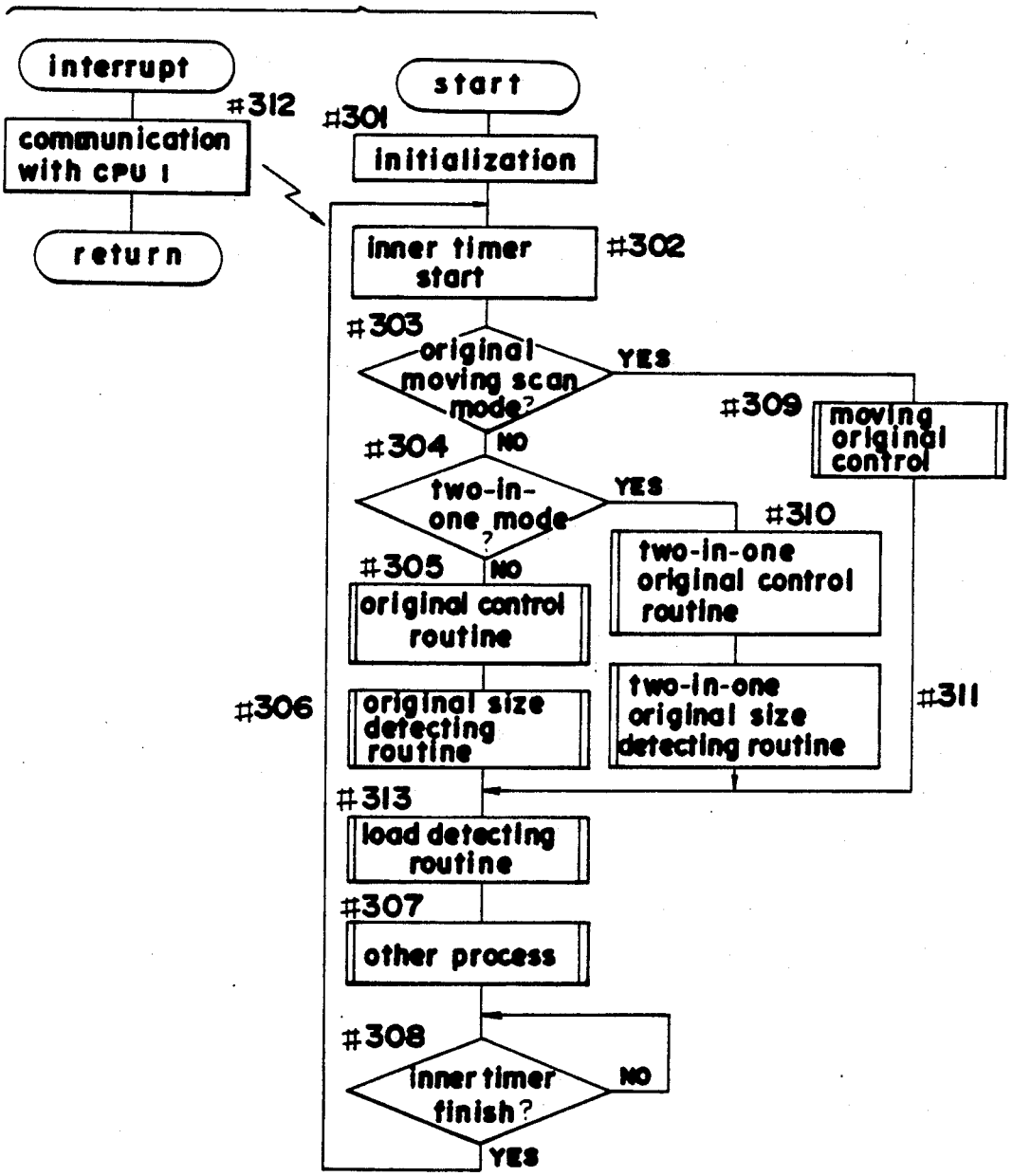
FIG. 38 is a flow chart showing the main routine of control operation of a second CPU.

FIG. 38 is a flow chart showing the main routine to be performed by the third CPU 303 for controlling the recirculating document handler RDH.

The system is initialized in step #301, an inner timer is started in step #302, and steps #303 and #304 thereafter inquire whether the current mode is the original moving scan mode or the two-in-one mode. If neither is the case, subroutines, i.e., an original control routine, original size detecting routine, load detecting routine and other process routine, are called up one after another (steps #305, #306, #313 and #307). On completion of operation of the inner timer, the sequence returns to step #302 (step #308).

Figure 52:
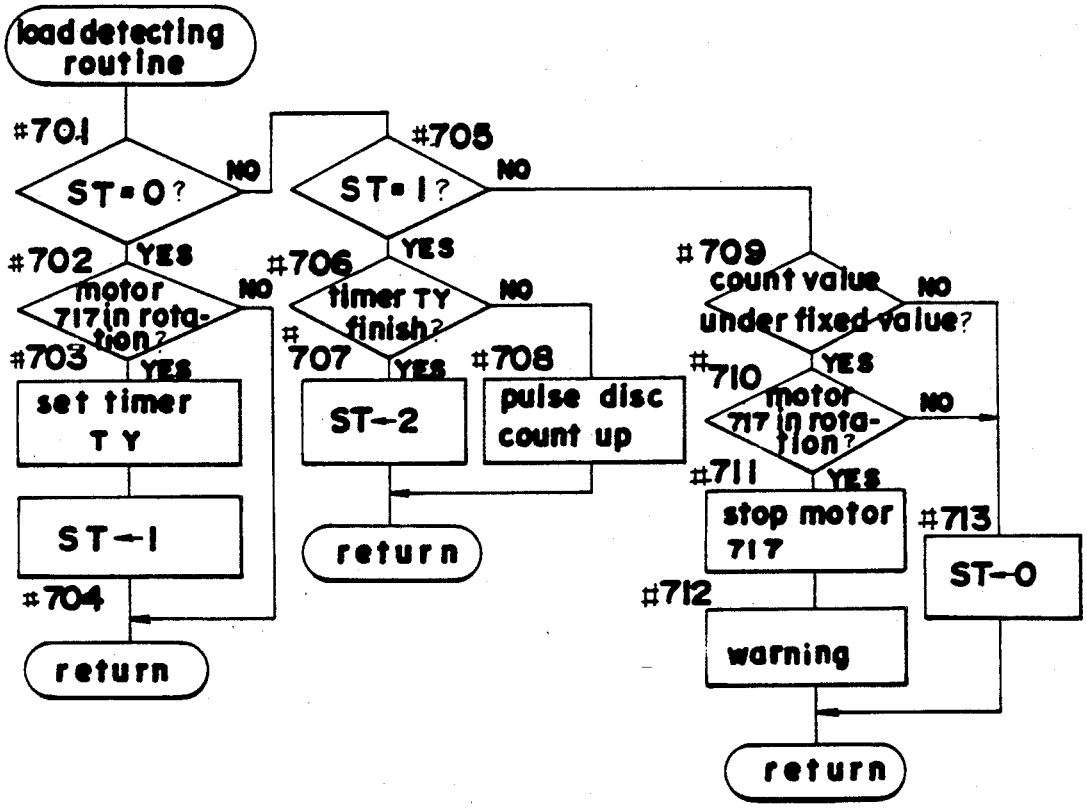
FIG. 52 is a flow chart showing the subroutine of a load detecting routine in FIG. 38.

Now, with reference to FIG. 52, the load detecting routine will be described.

If a state counter ST is found to be 1 in step #701, step #702 checks whether the motor 717 for driving the guide unit 101 is in rotation. When the motor 717 is in rotation, a timer TY is started in step #703 for setting a period of time for the pulse disc 722 to count pulses. The state counter ST is set to 1 in step #704. If the drive motor 717 is not in rotation, the sequence returns directly.

If the state counter is found to be 1 in step #705, step #706 inquires whether the operation of the timer TY has been completed. When the answer is affirmative, the state counter ST is set to 2 in step #707, whereas if otherwise, step #708 follows for the disc 722 to count up pulses. The sequence thereafter returns.

When the state counter ST is found to be 2, step #709 checks whether the count obtained by the disc 722 is below a predetermined value. If the count is below the fixed value, step #710 inquires whether the drive motor 717 is in rotation. When the motor 717 is in rotation, this indicates that although the guide unit 101 is driven by the motor, some load acting thereon causes the slipping means 721 to produce slippage to result in the count below the fixed value. To relieve the guide unit 101 of the load, therefore, the drive motor 717 is stopped in step #711, and the buzzer is turned on in step #712 for warning. If the count checked in step. #709 is not below the fixed value or when the drive motor 717 is found to be out of rotation in step #710, this indicates that the guide unit 101 is free of load, so that the state counter ST is reset to 0 step #713, whereupon the sequence returns.

Referring to FIG. 38 again, when the current mode is found to be the original moving scan mode in step #303, a subroutine for controlling the moving original in this mode is called up (step #309), followed by step #307. Further when the two-in-one mode is identified in step #304, a two-in-one original control subroutine and then a two-in-one original size detecting subroutine are called up in steps #310 and #311, and the sequence proceeds to step #307.

Further in response to an interrupt request from the first CPU 301, if any, the third CPU 303 performs communication with the first CPU 301 (step #312).

Figure 39:
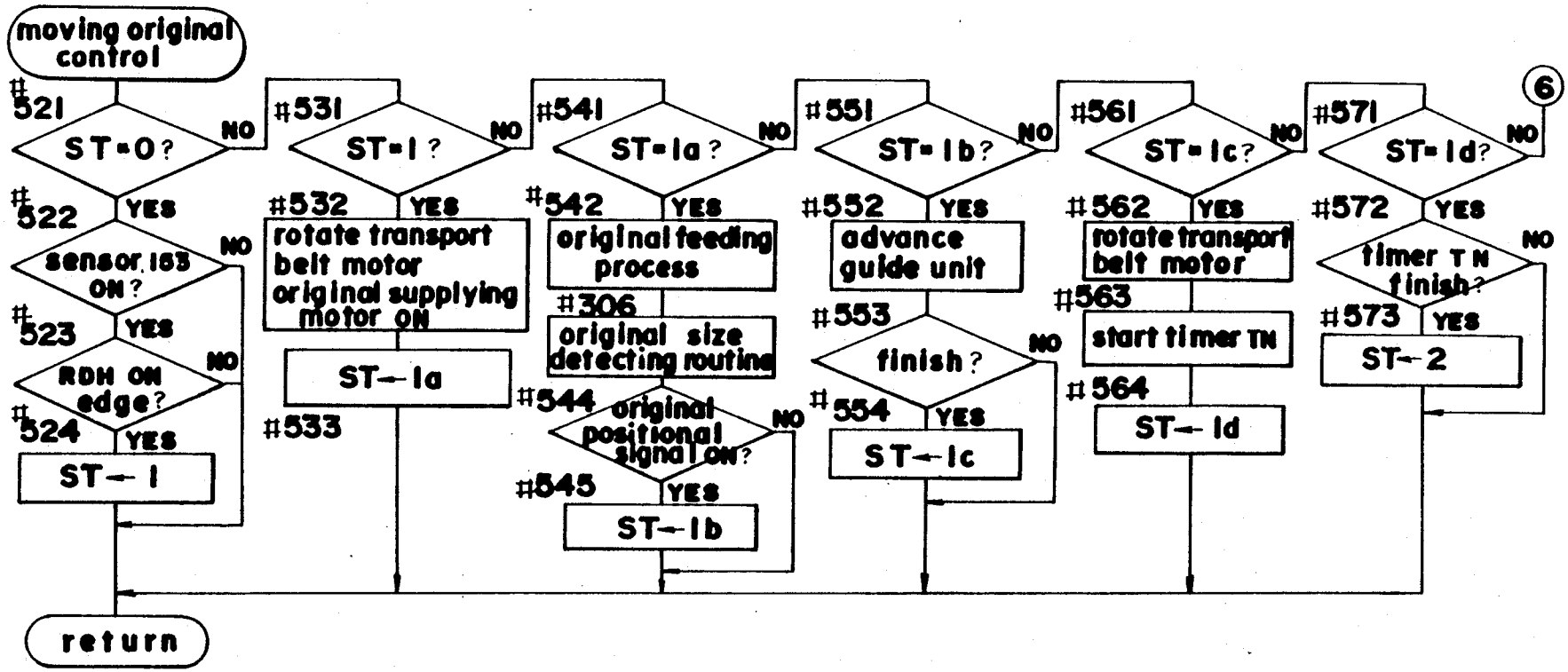
FIGS. 39 to 41 are flow charts showing the subroutine of a moving original control process of FIG. 38.
Figure 40:
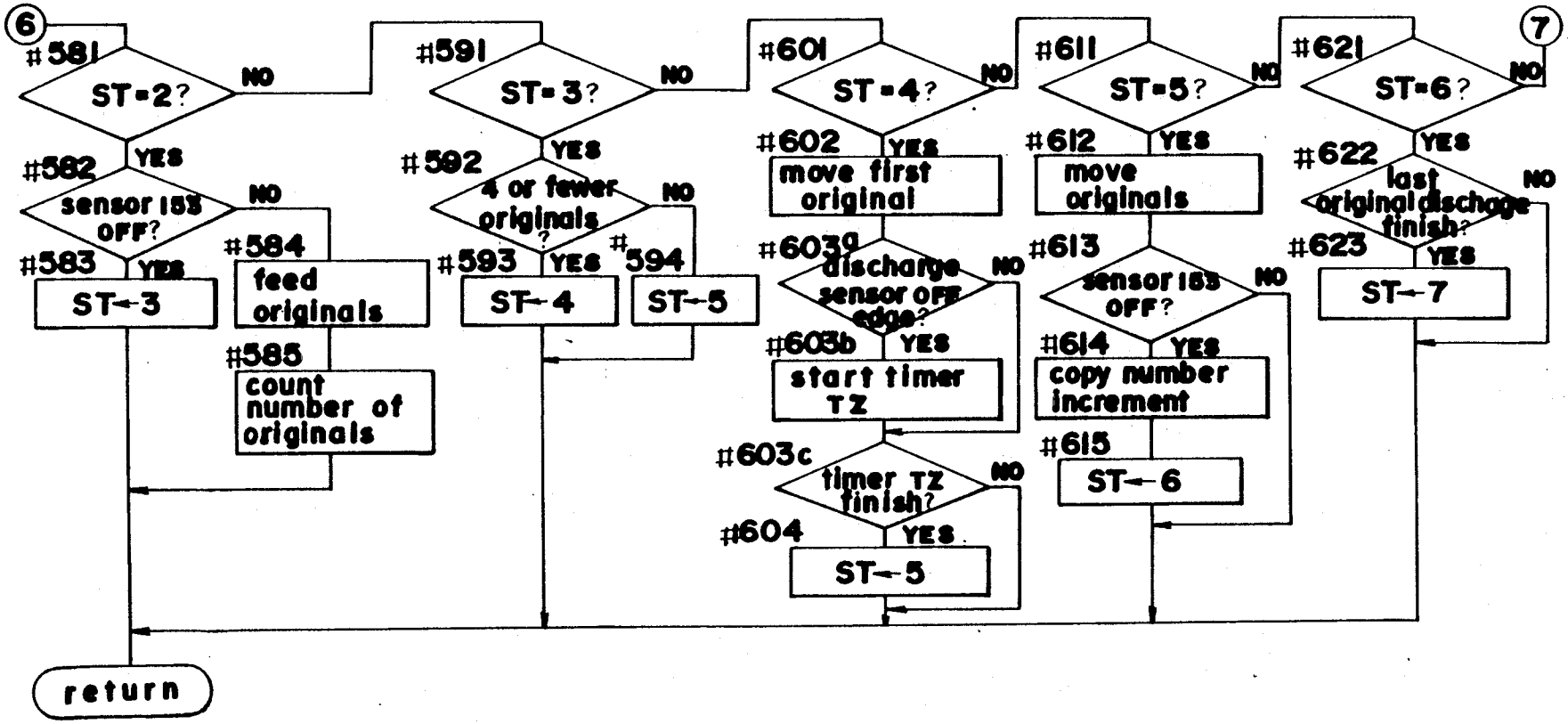
Figure 41:
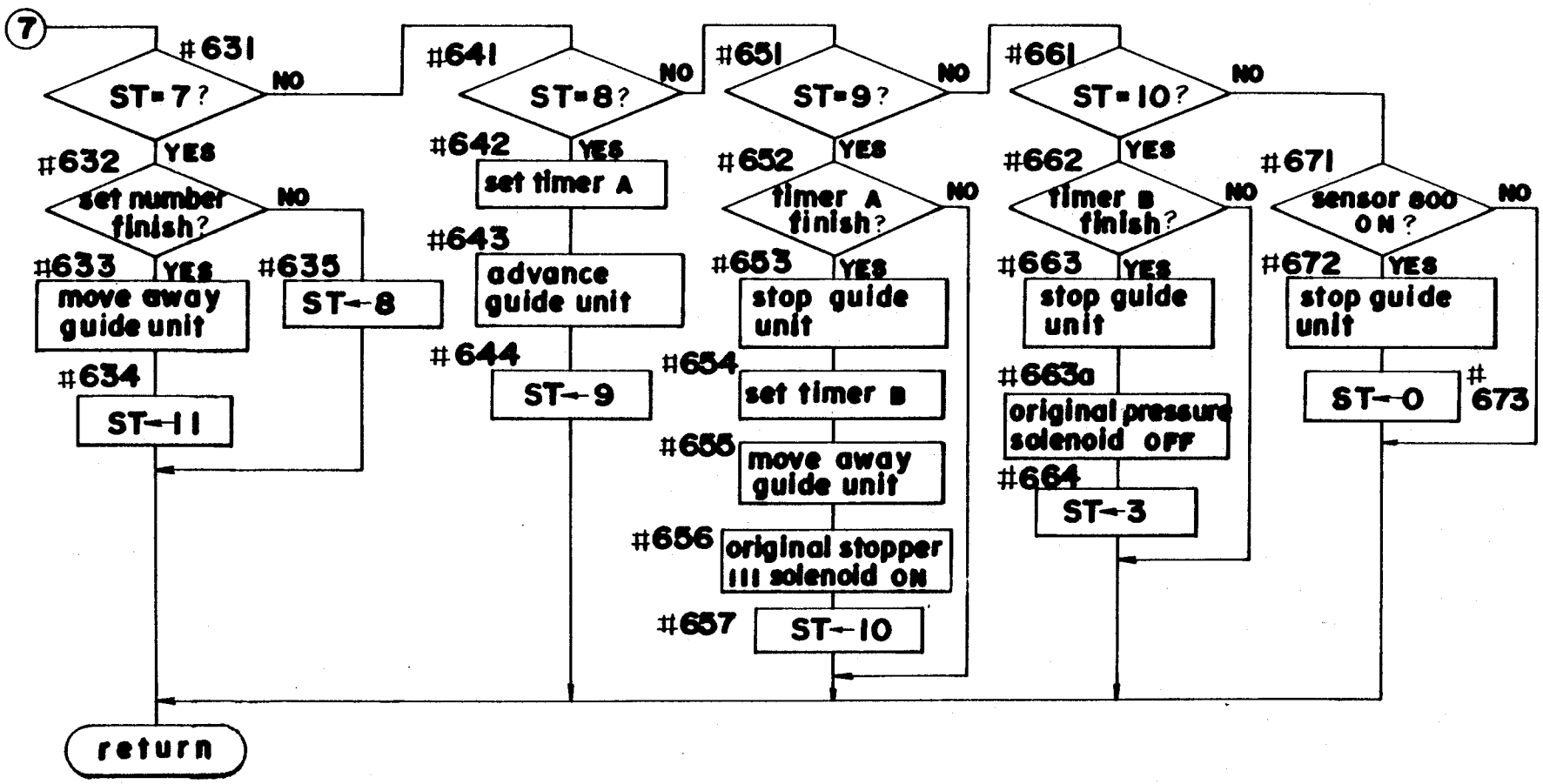

FIGS. 39 to 41 is a flow chart showing the moving original control subroutine.

The state counter, when 0 in step #521, is set to 1 only when the sensor 153 of the containing portion 63 is on and when the start signal for the handler RDH is on.

When the counter value is 1, the transport belt motor is rotated forward, the original feed motor is energized, the original holder (pressure) solenoid is actuated, and the state counter is thereafter set to 1a (steps #531 to #533).

When the state counter is 1a, an original feeding process and the attendant original size detecting subroutine are executed, and the state counter is set to 1b, provided that the original positional signal is on with the original positioned in place on the glass platen 1 (steps #541 to #544 and #306).

When the state counter is lb, the guide unit 101 is advanced to the original discharge position in conformity with the original size, whereupon the state counter is set to 1c (steps #551 to #554).

When the state counter is 1c, the transport belt motor is rotated forward, an original discharge timer TN is started, and the state counter is set to 1d (steps #561 to #564).

When the state counter is 1d, the state counter is advanced to 2 on completion of operation of the timer TN (steps #571 to #573).

When the counter value is 2 and if the containing portion 63 is empty, the state counter is advanced to 3, whereas if the portion 63 is not empty, idle transport of originals and counting of the number of thereof are continued until the number is completely counted (steps #581 to #585). At this time, the handler is so controlled that after the first original has been discharged, the second original is fed as already stated.

When the state counter value is 3 and if the originals are not greater than 4 in number, the state counter is advanced to 4, or if the number of originals is greater than 4, the state counter is advanced to 5. Thus, different steps are taken depending on whether the number of originals is up to 4 or not (steps #591 to #594).

When the state counter value is 4, the first original is moved forward for copying. In step #603*a* through step #603*c*, the discharge sensor 200 goes off, followed by lapse of a predetermined period of time, which is interpreted as indicating that the original has been completely discharged and whereupon the state counter is advanced to 5 (steps #601 to #604).

With the state counter advanced to 5, copying of moving original is repeated with the number of copies incremented every time until the containing portion 63 becomes empty, whereupon the state counter is advanced to 6 (steps #611 to #615). Accordingly, the steps in this state are performed for the second original et seq. when the number of originals OD is up to 4, or for all the originals when the originals are over 4 in number.

When the state counter value is 6, the state counter is advanced to 7 upon completion of discharge of the last original (steps #621 to #623).

When the specified number of copies have been made at the state counter value of 7, the guide unit 101 is retracted to the home position, and the state counter is advanced to 11, whereas if the specified number of have not been completed, the state counter is advanced to 8 (steps #631 to #634).

When the state counter value is 8, a timer A is set for determining the distance the originals are to be pushed out, the guide unit 101 is advanced toward the pushing-out position, and the state counter is advanced to 9 (steps #641 to #644).

On completion of operation of the timer A with the counter advanced to 9, the guide unit 101 is stopped at the pushing-out position, a retraction timer B is set, and the guide unit 101 is moved away from the pushing-out position toward the original discharge position. The original holder solenoid is energized, causing the holder 113 to prevent the originals from being drawn rearward by the guide unit 101. The state counter is then advanced to 10 (steps #651 to #657).

On completion of operation of the timer B with the state counter advanced to 10, the guide unit 101 is stopped at the original discharge position. The original holder solenoid is deenergized, and the state counter value is changed to 3 (steps #661 to #664). This causes the handler to resume the feed operation subsequently.

When the state counter value is 11, the sensor 800 detects the return of the guide unit 101 to its home position, whereupon the guide unit 101 is stopped at the home position. The state counter is reset to 0, whereby the automatic feeding operation for the moving originals is finished (steps #671 to #673).

Figure 42:
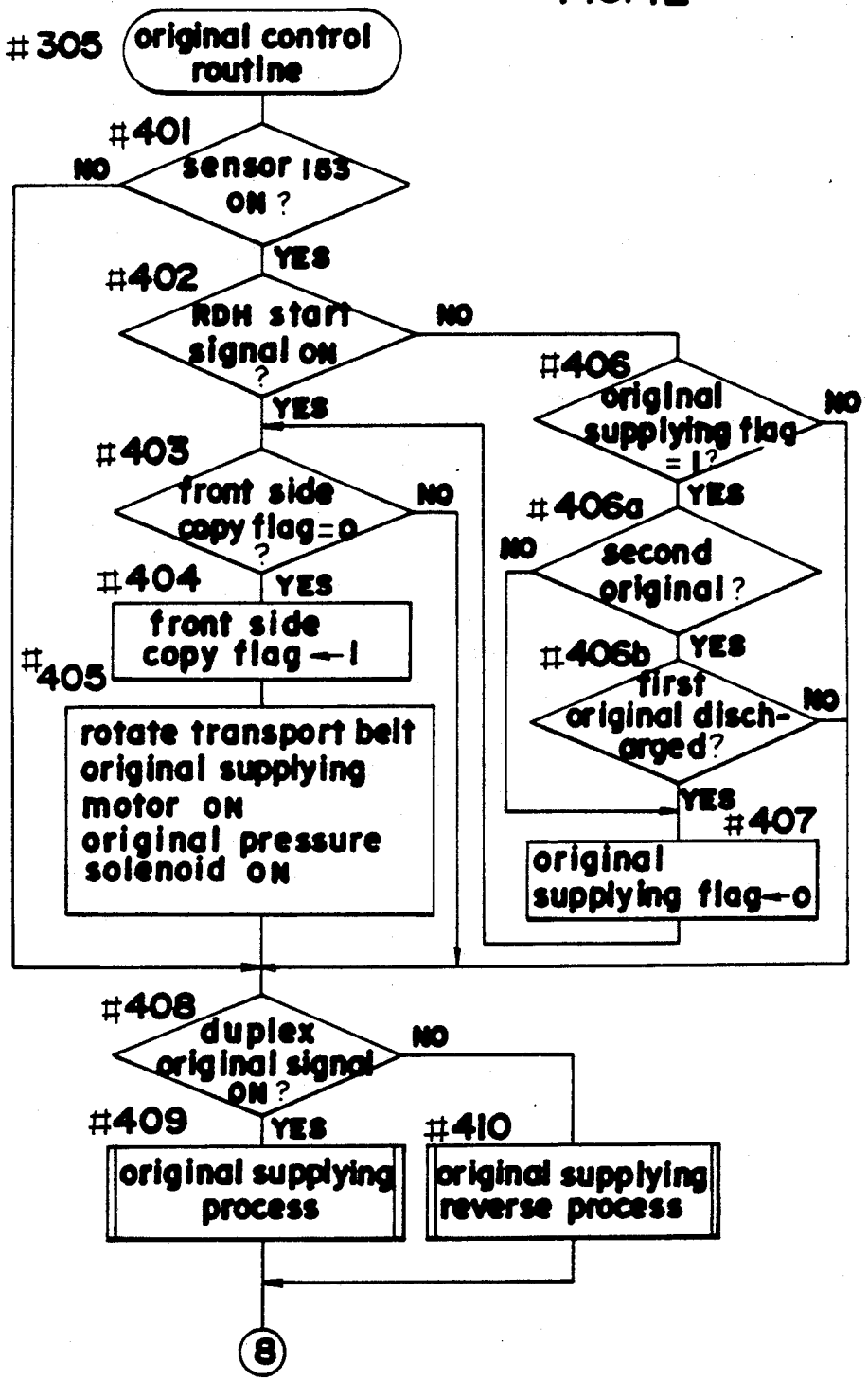
FIGS. 42 and 43 are flow charts showing an original control subroutine.
Figure 43:
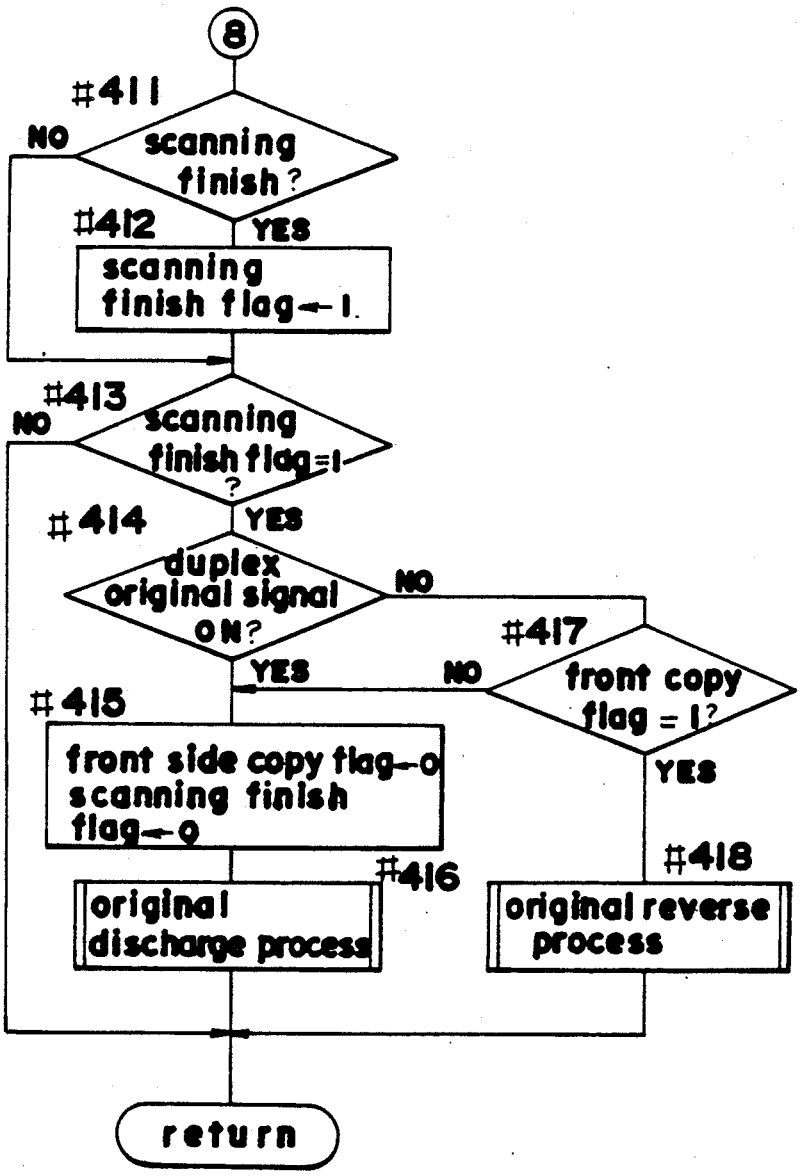

FIGS. 42 and 43 are flow charts showing the original control subroutine of FIG. 38. This routine starts with step #401. When the sensor 153 is found to be on owing to the presence of originals in the containing portion 63, and further when the RDH start signal is on (step #402), step #403 inquires whether the front side copy flag is "0". Only when it is "0", the flag is set to "1", the transport belt motor is rotated forward, and the original feed motor and the original holder solenoid are energized to feed the original for front-side copying (steps #404 and #405). If the RDH start signal is not on in step #402, an original supplying flag is checked as to whether it is "1". If it is "1" and when the second original is to be fed subsequently, the original supplying flag is reset to "0" on completion of discharge of the first original. The sequence then proceeds to step #403 et seq. (steps #406 and #407) for the subsequent feeding operation.

In step #408, an inquiry is made as to whether a duplex original signal is on. If it is on, an original supplying process subroutine is called up (step #409). If otherwise, an original supplying reverse process is called up (step #410).

Step #411 inquires whether scanning has been completed for the copies to be produced. If the answer is affirmative, a scanning finish flag is set to "1" (step #412). When this flag is found to be "1" in the next step #413, the sequence proceeds to step #414. If the duplex original signal is off in this step, the front copy flag and the scanning finish flag are reset to "0", whereupon an original discharge process subroutine is called up (steps #415 and #416). If the duplex original signal is not off in step #414, step #417 inquires whether the front side copy flag is "1". If it is "1", an original reverse process subroutine is called up (step #418) for back side copying. If otherwise, the sequence proceeds to steps #415 et seq.

Figure 44:
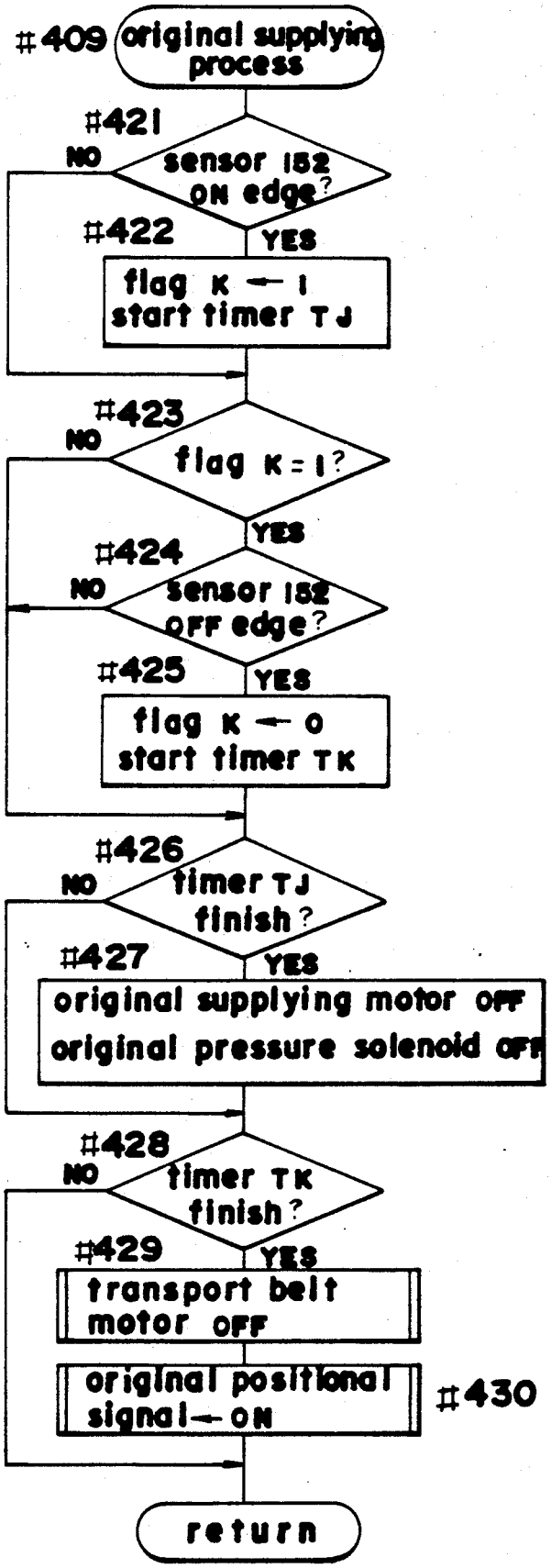
FIG. 44 is a flow chart showing an original supplying process subroutine.

FIG. 44 is a flow chart showing the original supplying process subroutine of FIG. 42. When the sensor 152 is found on edge in step #421, detecting the leading end of the original, a flag K is set to "1", and a feed completion timer TJ is started (step #422). When the flag K is "1" in the next step #423 and upon the sensor 152 becoming off edge, detecting the rear end of the original, the flag K is reset to "0", and an original positioning timer TK is started (steps #424 and #425).

Subsequently on completion of operation of the timer TJ, the original feed motor and the original holder solenoid are deenergized (steps #426 and #427). Further on completion of operation of the timer TK, the transport belt motor is turned off, with the original positioned in place in contact with the original scale 91, and the original positional signal is turned off (steps #428 to #430).

Figure 45:
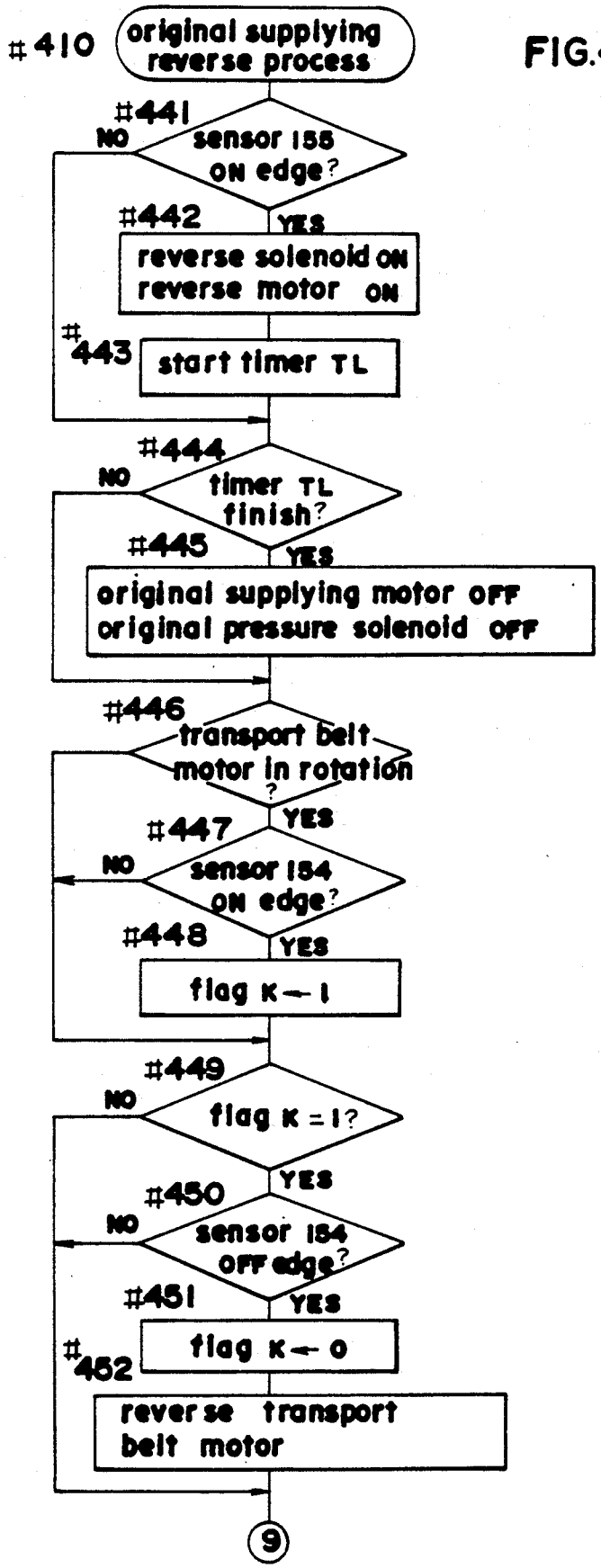
FIGS. 45 and 46 are flow charts showing an original supplying reverse process subroutine.
Figure 46:
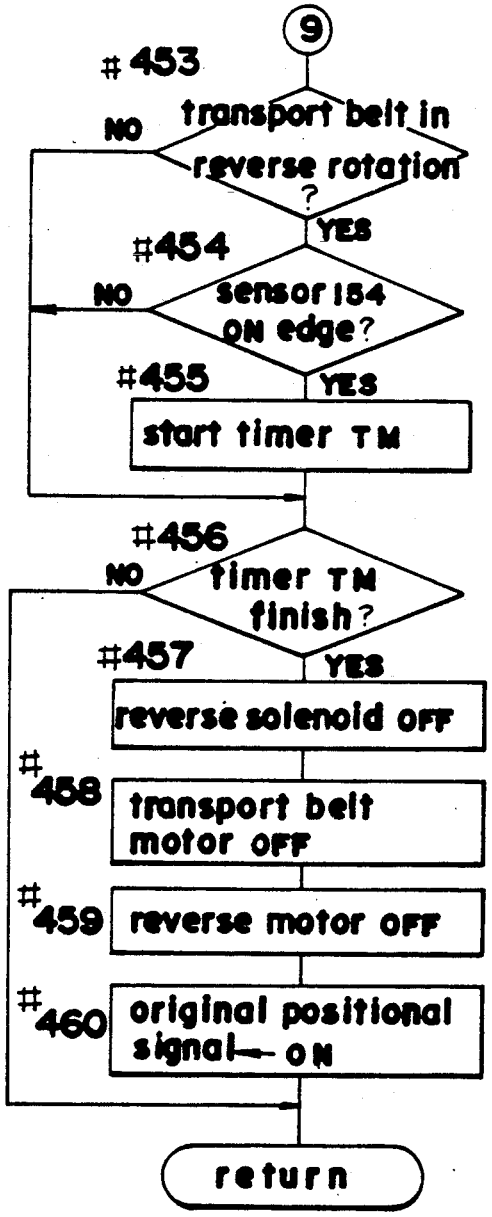

FIGS. 45 and 46 are flow charts showing the original supplying reverse process subroutine of FIG. 42. When the sensor 155 is on edge in step #441, a reverse solenoid for shifting the switch member 107 toward the inversion side and a reverse motor are energized, and a reverse feed completion timer TL is started (steps #442 and #443). Subsequently, on completion of operation of the timer TL, the original feed motor and the original holder solenoid are deenergized (steps #444 and #445). Since the transport belt motor is in forward rotation, the sensor 154 disposed between the straight channel portion 82 and the return transport channel 122 and the bent channel portion 83 becomes on edge to detect the leading end of the original, whereupon the flag K is set to "1" (steps #446 to #448).

With the flag K set to "1", the sensor 154 becomes off edge to detect the rear end of the original, whereupon the transport belt motor is reversely rotated (steps #449 to #452).

Since the transport belt motor is in reverse rotation, the sensor 154 subsequently becomes on edge again, detecting the leading end of the original forwarded from the bent channel portion 83 through the return transport channel 121, whereupon an inverted original positioning timer TM is started (steps #453 to #455). On completion of operation of the timer TM, the reverse solenoid, transport belt motor and reverse motor are deenergized to complete the inversion of the original and stop the inverted original in position on the glass platen 1. The original positional signal is turned on (steps #456 to #460).

Alternatively, the inverted original can be positioned in place by causing the original to overrun the original scale 91 and thereafter driving the transport belt motor forward to bring the original into contact with the scale 91.

Figure 47:
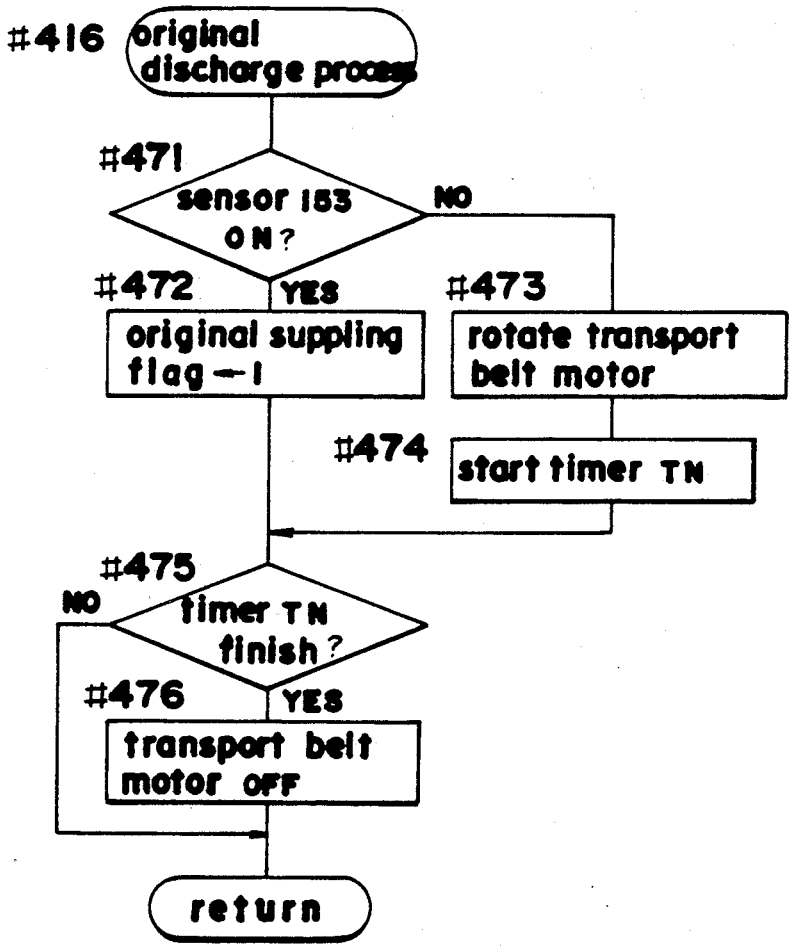
FIG. 47 is a flow chart showing an original discharge process subroutine.

FIG. 47 is a flow chart showing the original discharge process subroutine of FIG. 43. When the absence sensor 153 is on in step #471, the original supplying flag is set to "1" for the feed of the next original (step #472). If otherwise, the sensor 153 indicates that no original remains in the containing portion 63. The transport belt motor is then driven forward to discharge the original from the platen 1, and an original discharge completion timer TN is started (step #473 and #474). On completion of operation of the timer TN, indicating completion of discharge of the original, the belt motor is deenergized (step #476).

Figure 48:
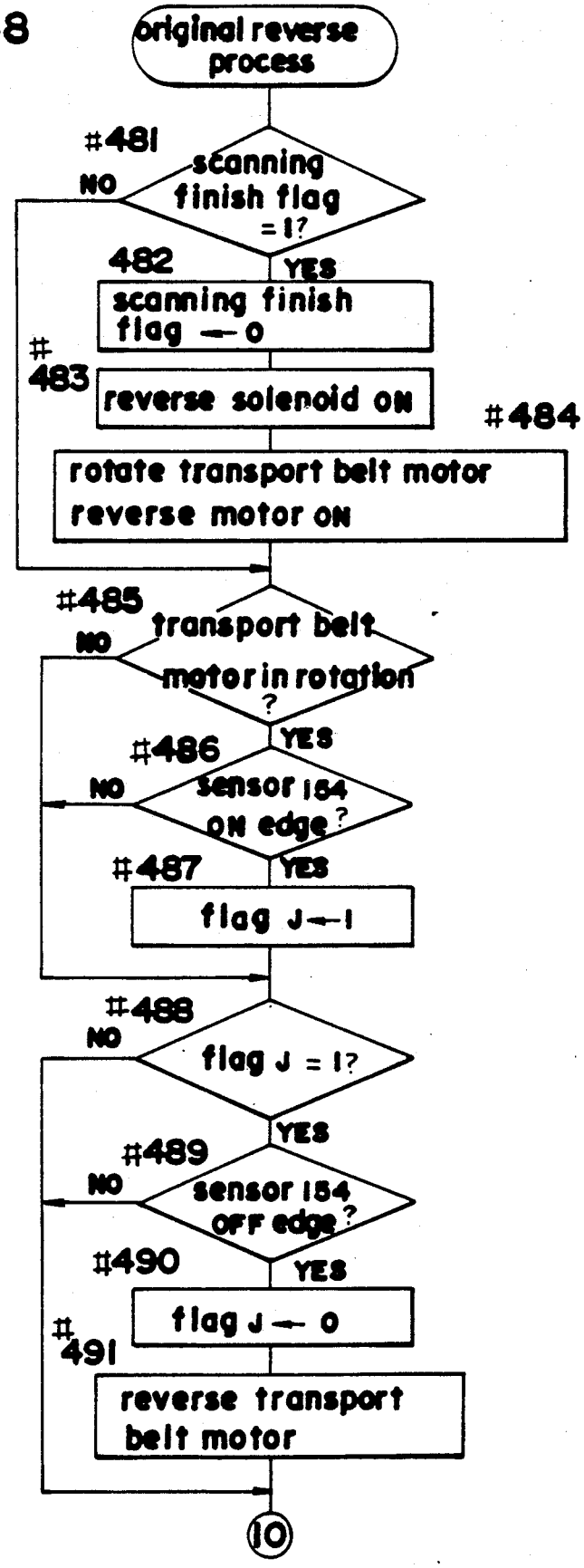
FIGS. 48 and 49 are flow charts showing an original reverse process subroutine.
Figure 49:
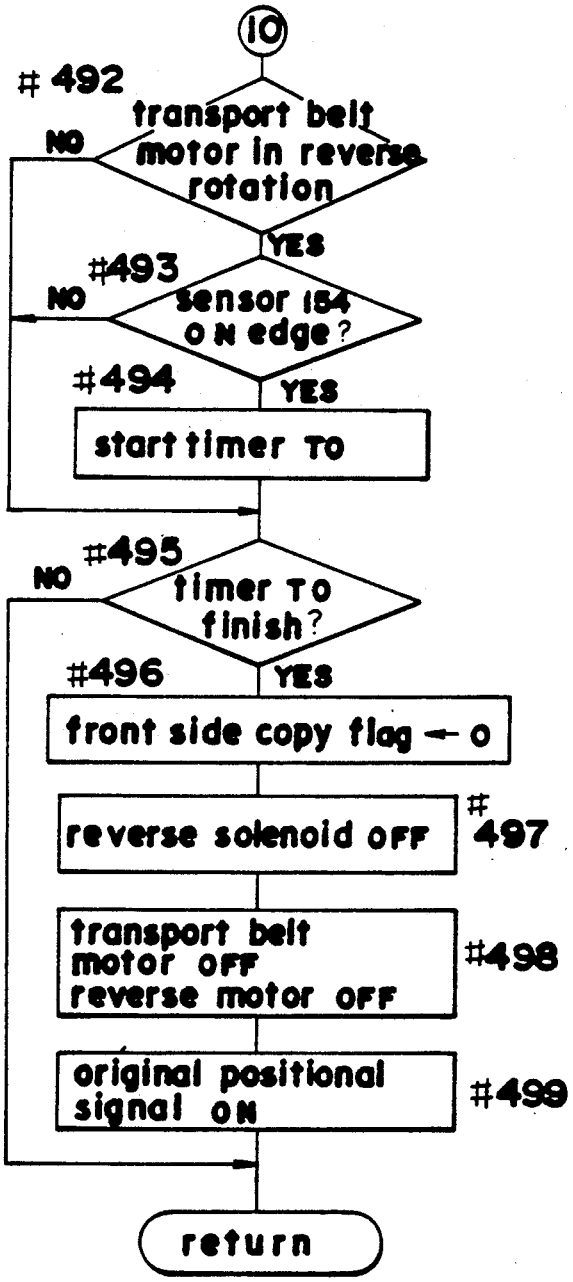

FIGS. 48 and 49 are flow charts showing the original reverse process subroutine of FIG. 43. A scanning finish flag, when found set to "1" in step #481, is reset to "0", and thereafter the reverse solenoid is energized, the transport belt motor is rotated forward and the reverse motor is energized to send out the original from the glass platen 1 once (steps #482 to #484).

Since the belt motor is in forward rotation, the sensor 154 subsequently becomes on edge, whereupon a flag J is set to "1" (steps #485 to #487). Upon the sensor 154 becoming off edge with the flag J set to "1", the flag J is reset to "0", and the transport belt motor ', is driven reversely (steps #488 to #491).

Since the belt motor is in reverse rotation, the sensor 154 subsequently becomes on edge again, whereupon an inverted original positioning timer TO is started (steps #492 to #494).

On completion of operation of the timer TO, the front side copy flag is reset to "0", and the reverse solenoid, belt motor and reverse motor are deenergized to place the inverted original in position on the glass platen 1. The original positional signal is then turned on (steps #495 to #499).

Figure 50:
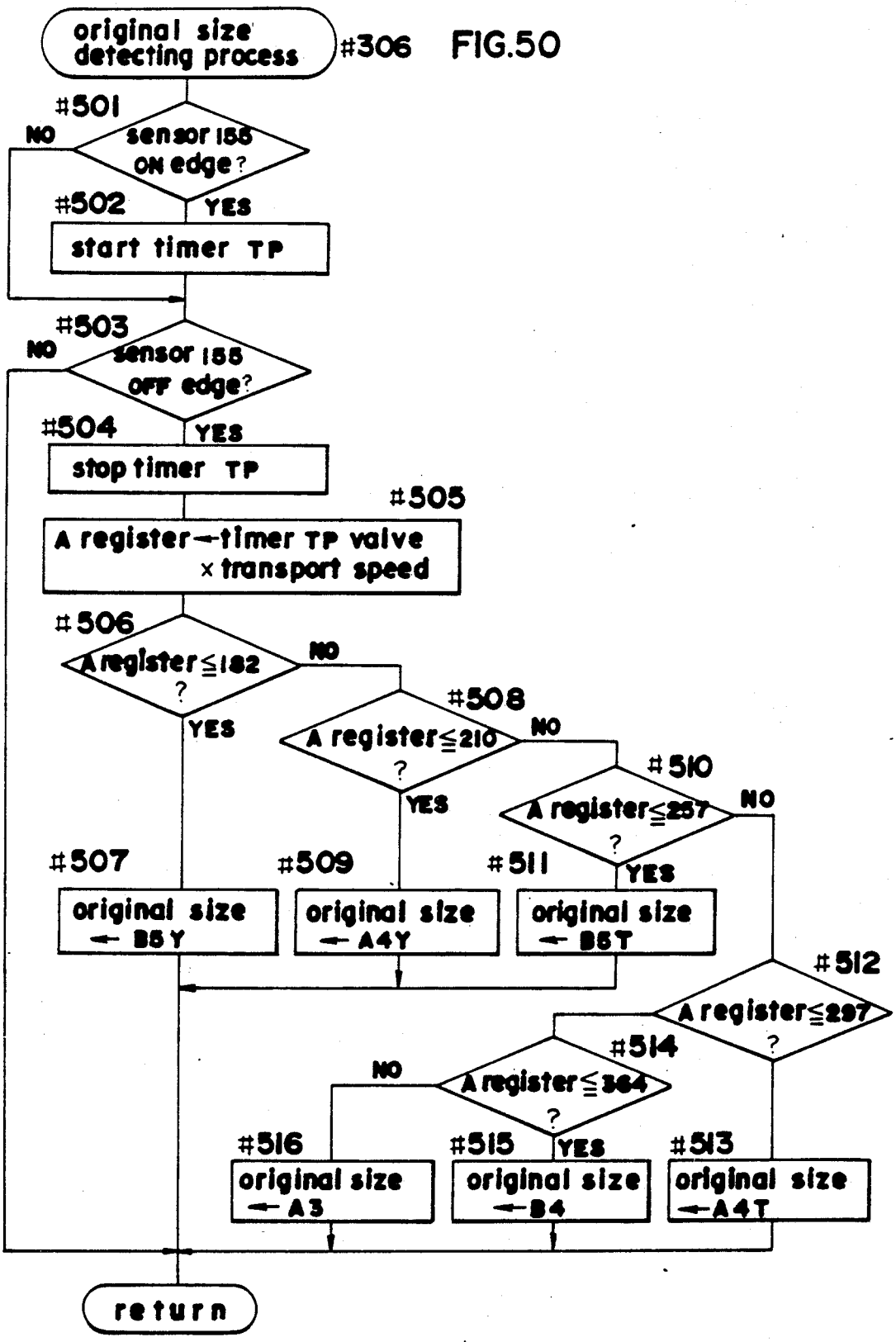
FIG. 50 is a flow chart showing the subroutine of an original size detecting process in the main routine of FIG. 38.

FIG. 50 is a flow chart showing the original size detecting process subroutine included in the main flow of FIG. 38. This routine of original size detection is performed in the usual original mode other than the two-in-one original mode. The duration of operation of a timer TP starting with the detection of original leading end by the sensor 155 (on edge) and ending with the detection of the original rear end (off edge) is utilized to detect the size of the original, and the detected size is set as the original size (steps #501 to #516).

This routine is performed for detecting not only the original size but also the orientation of the original being transported, i.e., whether the original is being transported with its long sides positioned transverse to the transport direction or in parallel thereto. For example, when an original of A4 size is being transported with its long sides positioned transverse to the transport direction, the original is identified as "A4 transverse" (represented as "A4Y" in FIG. 50), or when the long sides of the original are in parallel to the transport direction during transport, the original is identified as "A4 lengthwise" (referred to as "A4T" in FIG. 50).

Figure 51:
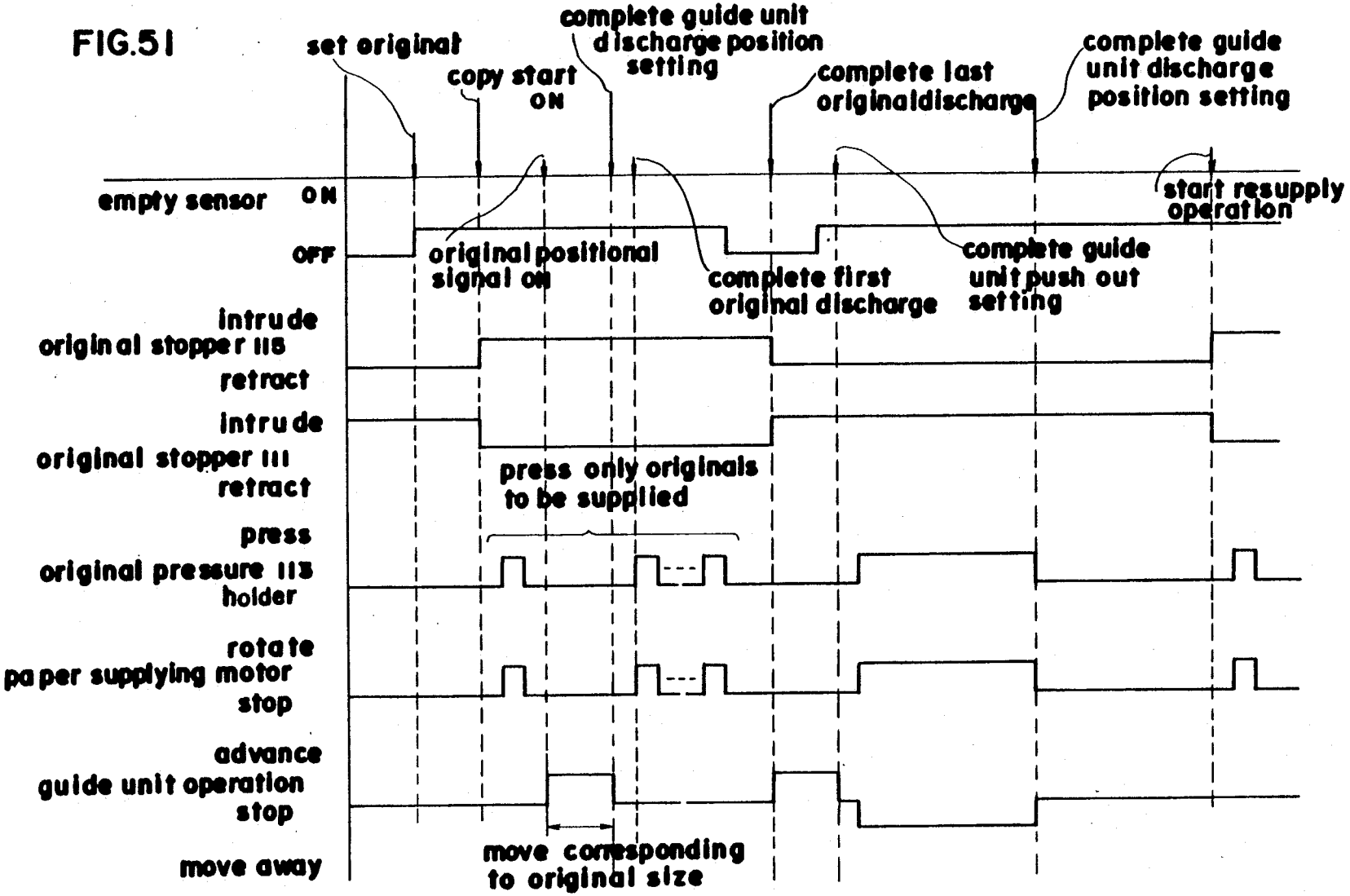
FIG. 51 is an operation time chart of main components of the handler.

FIG. 51 is an operation time chart of main components of the document handler RDH.

With the present embodiment, the transport roller 135, etc. disposed downstream from the transport belt 86 are not driven at a lower transport speed than the belt, whereas the transport roller 135 may be set to a lower transport speed than the belt 86 if the roller 135 acts on the original as positioned at the image scan point in the original moving scan mode depending on the position of the scan point.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An automatic original feeding handler for successively transporting to a reading portion on a platen of an image forming apparatus two originals, images of which are read at the reading portion, said automatic original feeding handler comprising:

an accommodating portion for accommodating originals stacked therein;

an inlet path connecting the accommodating portion and the platen;

a switchback path connected to the inlet path;

feeding means for feeding the originals stacked in the accommodating portion one by one;

transport means for advancing a first original fed by the feeding means along the inlet path and onto the platen; and control means for controlling the transport means so as to retreat into the switchback path the first original on the platen before a second original is fed by the feeding means.

2. The automatic original feeding handler as claimed in claim 1, wherein the feeding means feeds the second original after the first original is retreated in the switchback path, and then the second original is advanced to the reading portion on the platen together with the first original in the switchback path by the transport means.

3. The automatic original feeding handler as claimed in claim 1, wherein the transport means includes a plurality of rotatable rollers and a belt provided around the rollers, the rollers forwardly rotating for advancing the original fed from the accommodating portion onto the platen along the inlet path and backwardly rotating for retreating into the switchback path the original on the platen.

4. An automatic original feeding handler for successively transporting to a reading portion on a platen of an image forming apparatus two originals images of which are read at the reading portion, said automatic original feeding handler comprising:

an accommodating portion for accommodating originals stacked therein;

an inlet path connecting the accommodating portion and the platen;

a switchback path connected to the inlet path;

feed rollers rotated by a first driving means for feeding the originals stacked in the accommodating portion one by one;

transport means including a plurality of transport rollers rotated by a second driving means and a belt provided around the rollers for transporting the original fed by the feed rollers; and control means for controlling the activation of the first and second driving means, both of the first and the second driving means being activated upon feed of a first original from the accommodating portion for feeding and advancing the first original on the platen, thereafter only the second driving means being activated for retreating into the switchback path the first original on the platen, and then both of the first and second driving means being activated for feeding and advancing a second original together with the first original to the reading portion on the platen.

5. An automatic original feeding handler for successively transporting to a reading portion on a platen of an image forming apparatus two originals images of which are read at the reading portion, said automatic original feeding handler comprising:

an inlet through which originals are fed;

a first path connecting the inlet and the platen;

a second path connected to the first path;

feeding means for feeding the originals in the inlet one by one;

transport means for advancing a first original fed by the feeding means along the first path and onto the platen; and control means for controlling the transport means so as to retreat into the second path the first original on the platen before a second original is fed by the feeding means.

6. The automatic original feeding handler as claimed in claim 5, wherein the feeding means feeds the second original after the first original is retreated in the second path, and the second original is advanced to the reading portion on the platen together with the first original in the second path by the transport means.

7. The automatic original feeding handler as claimed in claim 5, wherein the transport means includes a plurality of rotatable rollers and a belt provided around the rollers, the rollers forwardly rotating for advancing the original fed from the inlet onto the platen along the first path and backwardly rotating for retreating into the second path the original on the platen.

8. An automatic original feeding handler for successively transporting to a reading portion on a platen of an image forming apparatus two originals images of which are read at the reading portion, said automatic original feeding handler comprising:

an inlet through which originals are fed;

a first path connecting the inlet and the platen;

a second path connected to the first path;

feed rollers rotated by a first driving means for feeding the originals in the inlet one by one;

transport means including a plurality of transport rollers rotated by a second driving means and a belt provided around the rollers for transporting the original fed by the feed rollers; and control means for controlling the activation of the first and second driving means, both of the first and the second driving means being activated upon feed of a first original from the inlet for feeding and advancing the first original on the platen, thereafter only the second driving means being activated for retreating into the second path the first original on the platen, and then both of the first and second driving means being activated for feeding and advancing a second original together with the first original to the reading portion on the platen.

9. A method for transporting two originals to a reading portion on a platen for sequential copying in an image forming apparatus, said method comprising the steps of:

feeding a first original from an accommodating portion which accommodates originals stacked therein;

advancing the first original on the platen;

retreating the trailing end of the first original on the platen with respect to an original advancing direction into a switchback path provided between the accommodating portion and the platen;

feeding a second original from the accommodating portion; and advancing the second original with the first original the trailing end of which is retreated into the switchback path to the reading portion on the platen.

10. A method for transporting two originals to a reading portion on a platen for sequential copying in an image forming apparatus, said method comprising the steps of:

feeding a first original from an inlet;

advancing the first original on the platen;

retreating the trailing end of the first original on the platen with respect to an original advancing direction into a path provided between the inlet and the platen;

feeding a second original from the inlet; and advancing the second original with the first original, the trailing end of which is retreated in the path to the reading portion on the platen.

* * * * *